US006091912A

United States Patent [19]

Kitajima et al.

[11] Patent Number: 6,091,912

[45] Date of Patent: Jul. 18, 2000

[54] TOWER SUPPLYING DEVICE AND IMAGE FORMING APPARATUS USING SAME TONER SUPPLYING DEVICE

[75] Inventors: Yuuji Kitajima, Kawasaki; Shunji Katoh, Sagamihara; Masasumi Yahata, Kamakura, all of Japan

[73] Assignee: Ricoh Company, Ltd., Tokyo, Japan

[21] Appl. No.: 09/236,626

[22] Filed: Jan. 26, 1999

[30] Foreign Application Priority Data

| | | | |
|---|---|---|---|
| Jan. 26, 1998 | [JP] | Japan | 10-027745 |
| Mar. 3, 1998 | [JP] | Japan | 10-067913 |
| Mar. 6, 1998 | [JP] | Japan | 10-073605 |
| Mar. 20, 1998 | [JP] | Japan | 10-092736 |
| Apr. 14, 1998 | [JP] | Japan | 10-120001 |

[51] Int. Cl.[7] ..... G03G 15/00

[52] U.S. Cl. ..... 399/13; 399/119; 399/258; 399/262

[58] Field of Search ..... 399/119, 120, 399/110, 107, 254, 256, 258, 262, 24, 27, 13, 9; 222/DIG. 1

[56] References Cited

U.S. PATENT DOCUMENTS

| | | | |
|---|---|---|---|
| 4,384,785 | 5/1983 | Katoh et al. | 399/190 |
| 5,053,820 | 10/1991 | Preszler et al. | 399/119 |
| 5,298,951 | 3/1994 | Kai | 399/27 |
| 5,493,382 | 2/1996 | Takagaki et al. | 399/359 |
| 5,604,575 | 2/1997 | Takagaki et al. | 399/359 |
| 5,678,121 | 10/1997 | Meetze, Jr. et al. | 399/262 X |
| 5,737,680 | 4/1998 | Takagaki et al. | 399/359 |
| 5,797,074 | 8/1998 | Kasahara et al. | 399/262 |
| 5,909,609 | 6/1999 | Yahata et al. | 399/258 |

FOREIGN PATENT DOCUMENTS

| | | |
|---|---|---|
| 2-277083 | 11/1990 | Japan . |
| 4-080779 | 3/1992 | Japan . |
| 7-020703 | 1/1995 | Japan . |
| 7-114255 | 5/1995 | Japan . |
| 7-219329 | 8/1995 | Japan . |
| 8-137227 | 5/1996 | Japan . |
| 9-292773 | 11/1997 | Japan . |

*Primary Examiner*—Sophia S. Chen

*Attorney, Agent, or Firm*—Oblon, Spivak, McClelland, Maier & Neustadt, P.C.

[57] ABSTRACT

A toner supplying device for supplying toner contained in a toner container attached to the toner supplying device to a developing device of an image forming apparatus. The toner supplying device includes a toner container insertion part configured such that a toner container is inserted therein from a front side of the toner supplying device. A toner container holder that detachably holds the toner container inserted into the toner container insertion part and toner discharged from the toner container held by the toner container holder is exhausted to a toner exhaust path. A toner delivery device delivers the toner, exhausted to the toner exhaust path, to the developing device of the image forming apparatus, by mixing the toner with air. The toner supplying device includes a covering device that covers and uncovers the toner container insertion part. The covering device includes a regulating device that regulates movement of the covering device to cover and uncover the toner container insertion part. The regulating device regulates movement of the covering device to cover and uncover the toner container insertion part when toner is being discharged from the toner container held by the toner container holder in the toner insertion part and releases regulating movement of the covering device when toner is not being discharged from the toner container held by the toner container holder in the corresponding toner container insertion part.

18 Claims, 47 Drawing Sheets

TOWER SUPPLYING DEVICE AND IMAGE FORMING APPARATUS USING SAME TONER SUPPLYING DEVICE

BACKGROUND OF THE INVENTION

1. Field of the Invention

This invention relates to a toner supplying device included in an image forming apparatus.

2. Discussion of the Background

In image forming apparatuses using electrophotography, such as copying apparatuses, facsimile apparatuses and printers, a latent image of image information is formed on a surface of a drum or belt-like shaped image bearing member by first uniformly charging the surface of the image bearing member and then exposing the charged surface with light modulated with the image information. The latent image is then developed by toner, and the developed toner image is transferred onto a recording medium, such as a sheet of paper directly or via an intermediate transfer member, thereby forming an image on the sheet of paper. The image forming apparatuses of this type include a developing device for developing the latent image by toner, and generally include a toner supplying device for supplying toner to the developing device as the developing device consumes the toner as a result of developing images.

A toner container containing toner is attached to the toner supplying device. Once the toner contained in the toner is consumed from being supplied to the developing device, the image forming apparatus generally stops the image forming operation and displays a message indicating that the toner container has run out of toner. The apparatus returns to an operable state once the toner container is replaced with a new toner container containing toner and the toner is supplied to the developing device.

As related art, Japanese Patent Laid Open Publication No. 2-277083 describes a toner supplying device having a plurality of toner containers, which are disposed near a developing device. The toner container chosen to supply toner to the developing device is changed by rotating the toner supplying device.

Japanese Patent Laid Open Publication No. 7-219329 describes a toner supplying device placed apart and connected to a developing device via a toner delivery device which delivers toner while mixing the toner with air.

Japanese Patent Laid Open Publications No. 4-80779 and No. 8-137227 describe a toner supplying device including a toner container accommodating device in which a plurality of toner containers can be attached. Toner discharged from each of the plurality of toner containers is merged with each other and conveyed to the developing device. Each of the plurality of toner containers is individually attachable to and detachable from the toner supplying device. The size of the toner container is made so that the container is easy to handle, and can be replaced with a new toner container without stopping the operation of the apparatus.

Japanese Patent Laid Open Publication No. 8-137227 further describes that the toner container accommodating device accommodates two toner containers. In addition, when a sensor detects non-existence of toner in a toner conveying pipe to a developing device, an agitator of one of the two toner containers, which has not been operated, begins to rotate to supply toner therefrom.

The Japanese Patent Laid Open Publication No. 4-80779 further describes a sensor to detect a toner container which is set in the toner supplying device, a detect device to detect non-existence of toner in the toner container, and a display device to display an indication to indicate that toner does not exist in the toner container of which the non-existence of toner is detected. In addition, the Japanese Patent Laid Open Publication No. 4-80779 describes that the toner container, which has first been set to the toner supplying device, is first set to start supplying toner to the developing device.

The Japanese Patent Laid Open Publication No. 8-137227 further describes that when a toner container is set to a toner container holder, a toner exit opening provided on an outer circumferential surface of the toner container is opened. Toner contained in the toner container is discharged from the toner exit opening by rotating an agitator provided inside the toner container. The agitator is rotated by an external drive device provided at a side of the toner container.

Also, Japanese Patent Laid Open Publication No. 7-5759 describes a toner container which includes an opening at one end to discharge toner. The opening is opened and closed by attaching and detaching a cap to the opening. The operation of attaching and detaching the cap is linked with an operation of an operator to replace the toner container, such that the operability of opening and closing the opening of the toner container with the cap is facilitated.

A toner supplying device including a plurality of toner containers, as described above in the background publications, has a problem in that the operability of attaching and detaching a toner container to and from the toner supplying device is poor. Further, rotating parts of the toner supplying device, which are exposed, may incur danger of hurting an operator when the operator attaches and detaches a toner container to and from the toner supplying device. Furthermore, toner scatters when a toner container is inserted into the toner supplying device through an insertion inlet for the toner container.

In addition, the toner supplying device including a plurality of toner containers, as described above in the background publications, has another problem in that, if an operator sets an empty toner container (i.e., a toner container containing no toner), the set empty toner container is not detected to be empty until an operating toner container becomes empty and the set empty toner container starts to be operated. This causes an intermittent supply of toner to a developing device, and thereby causes a decrease in the density of the toner in the developing device. Consequently, the resulting image quality is deteriorated. Stoppage of the image forming operation may also be caused.

Furthermore, the toner supplying device including a plurality of toner containers, as described in the above background publications, has yet another problem in that an operator cannot easily recognize both the non-existence of toner in each toner container and the nonexistence of a toner container itself in the toner supplying device. In addition, recognizing the remaining amount of toner in each of the toner containers is not easy. This causes a delay in replacing an empty toner container, which is erroneously set or a toner container whose toner is used up, and thereby causes a delay in supplying toner to the developing device. Consequently, toner is intermittently supplied to the developing device. Further, if an operator replaces a toner container whose toner is not completely used up without knowing that some toner remains in the toner container, toner may be scattered when the toner container is replaced. Thus, toner may be unnecessarily wasted.

In addition, toner supplying device in which a plurality of toner containers, as described above in the background publications, has still another problem because the operation of opening and closing a toner exit opening of a toner container with a cap is linked with the operation of replacing the toner container and moving the toner container to a position to start supplying toner therefrom. Therefore, if the toner container is replaced when the toner container is positioned at an interim position between the position where the toner container is replaced and the position where the toner container starts to supply toner therefrom, the cap is closed insufficiently, and thus the cap may fall inside a toner container accommodating unit, subsequently hindering the operation of replacing the toner container, or toner may scatter and stain the inside of the toner supplying device.

In addition, an image forming apparatus including a toner supplying device having a plurality of toner containers, as described above in the background art, has another problem in that attachment of the toner supplying device to the main body of the image forming apparatus at an assembling line, when the apparatus is installed at a user's place for use, or when the apparatus is overhauled is too complicated.

SUMMARY OF THE INVENTION

The present invention has been made in view of the above-discussed problems and an object of the invention is to address and resolve these and other problems. A non-exhaustive description of the features and attributes of the invention is presented in this section, with a more complete description provided by the figures and description of the preferred embodiment section of this document.

A feature of the present invention is a novel toner supplying device for supplying toner to a developing device of an image forming apparatus, in which the operability of attaching and detaching a toner container to and from the toner supplying device is improved with a simple configuration, and scattering of toner and danger of hurting an operator are prevented when an operator attaches and detaches a toner container to and from the toner supplying device.

The present invention further provides a novel toner supplying device that prevents stoppage of toner supply to a developing device and thereby prevents a decrease of the density of toner in the developing device. Consequently, deterioration of the resulting image quality is prevented, even when an empty toner container is set to the toner supplying device when one of a plurality of toner containers is replaced. The novel toner supplying device further prevents stoppage of the image forming operation due to stoppage of toner supply to the developing device, even when an empty toner container is set to the toner supplying device.

Furthermore, the present invention provides a novel toner supplying device in which the remaining amount of toner in a toner container set in the toner supplying device can be easily recognized via appropriate indications, and the operability of attaching and detaching a toner container for replacement is improved. Thereby scattering of toner when a toner container is replaced, an intermittent toner supply to the developing device and stoppage of the image forming operation are prevented.

Still furthermore, the present invention provides a novel toner supplying device in which the operability of opening and closing a toner exit opening of a toner container with a cap is improved, such that the opening is securely opened and closed by the cap. Thereby, the cap is prevented from falling off; the toner is not scattered, the inside of the toner supplying device is not stained, and the toner is not unnecessarily consumed.

The present invention further provides a novel image forming apparatus in which a toner supplying device can be attached to the main body of the apparatus in a safe and easy manner when the apparatus is assembled at an assembling line or when the apparatus is installed or overhauled at a user's location.

The above described, as well as may other attributes and features, are offered by a novel toner supplying device for supplying toner, contained in each of a plurality of toner containers attached to the toner supplying device, to a developing device of an image forming apparatus, according to the present invention. The toner supplying device includes a toner container insertion part that is configured such that a toner container is inserted therein from a front side of the toner supplying device. A toner container holder detachably holds the toner container inserted into the toner container insertion part and toner discharged from the toner container held by the toner container holder is exhausted to a toner exhaust path. A toner delivery device delivers the toner, exhausted to the toner exhaust path, to the developing device of the image forming apparatus, by mixing the toner with air. The toner supplying device of the present invention includes a covering device that covers and uncovers the toner container insertion part. The covering device includes a regulating device that regulates movement of the covering device to cover and uncover the toner container insertion part. The regulating device regulates movement of the covering device to cover and uncover the toner container insertion part when toner is being discharged from the toner container held by the toner container holder in the toner insertion part and releases regulating movement of the covering device when toner is not being discharged from the toner container held by the toner container holder in the corresponding toner container insertion part.

According to another feature of the present invention, a toner supplying device is provided for supplying toner contained in a toner container attached to the toner supplying device to a developing device of an image forming apparatus. The device includes a first detect device that detects existence of toner being discharged from the opening of the toner container inserted in each of the toner container insertion parts and a second detect device that detects in cooperation with the first detect device existence of an empty toner container inserted in the toner container insertion parts. The second detect device includes a display device to indicate a detect result of the second detect device. The second detect device detects existence of an empty toner container inserted in the toner container insertion parts by first detecting that a toner container in the toner container insertion parts has been removed and another toner container has been inserted, and then detecting existence of toner being discharged from the another toner container with the first detect device.

Further, a novel toner supplying device for supplying toner contained in a toner container attached to the toner supplying device to a developing device of an image forming apparatus, according to the present invention, includes a toner container detect device. The toner container detect device detects existence of the toner container inserted in the toner insertion part and held by the toner container holder. Also included is toner detect device that detects existence of toner in the toner container inserted in the toner insertion part and held by the toner container holder. The toner supplying device is further provided with a display device that displays an indication indicating results of detecting the existence of the toner container with the toner container detect device and the existence of toner in the toner container with the toner detect device. The display device displays the indication indicating results of detecting the existence of the toner container with the toner container detect device and the existence of toner in the toner container with the toner detect device individually for each of the insertion inlets. The display device also displays separate indications indicating that the toner container exists and toner exists in the container, that the toner container exists and the container is running low on toner or is out of toner, and that no toner container exists. The toner supplying device determines to supply toner or to stop supplying toner to the developing device based upon a result of detecting an existence of the toner container with the toner container detect device and stops supplying toner to the developing device when the toner container detect device detects non-existence of the toner container at least in one of the toner container insertion parts. The toner supplying device may further include a shutter for each of the toner container insertion parts that opens and closes communication between the toner container insertion parts and the toner conveying path. In addition, and the shutter closes or opens the communication between the toner container insertion part and the toner conveying path in accordance with a result of detecting with the toner container detect device existence of the toner container in a corresponding toner container insertion part. The shutter closes the communication between the toner container insertion part, in which no toner container is inserted, and the toner conveying path, and opens the communication between the toner container insertion part, in which the toner container is inserted, and the toner conveying path. The toner supplying device may further stop supplying toner to the developing device when the toner container detect device detects non-existence of the toner container in each of the toner container insertion parts. Further, an image forming apparatus including the toner supplying device, according to the present invention, may include a toner supply display device that displays an indication indicating results of detecting the existence of the toner container with the toner container detect device and the existence of toner in the toner container with the toner detect device.

According to another aspect of the present invention, a toner supplying device for supplying toner contained in a toner container attached to the toner supplying device to a developing device of an image forming apparatus, includes a toner container insertion part that detachably accommodates a toner container with an opening of the toner container to discharge toner therethrough being positioned at a rear end side of the toner supplying device. Also included is an open/close device that opens and closes the opening of the toner container inserted in the toner container insertion part by moving a cap of the toner container in directions to open and close the opening of the toner container, respectively. The open/close device includes a moving member to move the cap in the directions to open and close the opening of the toner container, respectively. A drive device applies to the moving member of the open/close device a force to move the moving member in directions to move the cap of the toner container inserted in the toner container insertion part in the directions to open and close the opening of the toner container, respectively. The drive device is configured so as to prevent the moving member of the open/close device from being moved when the drive device does not apply the force to move the moving member. The open/close device may include a detect device that detects positions of the moving member to open and close the opening of the toner container with the cap of the toner container, respectively. The open/close device may also include a stepping motor, and the moving member is moved to the positions to open and close the opening of the toner container with the cap by the force given to the moving member with the stepping motor. Further, the open/close device may include a shock absorbing member at positions of the moving member to open and close the opening of the toner container with the cap of the toner container, respectively. The toner supplying device of the present invention may further include a toner container removal preventing device that prevents a toner container from being removed from the toner container insertion part in cooperation with the moving member of the open/close device, when the moving member is in the position to close the opening of the toner container with the cap of the toner container.

Furthermore, according to the present invention, an image forming apparatus including a toner supplying device is provided that supplies toner contained in each of a plurality of toner containers attached to the toner supplying device to the developing device with a holder that detachably holds the toner supplying device. The toner supplying device holder includes an opening for inserting the toner supplying device, that extends through an outer circumferential surface of the image forming apparatus. The opening may be provided such that the toner supplying device is inserted into and removed from the apparatus from a front side of the apparatus or a side of the apparatus where an exit to exit a copysheet is located. The toner supplying device holder includes a first guide member that is provided at the side of the toner supplying device to guide the toner supplying device in a direction to be inserted into and removed from the apparatus. The toner supplying device holder may further include a second guide member provided on a circumferential surface of the image forming apparatus to guide the toner supplying device in the directions to be inserted into and removed from the apparatus. The toner supplying device holder may also include a positioning member to position the toner supplying device in a position to be attached to the image forming apparatus. In addition, the toner supplying device may include a handhold, and a fixing device to fix the toner supplying device to the apparatus.

Other objects, features and advantages of the present invention will become apparent from the following detailed description when read in conjunction with the accompanying drawings. Furthermore, while the drawings and descriptions illustrate specific structures, the present specification clearly explains the function, concepts and attributes of the present invention in sufficient detail so as to make clear all possible equivalent structures and techniques obtaining the desired result as discussed herein.

BRIEF DESCRIPTION OF THE DRAWINGS

A more complete appreciation of the present invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1:
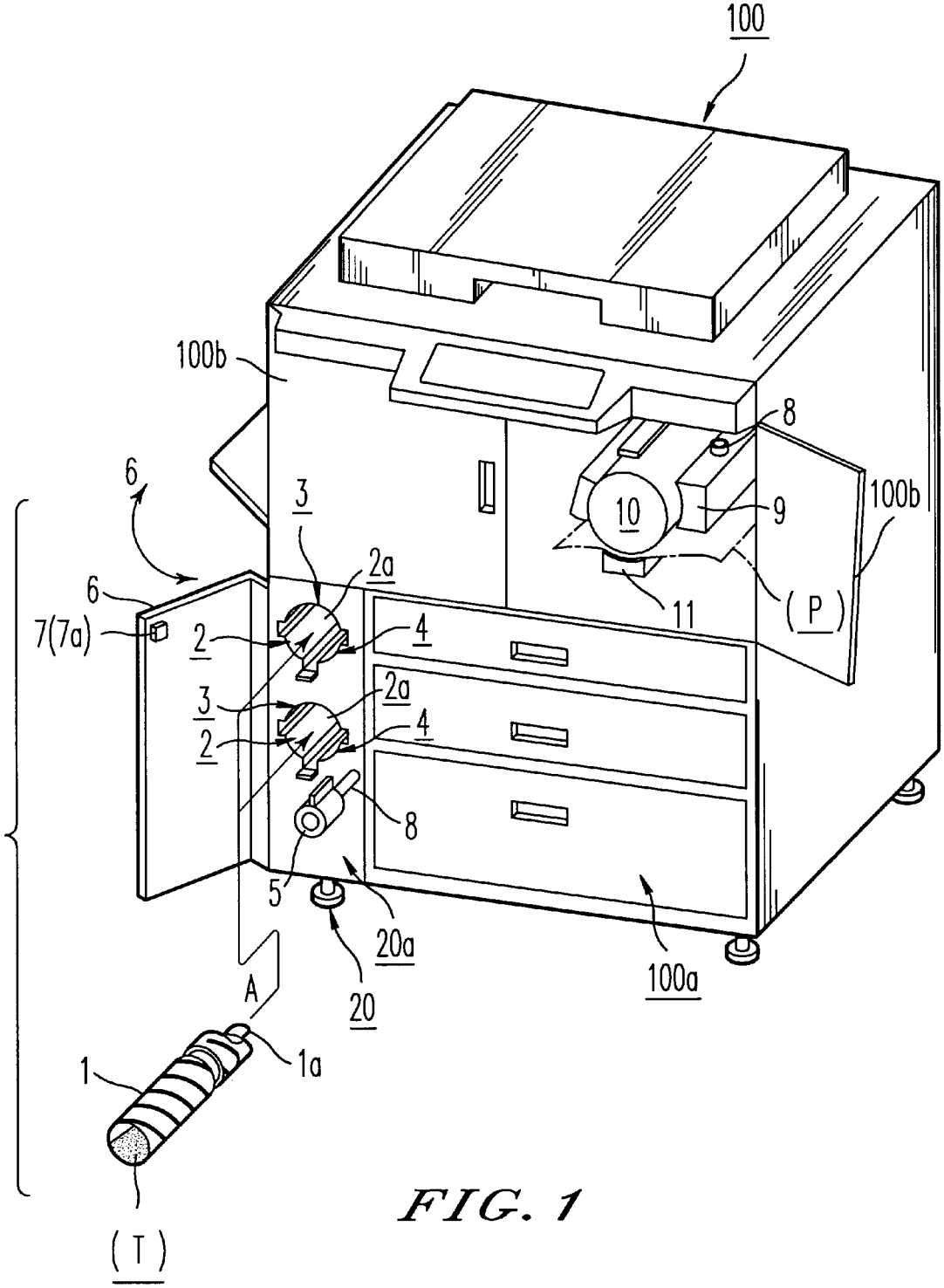
FIG. 1 is a schematic drawing illustrating an example of an image forming apparatus incorporating a toner supplying device according to an embodiment of the present invention.

In describing preferred embodiments of the present invention illustrated in the drawings, specific terminology is employed for the sake of clarity. However, the present invention is not intended to be limited to the specific terminology so selected and it is to be understood that each specific element includes all technical equivalents which operate in a similar manner.

Referring now to the drawings, wherein like reference numerals designate identical or corresponding parts throughout the several views, and more particularly to FIG. 1 thereof, there is illustrated an overall view of a configuration of an image forming apparatus incorporating a toner supplying device according to an exemplary embodiment of the present invention.

In FIG. 1, an image forming apparatus 100 includes an image carrier 10 and a developing device 9 at an upper right part of the apparatus 100 in the drawing. A toner bank 20 as a toner supplying device is arranged at a lower left part of the apparatus 100, apart from the developing device 9, in this embodiment. The toner bank 20 is configured such that two pieces of a toner container 1, each containing toner therein, can be attached to the toner bank 20 from a front side 20*a* of the toner bank 20. Two toner container insertion parts 2 that respectively receive a toner container 1 are arranged vertically, and a toner insertion inlet 2*a* is opened at the front side 20*a* of the toner bank 20 for each toner insertion part 2 as illustrated in the drawing. The toner container 1 is inserted into the toner insertion part 2 in a direction indicated by an arrow A through the toner insertion inlet 2*a* and then held by a toner container holder 3.

When the toner container 1 is held by the toner container holder 3, toner (T) contained in the container 1 is discharged through an opening 1*a*, which is provided at an axial end of the container 1 in the direction in which the container 1 is inserted into the toner container insertion part 2, to a toner exhaust path 4 which is provided at a rear end side of the toner container insertion part 2. Then, the discharged toner is mixed with air by a toner delivery device 5 and conveyed to the developing device 9 via a toner/air mixture conveying path 8.

The toner bank 20 includes a cover 6 as a covering device to cover the entire surface of the front side 20*a* of the toner bank 20, including the toner container insertion parts 2. The cover 6 is configured so as to swing open and close to cover and uncover the surface of the front side 20*a* of the toner bank 20. The cover 6 is arranged so as to be free from a front cover 100*b* of the image forming apparatus 100, which covers a part of the apparatus 100 containing the image carrier 10 and the developing device 9. When the cover 100*b* is opened, the apparatus 100 stops an image forming operation. The cover 6 is held at one side so as to open and close in a direction indicated by an arrow C. Further, a regulating device 7 is arranged so as to regulate the movement of the cover 6 to open and close. The regulating device 7 includes a magnet 7*a*, which regulates the movement of the cover 6 to open and close and releases the regulation of the movement of the cover 6 to open and close.

Figure 2:
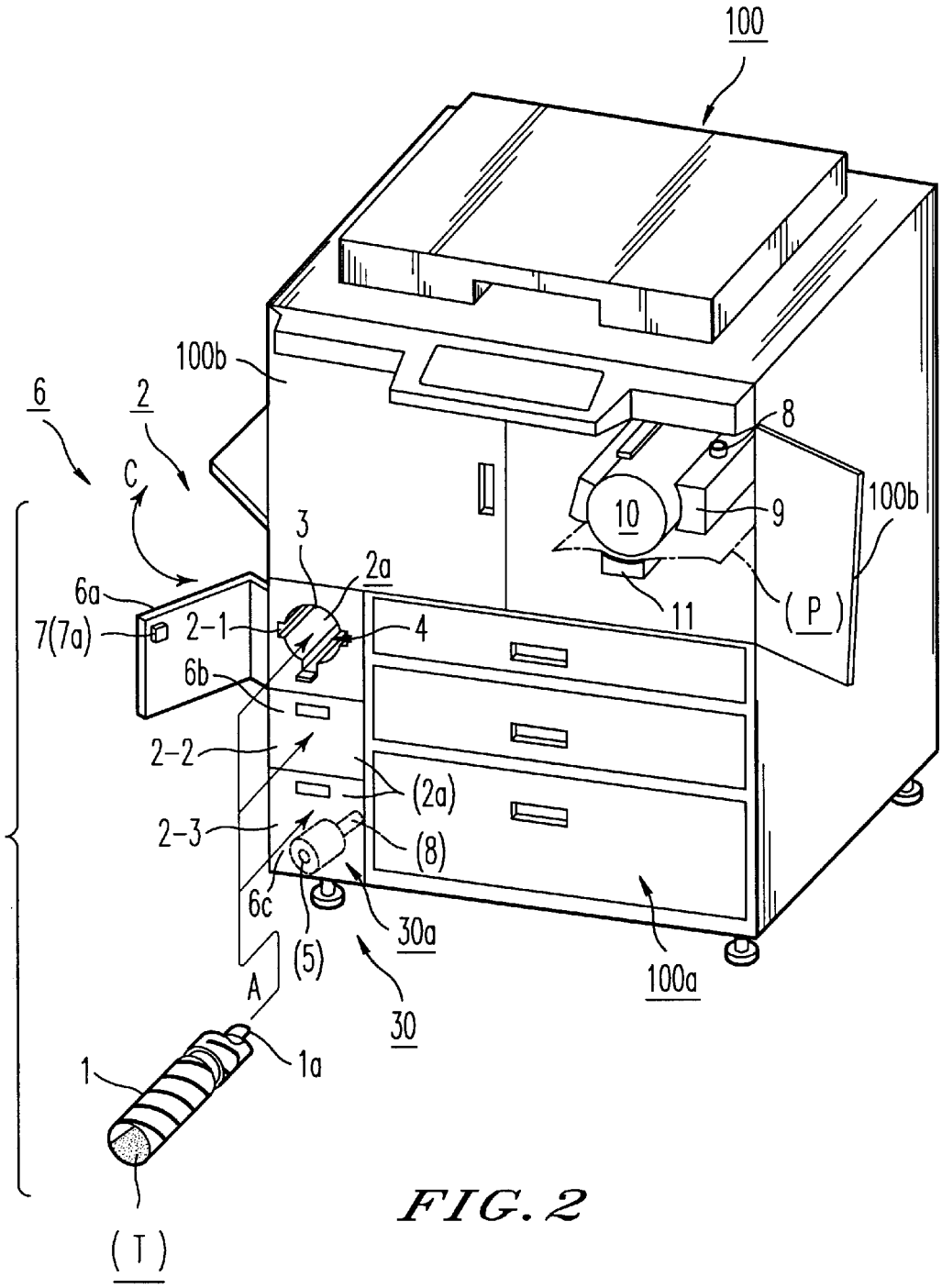
FIG. 2 is a schematic drawing illustrating an example of an image forming apparatus incorporating a toner supplying device according to another embodiment of the present invention.

FIG. 2 is a schematic drawing illustrating an example of an image forming apparatus incorporating a toner supplying device according to another embodiment of the present invention. An image forming apparatus 100 includes an image carrier 10 and a developing device 9 at an upper right part of the apparatus 100 in the drawing. A toner bank 30 as a toner supplying device is arranged at a lower left part of the apparatus 100, apart from the developing device 9.

The toner bank 30 is configured such that three pieces of a toner container 1, each containing toner therein, can be attached to the toner bank 30 from a front side 30*a* of the toner bank 30. Specifically, three toner container insertion parts 2-1, 2-2 and 2-3 that respectively receive a toner container 1 are arranged vertically, and a toner container insertion inlet 2*a* is opened at the front side 30*a* of the toner bank 30 for each of the toner insertion parts 2-1, 2-2 and 2-3 as illustrated in the drawing. The toner container 1 is inserted into each of the toner insertion parts 2-1, 2-2 and 2-3 in a direction indicated by an arrow A through each toner insertion inlet 2*a* and then held by a toner container holder 3.

When the toner container 1 is held by the toner container holder 3 and is operated to discharge toner therefrom, toner (T) contained in the container 1 is discharged through an opening 1*a*. The opening 1*a* is provided at an axial leading end of the container 1 in the direction in which the container 1 is inserted into each of the toner container insertion parts 2-1, 2-2 and 2-3. The toner is thus discharged into a toner exhaust path 4 provided at a rear end side of the toner container insertion parts 2-1, 2-2 and 2-3. Then, the exhausted toner is mixed with air by a toner delivery device 5 and is conveyed to the developing device 9 via a toner/air mixture conveying path 8.

The toner bank 30 includes covers 6*a*, 6*b* and 6*c* that respectively cover the surfaces of the front side 30*a* of the toner bank 30, including the toner container insertion parts 2-1, 2-2 and 2-3. The covers 6*a*, 6*b* and 6*c* are respectively configured so as to swing open and close, such that the surfaces of the front side 30*a* of the toner bank 30 are covered and uncovered by the covers 6*a*, 6*b* and 6*c*, respectively. The covers 6*a*, 6*b* and 6*c* are arranged so as to be free from a front cover 100*b* of the image forming apparatus 100, which covers the part of the apparatus 100 containing the image carrier 10 and the developing device 9. When the cover 100*b* is opened, the image forming apparatus 100 stops the image forming operation. The covers 6*a*, 6*b* and 6*c* are held at one side so as to open and close in a direction indicated by an arrow C, respectively. Further, a regulating device 7 is arranged for each of the covers 6*a*, 6*b* and 6*c* so as to regulate movement of the covers 6*a*, 6*b* and 6*c* to open and close, respectively. The regulating device 7 for each of the covers 6*a*, 6*b* and 6*c* includes a magnet 7*a*, which regulates the movement of the covers 6*a*, 6*b* and 6*c* to open and close and releases the regulation of the movement of the covers 6*a*, 6*b* and 6*c* to open and close, respectively.

Figure 3:
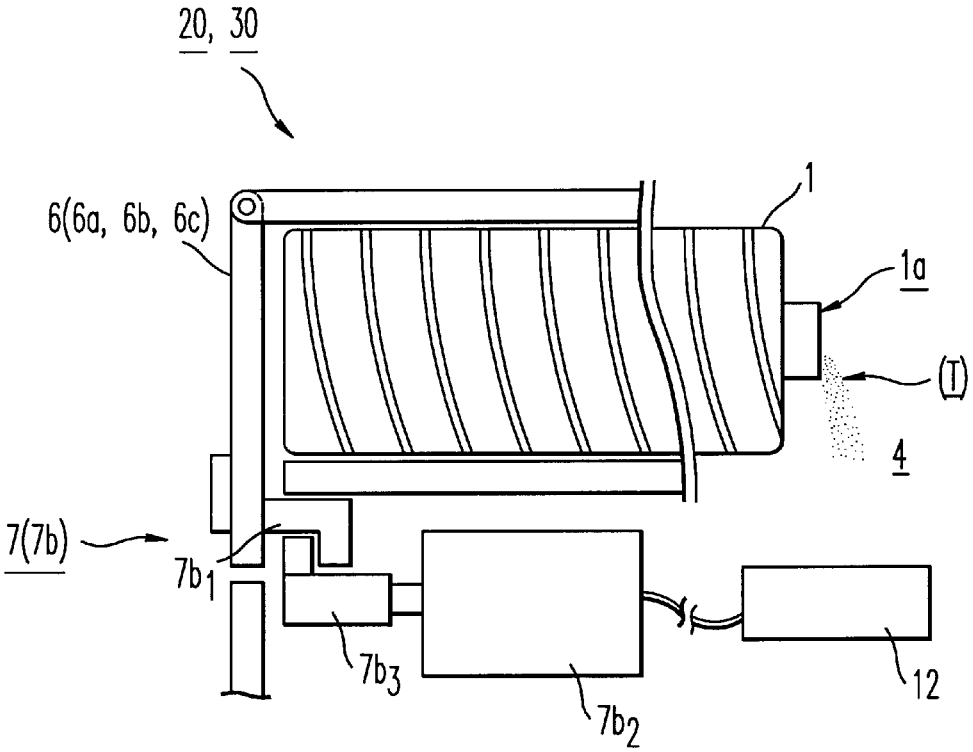
FIGS. 3 and 4 are schematic drawings illustrating a sectional view of the main part of the toner supplying devices incorporated in the image forming apparatuses of FIGS. 1 and 2.
Figure 4:
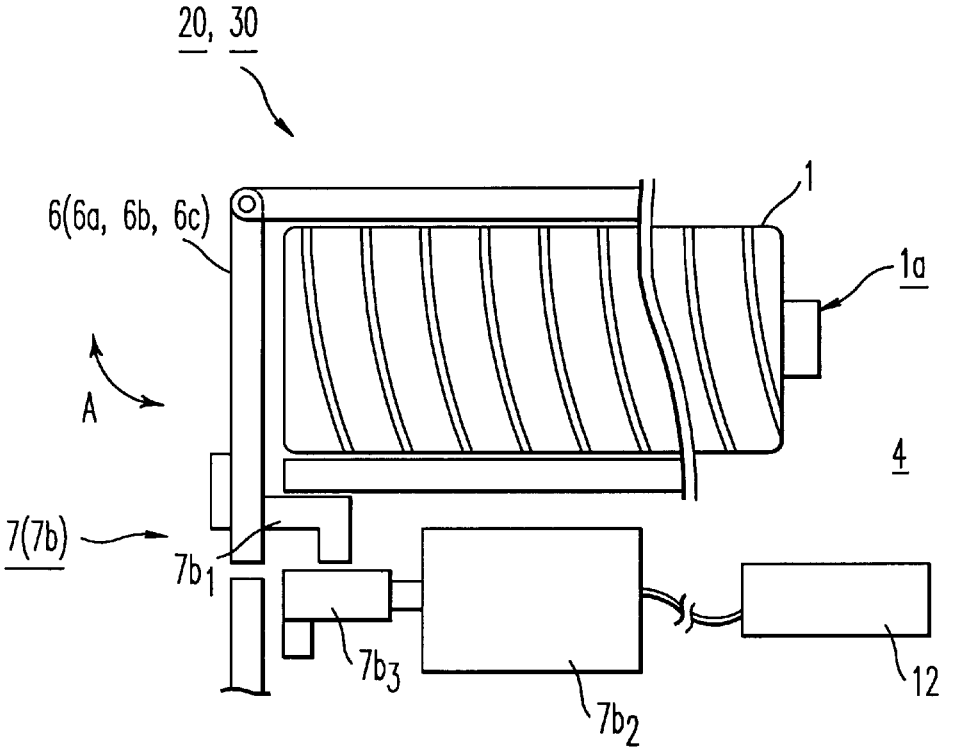

FIGS. 3 and 4 are schematic drawings illustrating a sectional view of a main part of the toner banks 20 and 30, respectively. As illustrated in the drawings, the regulating device 7 for the cover 6 in the toner bank 20 and the regulating device 7 for each of the covers 6*a*, 6*b* and 6*c* of the toner bank 30 respectively further include a locking device 7*b* that regulates and releases movement of the cover 6 of the toner bank 20 and the covers 6*a*, 6*b* and 6*c* of the toner bank 30.

The locking device 7*b* includes a crank-like shaped member 7*b*1, which is provided to the cover 6 of the toner bank 20 and to each of the covers 6*a*, 6*b* and 6*c* of the toner bank 30. Also included is an engaging member 7*b*3, which engages with and disengages from the crank-like shaped member 7*b*1 by a rotation movement of a motor 7*b*2, which is provided at the side of the toner banks 20 and 30, respectively.

Referring to FIG. 3, when the toner container 1 is discharging toner (T) through the opening 1*a* to the toner exhaust path 4, a controller 12 controls the crank-like shaped member 7*b*1 and the engaging member 7*b*3 to be engaged with each other by the rotation movement of the motor 7*b*2, such that the cover 6 of the toner bank 20 and each of the covers 6*a*, 6*b* and 6*c* of the toner bank 30 do not open. When the toner container 1 is not discharging toner through the opening 1*a* to the toner exhaust path 4, the controller 12 controls to release the engagement of the crank-like shaped member 7*b*1 and the engaging member 7*b*3 by the rotation movement of the motor 7*b*2, such that the cover 6 and each of the covers 6*a*, 6*b* and 6*c* can be opened in a direction indicated by an arrow H, as illustrated in FIG. 4.

Figure 5:
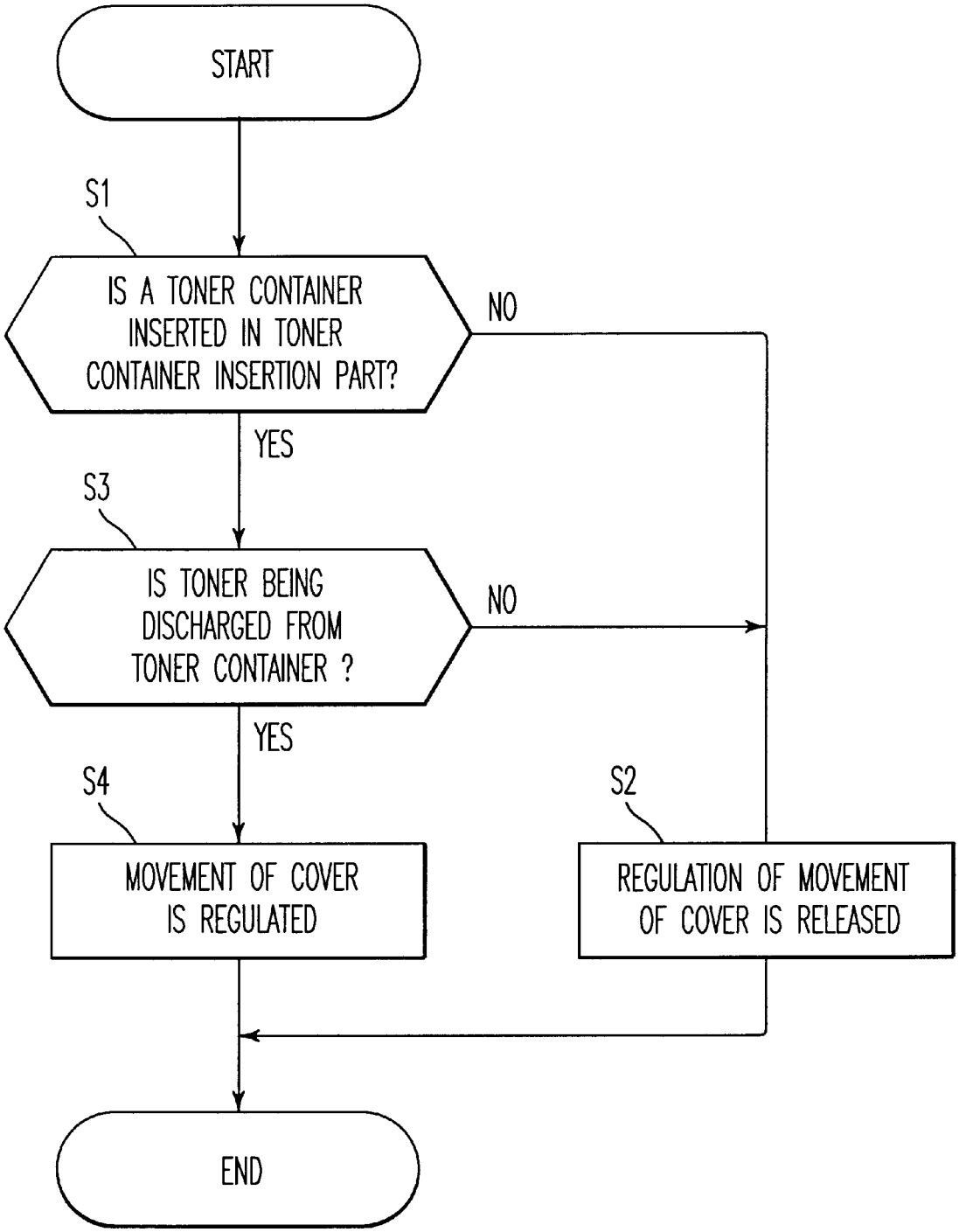
FIG. 5 is a flowchart illustrating an example of an operation of controlling a regulating device that regulates and releases movement of a cover covering a toner container insertion part of the toner supplying devices of FIGS. 1 and 2.

FIG. 5 is a flowchart illustrating an example of an operation of controlling the regulating device 7 with the control device 12. Step S1 determines if a toner container 1 is inserted and set in each of the toner container insertion parts 2 in the toner bank 20 and in each of the toner container insertion parts 2-1, 2-2 and 2-3 in the toner bank 30. When the answer to the step S1 is No, in the toner bank 20, the engagement of the crank-like shaped member 7*b*1 and the engaging member 7*b*3 for the cover 6 for the toner container insertion part 2 is released (Step S2), such that the cover 6 can be opened. In the toner bank 30, the engagement of the crank-like shaped member 7*b*1 and the engaging member 7*b*3 for the cover 6*a*, 6*b* or 6*c* for the toner container insertion part 2-1, 2-2 or 2-3, in which a toner container 1 is not inserted, is released such that the corresponding cover 6*a*, 6*b* or 6*c* can be opened.

When the answer to the step S1 is Yes, step S3 determines if toner (T) is being discharged from each of the toner containers 1 through each opening 1*a* to the toner exhaust path 4. In the toner bank 20, when toner is not being discharged from one of the toner containers 1, the engagement of the crank-like shaped member 7*b*1 and the engaging member 7*b*3 for the cover 6 for the toner container insertion part 2 is released, such that the cover 6 can be opened. In the toner bank 30, when toner is not being discharged from any one of the toner containers 1, the engagement of the crank-like shaped member 7*b*1 and the engaging member 7*b*3 for the cover 6*a*, 6*b* or 6*c* for the corresponding toner container insertion part 2-1, 2-2 or 2-3 is released, such that the corresponding cover 6*a*, 6*b* or 6*c* can be opened.

When toner is being discharged from one of the toner containers 1 in the toner bank 20, the crank-like shaped member 7*b*1 and the engaging member 7*b*3 for the cover 6 for the toner container insertion part 2 is controlled to be engaged with each other in step S4 such that the cover 6 cannot be opened. In the toner bank 30, when toner is being discharged from any one of the toner containers 1, the crank-like shaped member 7*b*1 and the engaging member 7*b*3 for the cover 6*a*, 6*b* or 6*c* for the corresponding toner container insertion part 2-1, 2-2 or 2-3 is controlled to be engaged with each other such that the corresponding cover 6*a*, 6*b* or 6*c* cannot be opened.

Figure 6:
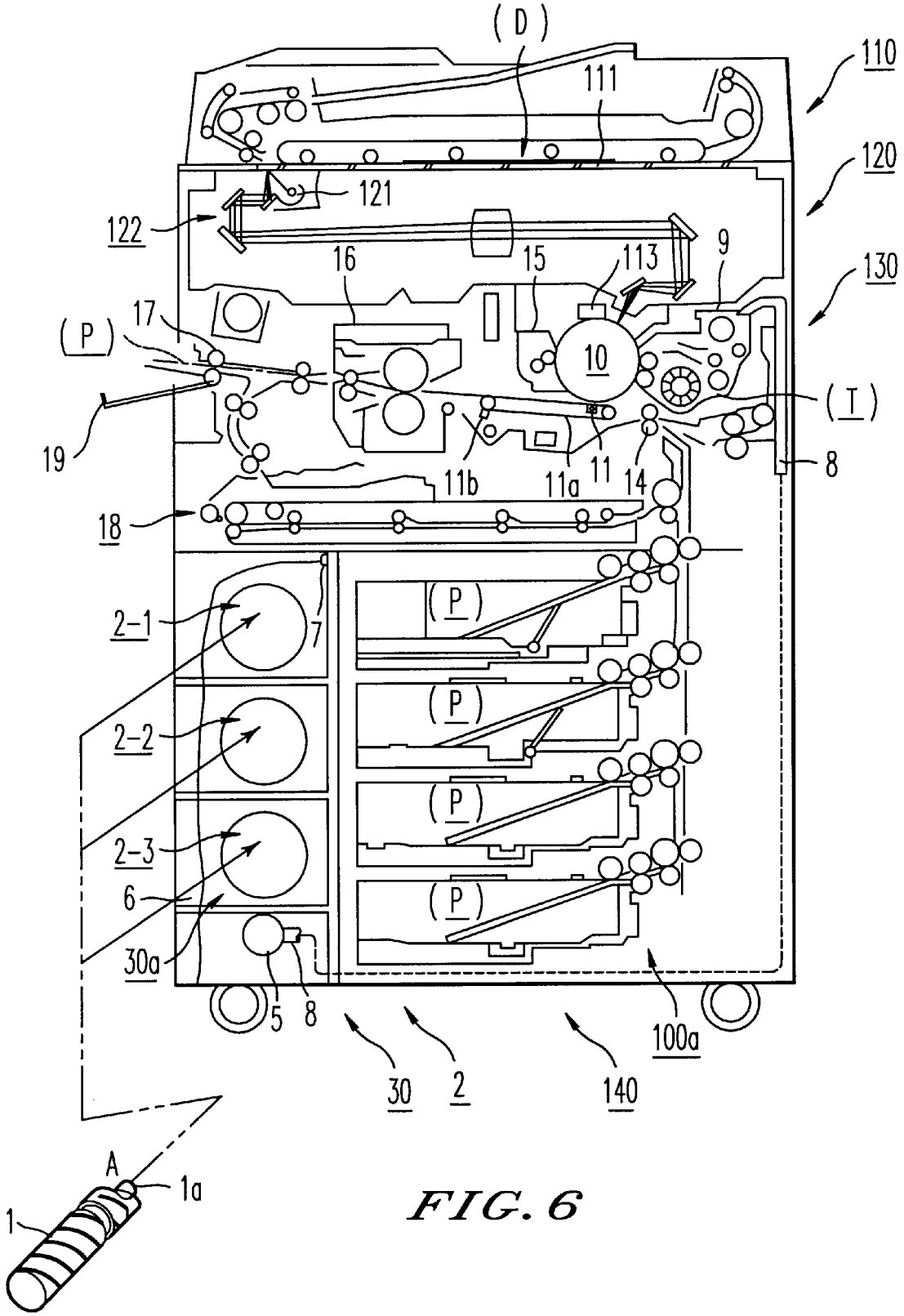
FIG. 6 is a detailed schematic drawing illustrating the construction of the image forming apparatus of FIGS. 1 and 2.

FIG. 6 is a schematic drawing illustrating in more detail the construction of the image forming apparatus 100 of FIG. 2. The image forming apparatus 100 is a copying machine and includes an automatic document feeder (ADF) 110, an exposing section 120 for forming an image in a conventional known electrophotographic system, an image forming section 130, and a paper feeding section 140. The exposing section 120 has an exposure optical system including a light source 121 for putting light on a document (D) placed on a contact glass 111 by the ADF 110 or with a manual insertion, a series of mirrors 122 and a lens 123 for using a reflected light image from the document to expose a surface of a photosensitive drum 10, which is a latent image carrier of the image forming section 130.

The image forming section 130 has the photosensitive drum 10 as the image carrier, and a charging device 13, a developing device 9, a resist roller 14, a transfer device 11 and a photosensitive body cleaning device 15, which are arranged around the photosensitive drum 10. Also included is a fixing device 16, a paper output roller 17, a transfer paper reversing/delivering section 18 for duplex copying, and a paper output tray 19. In the paper feed section 140, a plurality of paper feed cassettes are set containing transfer paper (P) in various sizes. Although the above exposing section 120 is an example of an analog-type exposure optical system, it can serve as a laser printer if it is configured in a system in which an image is optically recorded on the photosensitive drum 10 based on an image signal by using a laser scan optical system in which a laser light source and a deflector are used as an exposing section. The exposing section can also serve as a digital copying machine or a facsimile if a document reader is arranged between the ADF 110 and the exposing section 120.

In FIG. 6, when an image forming operation is started, the photosensitive drum 10 is charged by the charging device 13 and then exposed for a document image from the exposing section 120 so that a static latent image is formed on it. The static latent image is developed by developer (e.g., two-component developer or one-component developer) in the developing device 9, and a toner image is formed on the photosensitive drum 10. A toner image formed on the photosensitive drum 10 is transferred to a transfer paper (P) fed to a transfer section (i.e., a nip portion between the photosensitive drum 10 and the transfer belt 11*a* of the transfer device 11) through the resist roller 14 from the paper feed section 140. The transfer paper (P) to which the toner image is transferred is delivered to the fixing device 16 by the transfer belt 11*a* of the transfer device 11, and the toner image is fixed to the transfer paper (P) by the fixing device 16. The fixed transfer paper (P) is output to the paper output tray 19 via the paper output roller 17. The photosensitive drum 10, after transferring the toner image, is cleaned by the photosensitive body cleaning device 15 to salvage or remove remaining toner and contaminants, such as paper lint. The transfer belt 11*a*, after transfer paper delivery, is also cleaned by a cleaning device 11*b* in the transfer device 11 to salvage or remove remaining toner and paper lint.

In FIG. 6, as the developing device 9, there is shown an example in which a magnetic brush developing method using a two-component developer including toner (T) and a carrier is applied.

Apart from the developing position of the developing device 9, the toner bank 30 as a toner supplying device is provided. In this embodiment, the toner bank 30, including a plurality of toner container insertion parts 2-1, 2-2 and 2-3, is positioned at a lower left part of the image forming apparatus 100. The toner bank 30 may alternatively be positioned at a lower right part of the image forming apparatus 100 or in other appropriate places.

The toner bank 30 is connected to the developing device 9 via a flexible toner conveying pipe as the toner/air mixture conveying path 8 through which toner is conveyed while being mixed with air. Toner stored in each of the toner containers set in the toner bank 30 is supplied to the developing device 9 through the toner/air mixture conveying path 8 by a powder pump unit as a toner delivery device 5. As shown in FIG. 6, in this embodiment, the powder pump unit as the toner delivery device 5 is arranged in a lower portion of the toner bank 30.

The toner container 1 is inserted into each of the toner insertion parts 2-1, 2-2 and 2-3 in a direction indicated by an arrow A from the side of the front surface 30*a* with an opening 1*a* as the leading edge so as to be attached to the toner bank 30. A regulating device 7 regulates and releases an opening and closing movement of a cover 6 covering the surface of the toner bank 30.

For the toner/air mixture conveying pipe as the toner/air mixture conveying path 8, it is advantageous to use a material which is flexible and has excellent resistance to toner, such as, for example, nylon, Teflon, etc. In the image forming apparatus 100 in this embodiment, the connection between the developing device 9 and the toner bank 30 is flexible, whereby a restriction on each arrangement is dissolved, and therefore it is possible to utilize the layout effectively. Further, because each of the toner containers 1 is inserted into the toner container insertion parts 2-1, 2-2 and 2-3 from the front side of the apparatus 100, with the opening 1*a* as the leading edge, the operation of attaching and detaching the toner container 1 to and from the toner bank 30 is facilitated and scattering of toner is minimized.

Figure 7:
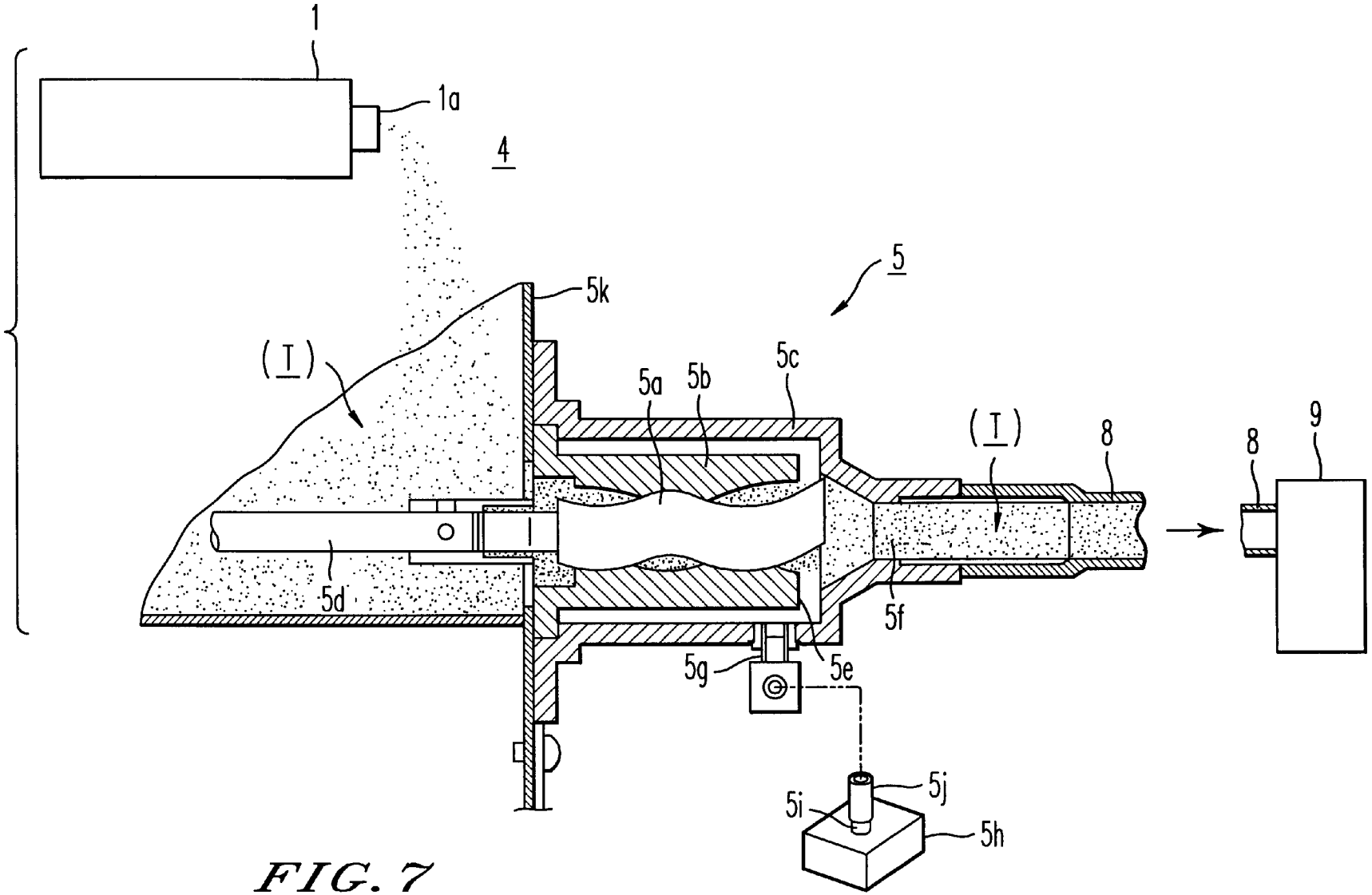
FIG. 7 is a sectional view illustrating a configuration of a powder pump unit as a toner delivery device for transferring toner from a toner bank to the developing device in the image forming apparatuses of FIGS. 1 and 2.

FIG. 7 is a sectional view showing a configuration of the powder pump unit as the toner delivery device 5 for transferring toner from the toner bank 30 to the developing device 9. Toner exited from the toner container 1 to the toner exhaust path 4 is deposited in a hopper 5*k* and the deposited toner is then conveyed by the powder pump unit 5 to the developing device 9. For the powder pump unit 5, a screw pump which is conventionally known and commonly called a Moineau-pump is used. As shown in FIG. 7, the power pump unit 5 includes a rotor 5*a*, a stator 5*b*, and a holder 5*c*.

The rotor 5*a* is engaged with a driving source, such as a driving motor (not shown) via a driving shaft 5*d* (or in some cases a horizontal delivery screw with a screw attached to the driving shaft on its outer periphery), and the rotor 5*a* is rotatively driven by a rotation of the driving source. The stator 5*b* is made of an elastic body, such as a rubber material, and surrounds the rotor 5*a*. The holder 5*c* holds the stator 5*b*.

The toner delivery device 5 takes in toner at the bottom part of the toner bank 30 from the side of the driving shaft 5*d* to deliver the toner toward a toner passageway (i.e., discharging section) 5*f* with a rotation of the rotor 5*a*. In addition, there is about a 1-mm gap 5*e* between a side of the stator 5*b* and an inner side of the holder 5*c* for communication with the toner passageway 5*f*. An air supply port 5*g* is provided so that an air blows from the gap 5*e* to the toner passageway 5*f*. The air supply port 5*g* communicates with the toner passageway 5*f*, and further communicates with an air exhaust outlet 5*i* of an air pump as an air supplying device 5*h* via an air supply tube 5*j*. When the air pump 5*h* starts to run, air blows on the toner (T) in the toner passageway 5*f* via the air supply tube 5*j* and the air supply port 5*i* by approximately 0.5 to 1 liter/minute of a blow amount, whereby fluidization is accelerated for toner that is discharged from the toner passageway 5*f* of the powder pump unit 5. Thus, the toner is discharged to the toner conveying pipe 8 while being mixed with air. Therefore, toner delivery with the powder pump 5 becomes more reliable.

Figure 8:
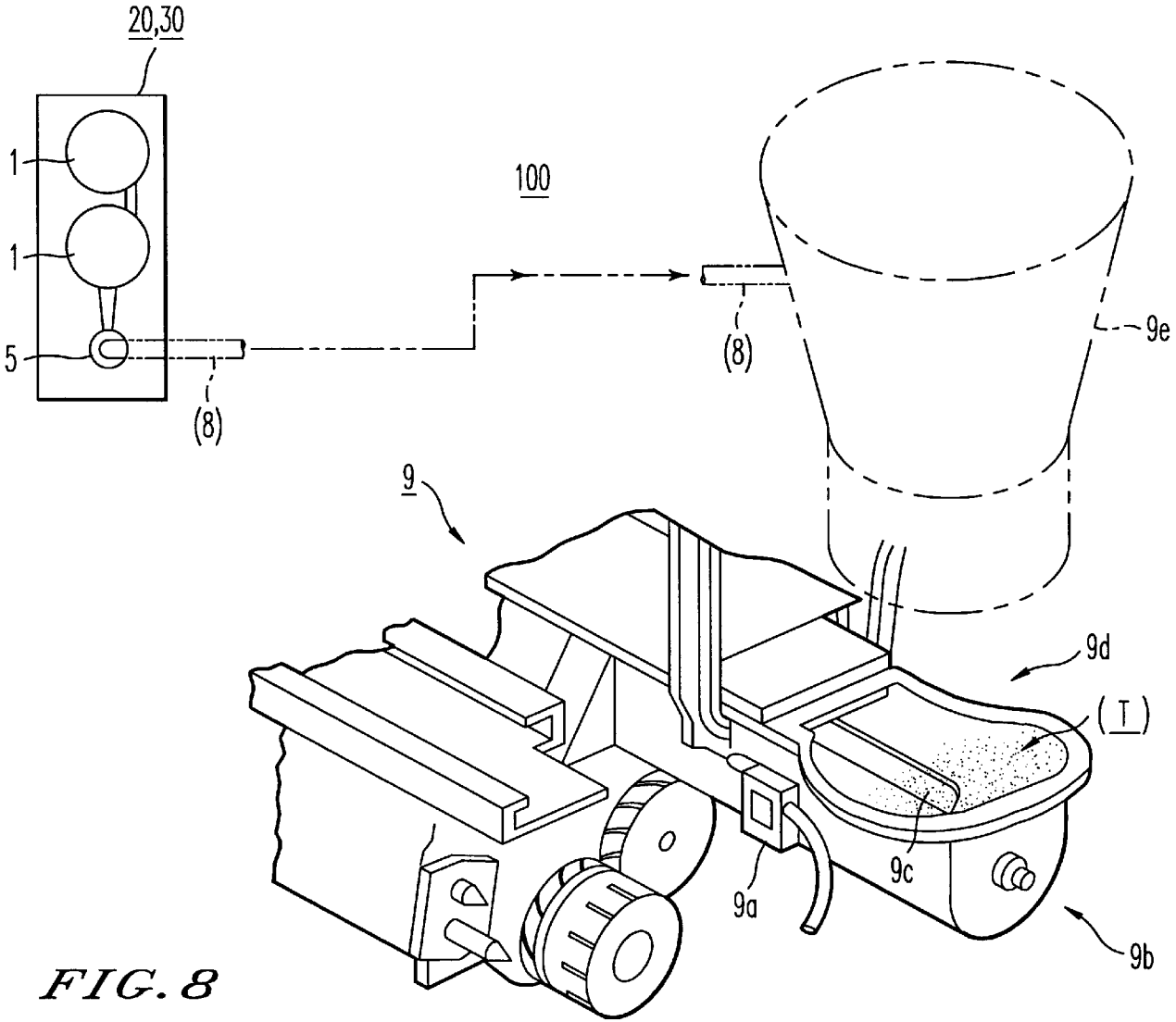
FIG. 8 is a schematic drawing illustrating the main portion of the developing device of the image forming apparatus of FIG. 6 for explaining control of toner supply from the toner bank to the developing device.

FIG. 8 is a schematic drawing illustrating the main portion of the developing device 9 for explaining control of toner supply from the toner bank 30 to the developing device 9. The toner supply from the toner bank 30 to the developing device 9 in this embodiment is performed by a sensor as a toner detect device 9*a* arranged in the developing device 9 and a controller (not shown).

If the sensor 9*a* does not detect the toner, that is, when the height of the accumulated toner in the toner supplying section 9*b* of the developing device 9 is lower than a predetermined level, the above powder pump unit 5 is driven to supply toner from the toner bank 30 to the toner supplying section 9*b* of the developing device 9. When the height of the accumulated toner in the toner supplying section 9*b* reaches the predetermined level, the toner is detected by the sensor 9*a* and the supplying of toner to the toner supplying section 9*b* from the toner bank 30 is stopped. With these controls, the toner supplying section 9*b* always contains a certain amount of toner, so that a stable developing process is assured. Additionally, if the sensor 9*a* dose not detect the toner a predetermined number of times (i.e., at periodic or predetermined intervals) or for a predetermined period of time, it is determined that toner contained in the operating toner container 1 is almost exhausted. Then, toner contained in another toner container 1 starts to be discharged to be conveyed to the toner supplying section 9*b* of the developing device 9. In the toner supplying section 9*b* of the developing device 9, as shown in FIG. 8, a toner supplement opening 9*d* is formed in the side of an axial end of a stirring member 9*c* arranged in the toner supplying section 9*b*, and in this toner supplement opening 9*d*, a toner salvaging device 9*e* described next is removably attached.

Figure 9:
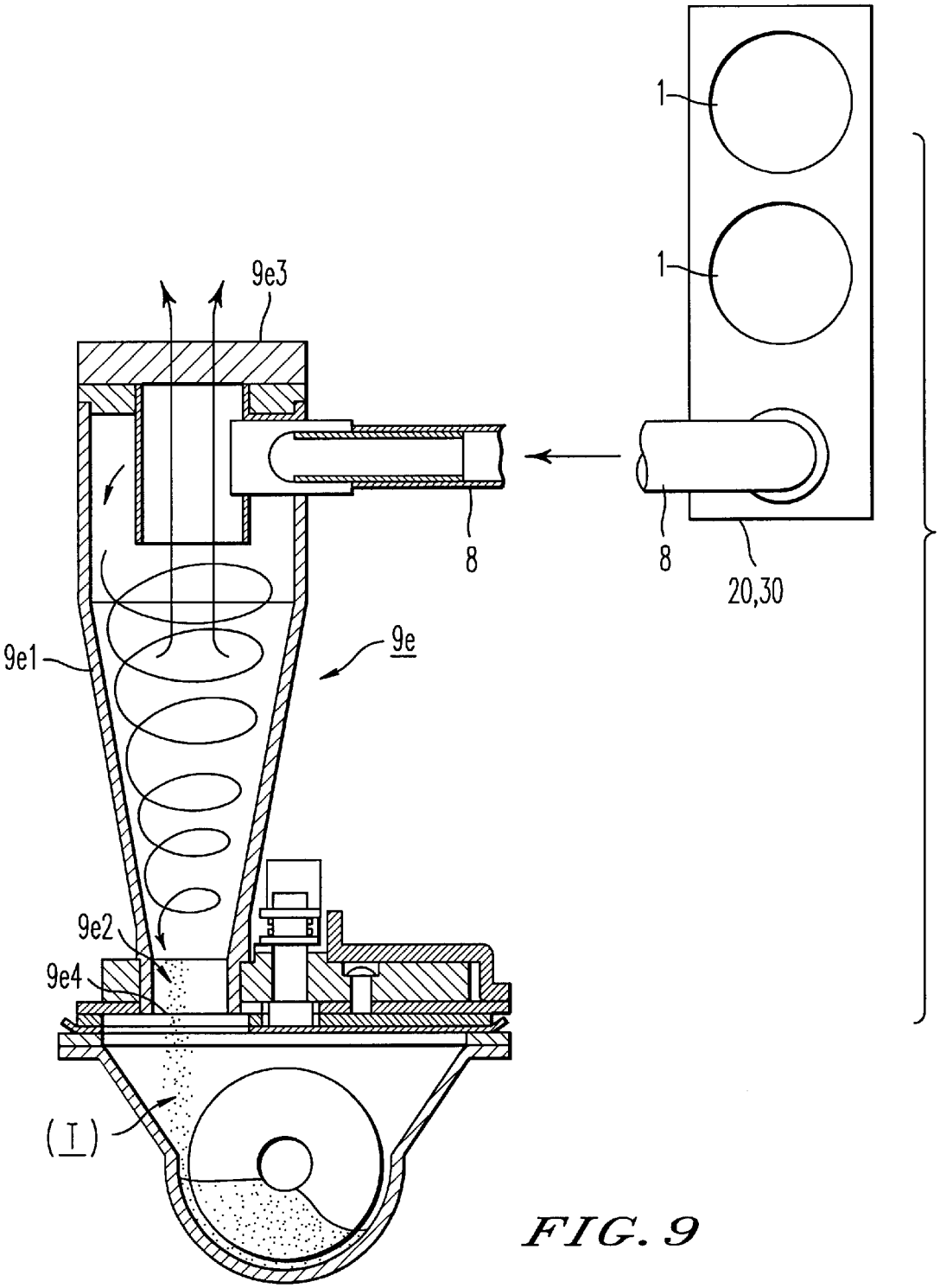
FIG. 9 is a schematic drawing illustrating a toner salvaging device attached to a toner supplying section of the developing device of the image forming apparatus of FIG. 6.

FIG. 9 is a schematic drawing illustrating an example of the toner salvaging device 9*e* attached to the toner supplying section 9*b* of the developing device 9. The toner salvaging device 9*e* has a unit structure that is configured separately from the developing device 9. The toner salvaging device 9*e* is used to salvage toner that has been delivered while being mixed with air through the toner/air mixture conveying path 8 from the toner bank 30 by separating the toner (T) from the air, so as to supply the toner in preparation for decreased supplement toner in the toner supplying section 9*b* of the developing device 9.

In FIG. 9, the toner salvaging device 9*e* has a funnel-shaped toner separating section 9*e*1 whose longer direction is vertical. The toner separating section 9*e*1 includes a hopper that separates air from toner transmitted from the toner bank 30, and drops only the toner by gravity, so as to put the toner into the toner supplying section 9*b* of the developing device 9. Therefore, in the upper part of the toner separating section 9*e*1, an end of the toner/air mixture conveying path 8, through which the toner is delivered from the toner bank 30, is connected, while an opening 9*e*2, which can be connected to the toner supplying section 9*b* of the developing device 9, is formed in the lower part. With this configuration, a mixture of air and toner transmitted from the toner/air mixture conveying path 8 falls spiraling, when striking an inner wall of the toner separating section 9e1, due to the shape of the toner separating section 9e1 and the discharging position of the toner/air mixture conveying path 8. The air having a lower specific gravity rises, while the toner having a higher specific gravity drops, and thus the air is separated from the toner. On the top surface of the toner separating section 9e1, there is included a filter 9e3 for discharging only air, and on the bottom surface, there is provided an opening/closing member 9e4 for opening or closing the opening 9e2.

Figure 10:
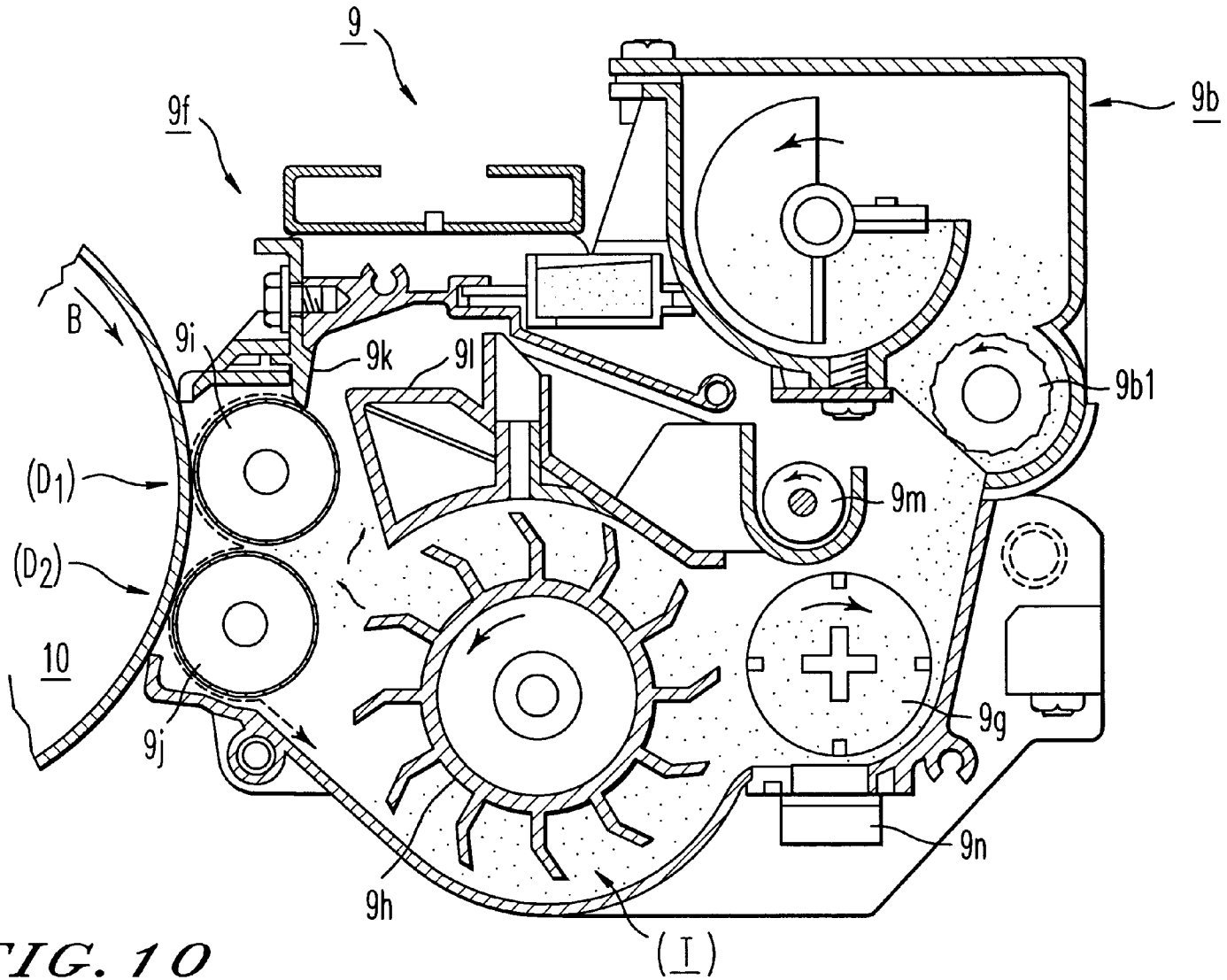
FIG. 10 is a sectional view illustrating an example of a configuration of the developing device.

Next, the developing device 9 will be described below. FIG. 10 is a sectional view illustrating an example of a configuration of the developing device 9. In FIG. 10, the developing device 9 has a developing container 9f and the toner supplying section 9b. The developing container 9f is arranged near the photosensitive drum 10, which is a latent image carrier movable in a direction indicated by an arrow B in the drawing. The toner supplying section 9b is mounted on the developing container 9f In the developing container 9f, a stirring roller 9g and a paddle wheel 9h are arranged for development, so as to scoop up a two-component developer having magnetic or non-magnetic toner and magnetic carrier subjected to frictional electrification in opposite polarities by being stirred and mixed by the stirring roller 9g and the paddle wheel 9h. In addition, the toner supplying section 9b stirs the toner (T) with a rotation of a toner supplying roller 9b1 and transmits it toward the stirring roller 9g if a density of the toner supplied to the photosensitive drum 10 is lowered.

In a position where the developer is scooped up by the paddle wheel 9h, there are arranged a plurality of (e.g., two shown in the drawing) developing rollers 9i and 9j near the photosensitive drum 10. The two developing rollers 9i and 9j are arranged in the upstream side and the downstream side along a moving direction of the photosensitive drum 10. The roller in the upstream side is considered to be a first developing roller 9i and the roller in the downstream side is to be a second developing roller 9j. The first and second developing rollers 9i and 9j include a developing sleeve that is rotatable in a counterclockwise direction in the drawing by a driving section (not shown) and a magnetic roller fixed in the developing sleeve as the main portion. This developing sleeve is made of a non-magnetic body, such as aluminum or stainless steel. The magnetic roller includes a plastic magnet molded by mixing a ferrite magnet or a rubber magnet, and further nylon powder and ferrite powder, having a configuration in which a plurality of magnetic poles are arranged along a circumferential direction.

In the developing container 9f, the developer is scooped up by a centrifugal force generated at a rotation of the paddle wheel 9h and then expelled toward the first developing roller 9i. A part of the expelled developer is supplied directly to the first developing roller 9i and carried on a surface of the first developing roller 9i. Another part of the remaining developer to be expelled rebounds from the second developing roller 9j and then is carried on the surface of the first developing roller 9i by way of a magnetic force in the side of the first developing roller 9i. To supply the developer to the first developing roller 9i also from the side of the second developing roller 9j, it is desired to increase a relative rotation speed of the paddle wheel 9h in order to increase the amount of developer rebounding from the second developing roller 9j so as to increase the centrifugal force in advance.

The developer carried on the surface of the first developing roller 9i moves on the roller surface with a rotation of the developing sleeve, and after the layer thickness is restricted by a doctor blade 9k, it reaches a first developing area D1 in which the first developing roller 9i is opposite to the photosensitive drum 10, so that a latent image on the photosensitive drum 10 is made visible with toner. Then the developer, which has passed the first developing area D1 moves to a position where the magnetic force in the side of the first developing roller 9i has a lower effect. Thus, the developer is transmitted toward a second developing area D2 between the second developing roller 9j and the photosensitive drum 10, as indicated by a dashed line in the drawing, with a rotation in the side of the second developing roller 9j and a magnetic force from the magnetic roller. Then, the developer drops to the bottom of the developing container 9f in a position where the second developing roller 9j has no effect, and the developer is stirred again by the paddle wheel 9h.

On the other hand, developer scraped off by the first developing roller 9i, due to restriction of the layer thickness with the doctor blade 9k, is guided by a separator 9l toward a delivery screw 9m located at the other end of an extension of the separator 9l. The developer is then dropped on the stirring roller 9g by the delivery screw 9m. Therefore, at the other end of the extension of the separator 9l, there is a slit for dropping the developer formed in a position opposite to the stirring roller 9g.

The magnetic rollers arranged in the first and second developing rollers 9i and 9j have an arrangement of magnetic poles, which can be used to form a repulsion magnetic field generated by the identical poles between the nearest portions of the first developing roller 9i and the second developing roller 9j, so that the transfer direction of the developer is forcibly set to a direction in which the developer starts for the second developing roller 9j. With this arrangement, the developer is transferred to the second developing roller 9j by the magnetic pole in the side of the second developing roller 9j.

Near the stirring roller 9g in the developing container 9f, there is arranged a toner density sensor as a toner density detecting device 9n for detecting a mixing ratio of toner and carrier. The toner density sensor 9n employs, for example, a method in which a toner density is detected based on a content of the toner in the developer by using changes of inductance on a coil arranged in the developer.

Figure 11A:
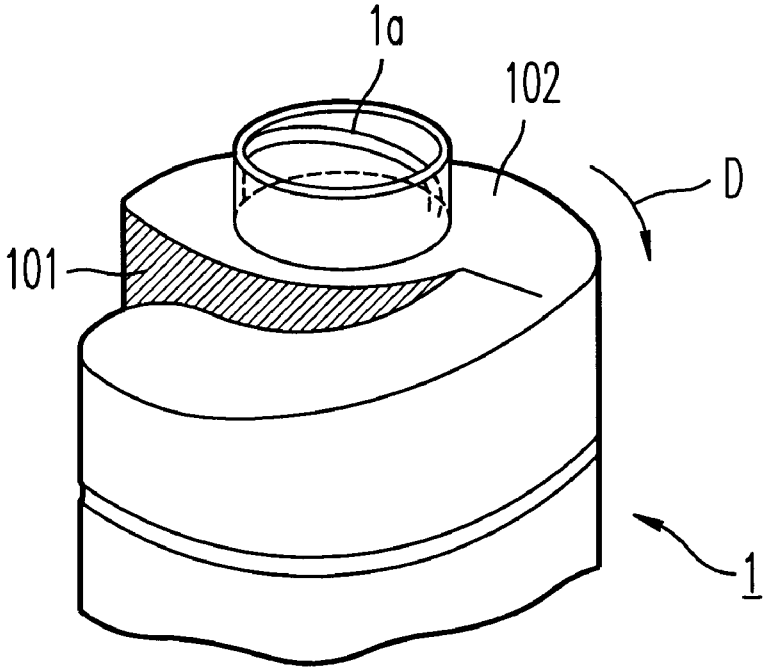
FIGS. 11(*a*) and 11(*b*) are schematic drawings illustrating a part of a toner container near an opening provided at an end part of the container.
Figure 11B:
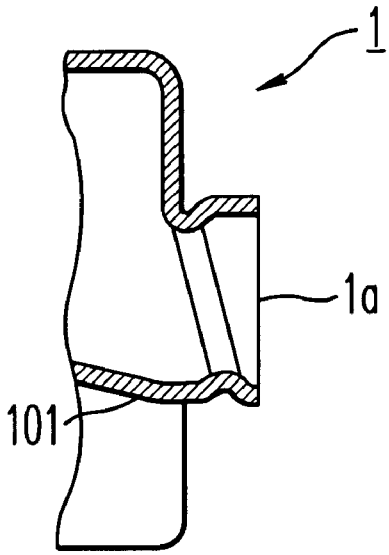

FIGS. 11(*a*) and 11(*b*) are schematic drawings illustrating a part of the toner container near the opening 1*a*. As illustrated in the drawings, a shoulder part 101 is formed at an end part 102 holding the opening 1*a*. In addition, a spiral groove or protrusion is formed inside the container 1 toward the opening 1*a*. Because of this configuration, the rotation of the container 1 in a direction I causes toner contained in the container 1 to be conveyed by the spiral groove or protrusion toward the opening 1*a* through the shoulder part 101 and discharged from the container 1.

Figure 12:
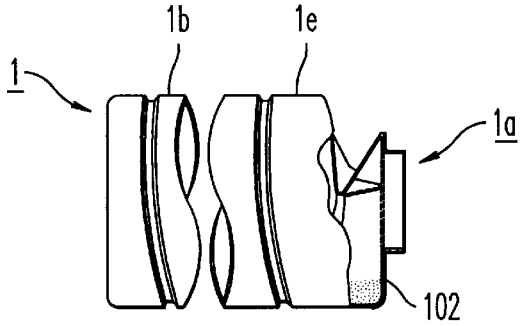
FIG. 12 is a series of schematic drawings for explaining how toner is discharged from the toner container.
Figure 12:
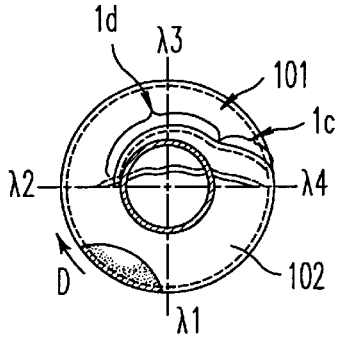
Figure 12:
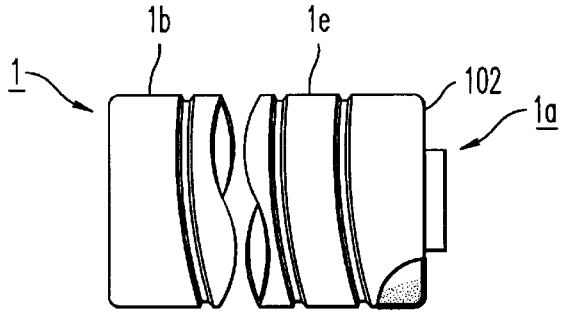
Figure 12:
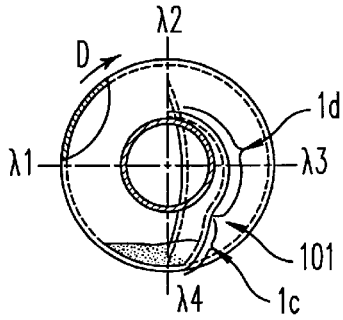
Figure 12:
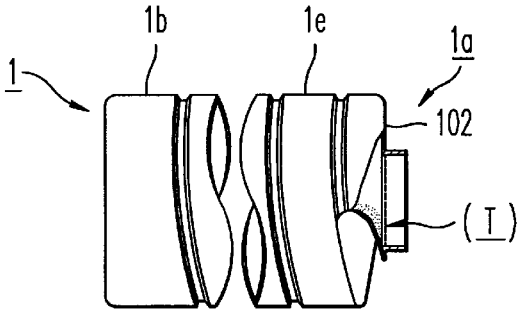
Figure 12:
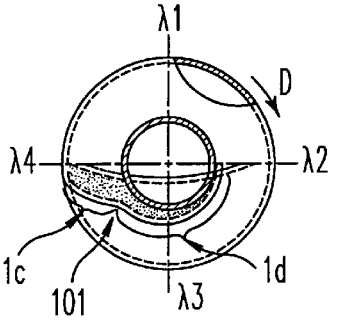
Figure 12:
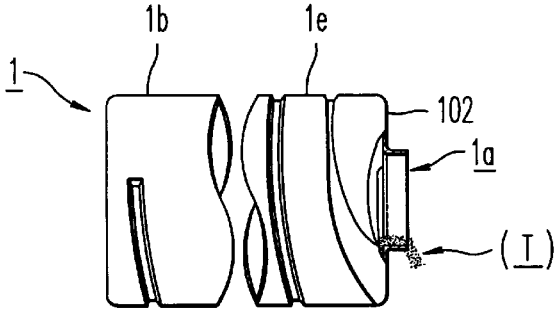
Figure 12:
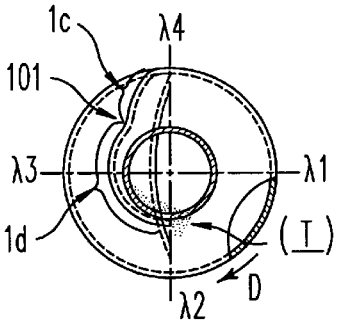

FIG. 12 illustrates how toner is discharged from the toner container 1. Sub-diagrams (a1), (b1), (c1) and (d1) are elevation views of the toner container 1 and sub-diagrams (a2), (b2), (c2) and (d2) are corresponding right-side views of the toner container 1. The sub-diagrams (b1)(b2) show views rotated from the sub-diagram (a1)(a2) by 90 degrees, the sub-diagrams (c1)(c2) show views rotated from the sub-diagrams (b1)(b2) by 90 degrees, and the sub-diagrams (d1)(d2) show views rotated from the sub-diagrams (c1)(c2) by 90 degrees, respectively. $\lambda_1$–$\lambda_4$ are used to illustrate 90° rotations of the toner container 1.

As shown, the toner container 1 is formed with the opening 1*a* for discharging toner at an end of a cylindrical container body 1*b* so as to have a smaller diameter than a diameter of the cylindrical body 1*b*. Further, with a part of the inner surface of the shoulder part 101 of the end part 102 on which the opening 1*a* of the toner container 1 is formed being pushed out from the inner surface of the shoulder part 101 up to an edge of the opening 1*a*, a projected portion 1*c* for raising toner is formed.

Specifically, the sub-diagrams (a2), (b2), (c2) and (d2) show how toner is guided by the projected portion 1*c* of the toner container 1 and an opening projected portion 1*d*. An arrow B in each sub-diagram indicates a direction in which the toner container 1 rotates. In the sub-diagrams (a1) and (a2), each part of the maximum diameter in the shoulder part 101 is located vertically downward and toner is guided to the lower part of the circumferential wall in the maximum-diameter part of a head portion of the toner container 1 by a guiding groove 1*e*. In the state shown in the sub-diagrams (b1) and (b2), after a rotation by 90 degrees from the above state in a direction indicated by the arrow D, a borderline area between the maximum-diameter part of the shoulder part 101 and the projected portion 1*c* are located vertically downward and a part of the toner guided by the above guiding groove 1*e* is put on the projected portion 1*c*. During a further rotation by 90 degrees from this state to the state shown in the sub-diagrams (c1) and (c2) in a direction indicated by the arrow D, the projected portion 1*c* raises the toner up to an edge of the opening 1*a* as if it were a spoon. Before or after the state shown in the sub-diagrams (d1) and (d2) after a further rotation by 90 degrees in a direction indicated by the arrow D, the above toner on the projected portion 1*c* is partially transferred to the opening projected portion 1*d* and then discharged from the opening 1*a* due to an incline of the opening projected portion 1*d*. In this point, the projected portion 1*c* itself is recessed like a scooping part of a spoon as apparently shown in the sub-diagram (c2) in this example. By using a toner container having this shape near the opening 1*a*, it is possible to prevent a discharge and a drop of a lump of toner, and also to prevent scattering of toner powder dust in the toner deposit portion at the bottom of the toner bank 30. Thus, the toner is gradually discharged from the toner container 1 through the opening 1*a*. In addition, it is possible to use almost the entire amount of toner contained in the toner container 1, without leaving some of the toner. Furthermore, extra toner is removed by the rotation of the toner container 1 and only a spoonful of toner is scooped up to the opening 1*a*, and therefore toner is discharged stably from the opening 1*a*.

Next, an exemplary mechanism for opening and closing the opening 1*a* at an end of the toner container 1 with a cap is described with reference to FIG. 13.

Figure 13:
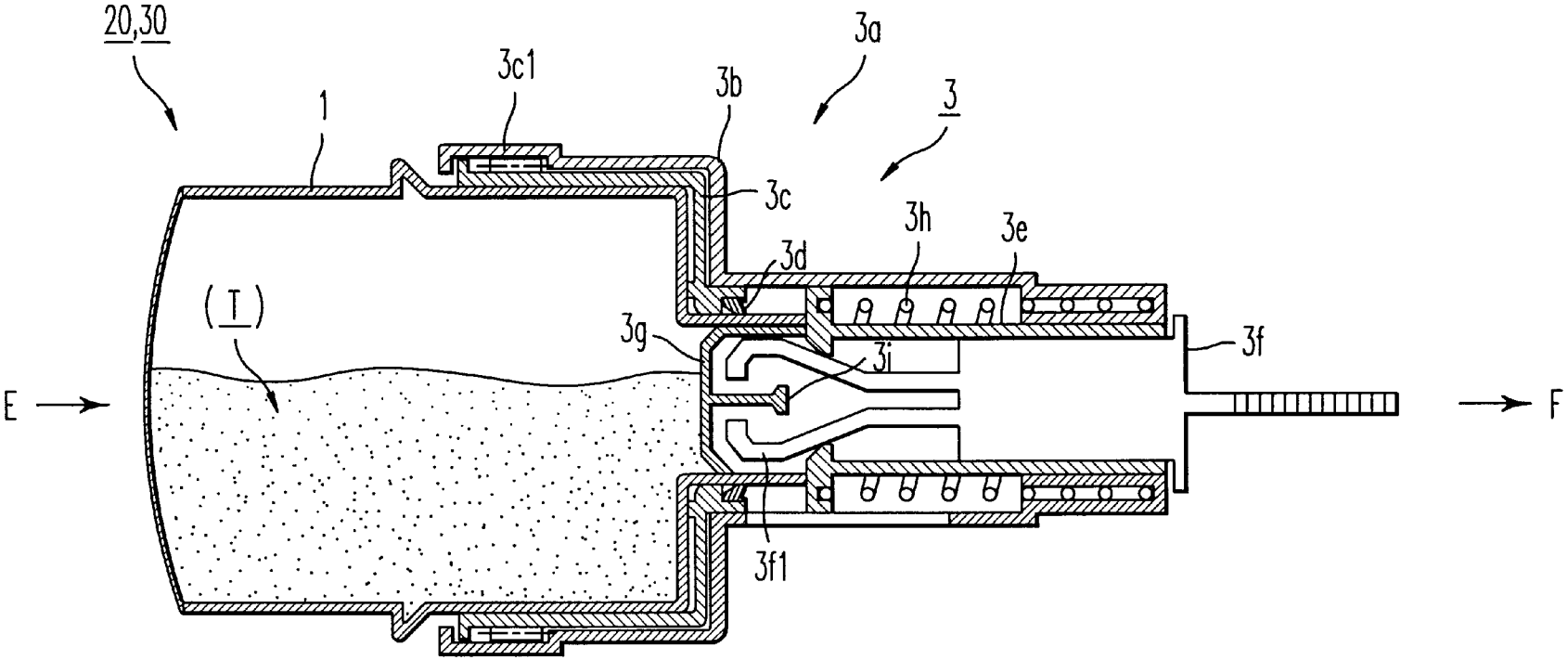
FIG. 13 is a schematic drawing illustrating an exemplary mechanism used in the toner supplying device of FIGS. 1 and 2 for opening or closing the opening at an end of the toner container with a cap.

FIG. 13 illustrates the toner container 1 being set in a holder portion 3*a* of the toner container holder 3 of the toner bank 30 and the opening 1*a* being closed with a cap 3*g*. In the holder portion 3*a*, there is provided a rotatably-supported inner holder 3*c* in a holder 3*b*. The inner holder 3*c* is rotated by a gear drive (not shown) via a driving gear 3*c*1. The toner container 1 has recess and projecting portions (not shown) so that it can rotate synchronously with this inner holder 3*c*. In the inner holder 3*c*, a seal 3*d* is arranged so as to prevent toner from being scattered from a gap between the toner container 1 and a supporting section of the inner holder 3*c*. In the holder 3*b*, a slider 3*e* and a chuck 3*f* are supported so as to respectively slide freely.

The slider 3*e* is pressed by a spring 3*h* in a direction that urges the cap 3*g* toward the toner container 1. When the chuck 3*f* is shifted in a direction indicated by an arrow F from this state, as shown in FIG. 13, a grab portion 3*i* of the cap 3*g* is held by a click 3*f*1 of the chuck 3*f* and then the cap 3*g* is drawn out of the toner container 1, whereby the opening 1*a* is opened.

Figure 14:
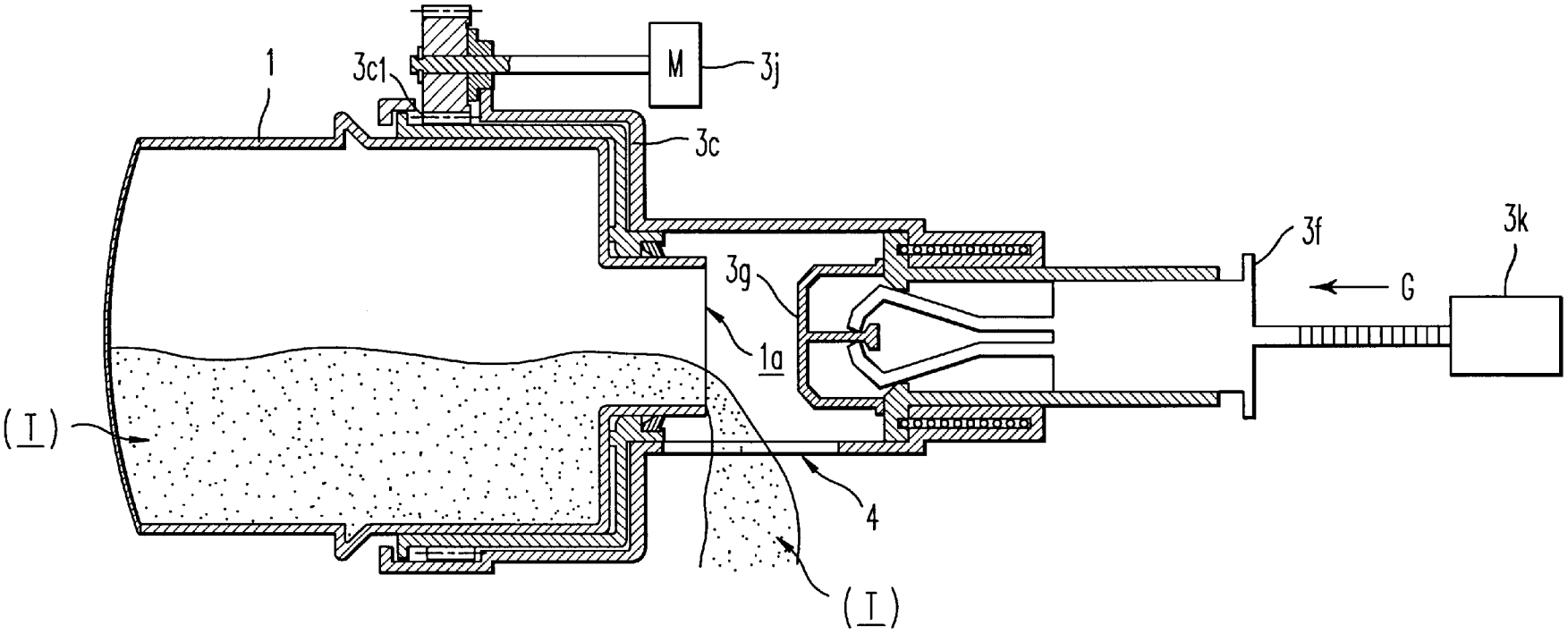
FIG. 14 is a schematic drawing illustrating a state of the opening/closing mechanism when the cap is taken off to open the opening of the toner container.

FIG. 14 is a schematic drawing illustrating a state of the opening/closing mechanism when the cap 3*g* of the toner container is taken off to open the opening 1*a*. In FIG. 14, when the driving gear 3*c*1 is rotated by a gear of the rotation driving device 3*j* in this state, the inner holder 3*c* rotates and the toner container 1 rotates synchronously with this rotation, whereby toner (T) in the toner container 1 is discharged from the opening 1*a*. If the toner (T) remaining in the toner container 1 becomes less than a predetermined amount, as determined by the toner detect device 9*a* after a predetermined period of time sufficiently long for using up the remaining toner of the toner container 1, the opening 1*a* of the toner container 1 is closed by the cap 3*g* by shifting the chuck 3*f* with a moving device 3*k* in a direction indicated by the arrow G in FIG. 14.

Figure 15:
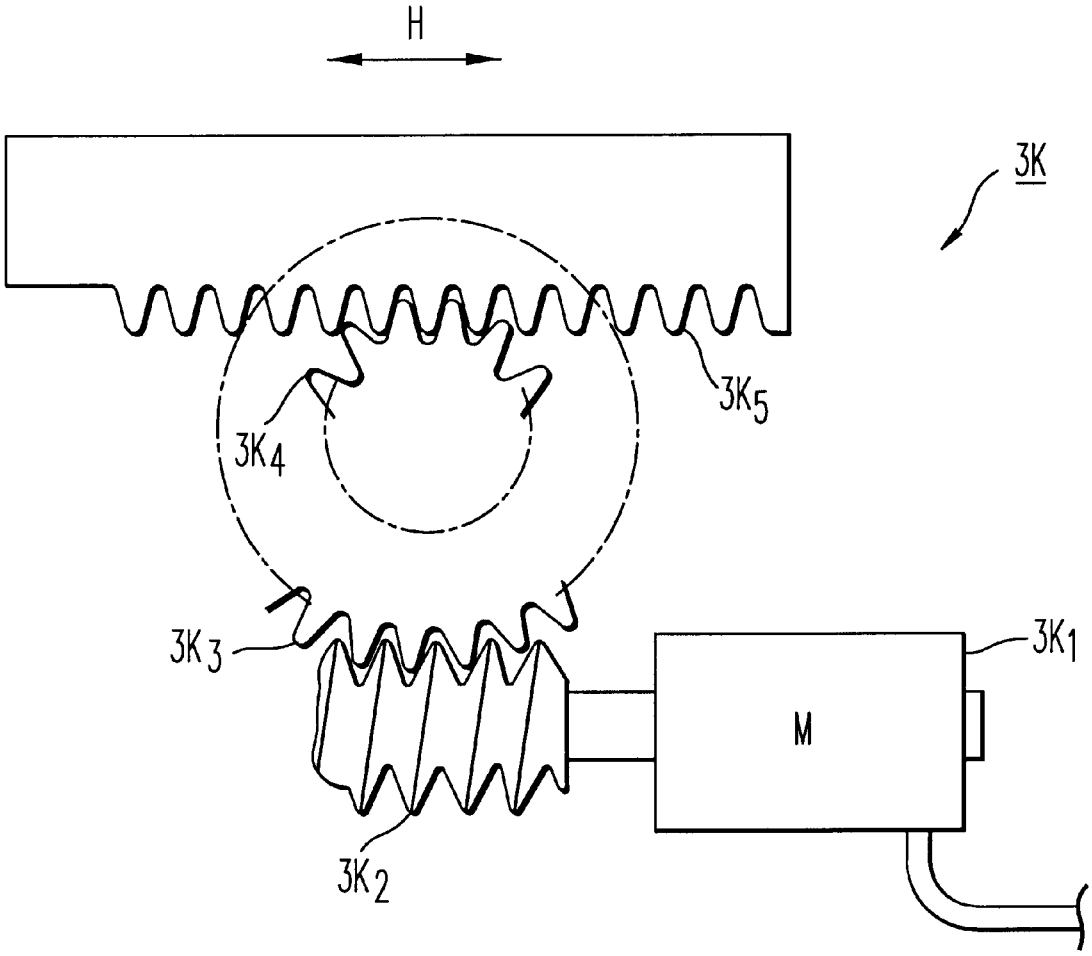
FIG. 15 is a schematic drawing illustrating an exemplary construction of a moving device that moves a chuck of the opening/closing mechanism to open and close the opening of the toner container with the cap.

FIG. 15 is a schematic drawing illustrating an exemplary construction of the moving device 3*k*. As shown in FIG. 15, the moving device 3*k* includes a driving motor 3*k*1, a worm gear 3*k*2, a helical gear 3*k*3, a pinion 3*k*4, and a rack 3*k*5. The chuck 3*f* is moved in a horizontal direction as indicated by an arrow H in the drawing with a rotation of the driving motor 3*k*1 in a clockwise direction or a counterclockwise direction, whereby the cap 3*g* can be put on or taken off the opening 1*a* of the toner container 1. When the cap 3*g* is put on the opening 1*a* of the toner container 1, a stopper (illustrated in FIG. 16) is used to prevent the toner container 1 from being moved.

Figure 16:
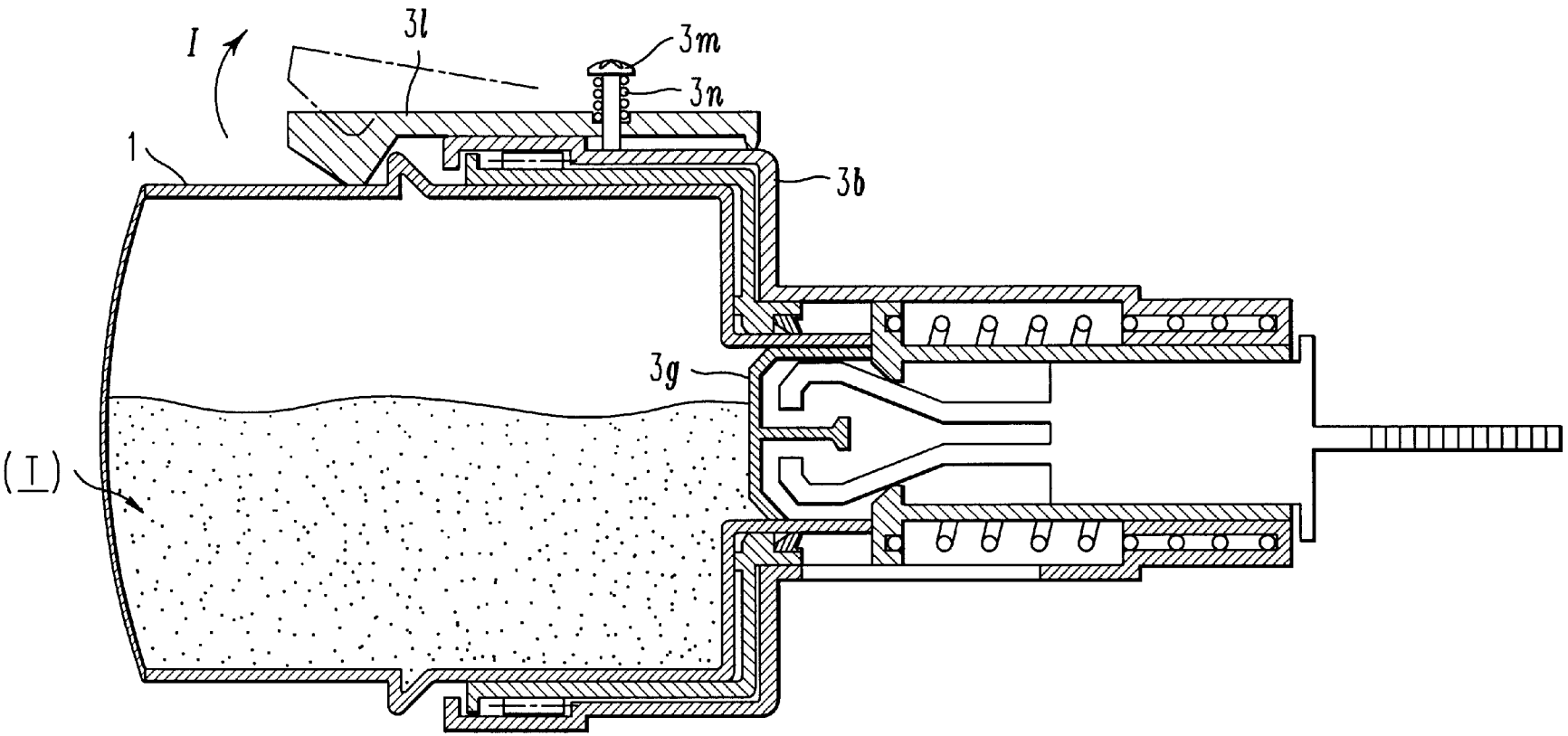
FIG. 16 is a schematic drawing illustrating a stopper that is used to prevent the toner container from being moved from the toner supplying device.

In FIG. 16, a stopper 31 is supported by a stepped screw 3*m* and a spring 3*n* so as to be fixed to the holder 3*b*, with its click portion being engaged with a projection arranged on an outer peripheral surface of the toner container 1. The stopper 31 is pressed by the spring 3*n* so as not to be raised up to the position indicated by a two-dotted and dashed line in FIG. 16 by a force of closing the cap 3*g*. Accordingly, the cap 3*g* can be put on the opening 1*a* of the toner container 1 securely. In addition, when exchanging the toner container 1, the toner container 1 can be easily removed from the stopper 3*l*, so that it can be easily exchanged. This may be accomplished by pulling out the toner container 1 more strongly or by withdrawing the stopper 3*l* manually or with an added lever or the like to the position indicated by the two-dotted and dashed line in FIG. 16.

Figure 17:
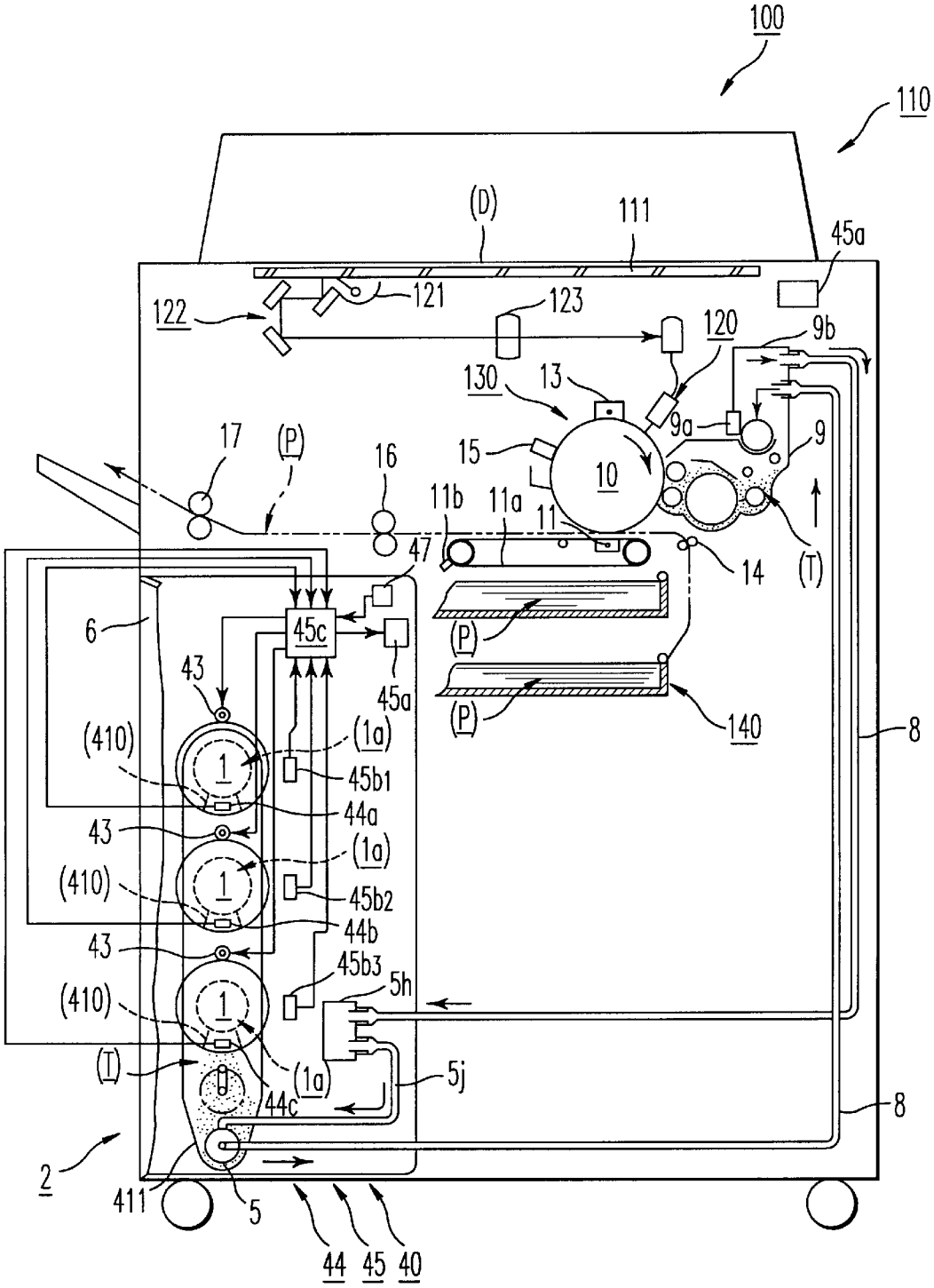
FIG. 17 is a schematic drawing illustrating an example of an image forming apparatus incorporating a toner supplying device according to another embodiment of the present invention.

FIG. 17 is a schematic drawing illustrating an example of an image forming apparatus incorporating a toner supplying device according to another embodiment of the present invention. An image forming apparatus 100 includes a toner supplying device 40, an automatic document feeder (ADF) 110, an exposure unit 120, an image forming unit 130, a paper feeding unit 140 and so on for forming an image using a known electrophotography.

In this embodiment, the toner supplying device 40 is arranged, apart from the developing position where a developing device 9 and an image carrier 10 face each other, at a lower left part of the apparatus 100 in the drawing. A toner container insertion part 2 is configured so as to accommodate a plurality of toner containers 1. The toner container insertion part 2 is provided with a plurality of insertion inlets, such that a toner container 1 is inserted into each of the inlets, from a front side of the toner supplying device 40 to be set in the toner container insertion part 2. A cover 6 is held at one side of the toner supplying device 40 so as to open and close the front surface of the toner supplying device 40, in which the insertion inlets are provided. A toner discharging device 43 causes the toner container 1 set in the toner container insertion part 2 to discharge toner through an opening 1*a* of the toner container 1 to a toner conveying path 410 communicating with the opening 1*a* of each toner container 1. A first detect device 44 to detect toner being discharged through the opening 1*a* of the toner container 1 is arranged for each toner container 1 in the toner conveying path 410 communicating with the opening 1*a* of each toner container 1. More specifically, an upper first detect sensor 44*a* is arranged for the toner container 1 set at the top of the toner insertion part 2, a middle first detect sensor 44*b* for the toner container 1 at the middle, and a bottom first detect sensor 44*c* for the toner container 1 at the bottom of the toner container insertion part 2. Further, a second detect device 45 is arranged for each toner container 1 so as to detect, in cooperation with the first detect device 44, existence of an empty toner container 1 inserted in the toner container insertion part 2. The second detect device 45 includes an upper second detect sensor 45*b*1, a middle second detect sensor 45*b*2 and a lower second detect sensor 45*b*3, respectively arranged for the corresponding toner container 1 inserted in the toner container insertion part 2.

The toner supplying device 40 is connected to the developing device 9 via a toner/air mixture conveying path 8, which is typically made of a flexible pipe. A toner delivery device 5 is arranged at a bottom part of the toner supplying device 40 to deliver toner (T), which is exhausted to the toner conveying path 410 from each toner container 1 and conveyed to a merged conveying path 41*l*, to a toner supplying part 9*b* of the developing device 9 via the toner/air mixture conveying path 8. The toner delivery device 5 includes a powder pump which is generally called a Moineau pump.

As a latent image on the image carrier 10 is developed with toner to be formed as a toner image by the developing device 9, the toner in the developing device 9 is consumed and the amount of toner in the developing device 9 decreases. As the amount of toner in the developing device 9 decreases, toner in the toner supplying part 9*b* is supplied to the developing device 9. If the amount of toner in the toner supplying part 9*b* decreases below a predetermined level, a toner detect sensor 9*a* arranged in the toner supplying part 9*b* detects the decrease of toner in the toner supplying part 9*b*. A controller (not shown) then controls the toner discharging device 43 to rotate the operating toner container 1 to discharge toner while driving the toner delivery device 5, such that toner is conveyed to the toner supplying part 9*b* via the toner/air mixture conveying path 8.

While the operating toner container 1, (e.g., the toner container 1 at the top of the toner container insertion part 2), is discharging toner, the upper first detect sensor 44*a* detects existence of the toner being exhausted from the operating toner container 1. If the upper first detect sensor 44*a* detects non-existence of the toner being discharged from the operating toner container 1, the controller (not shown) determines that the operating toner container 1 has run out of the toner and activates, for example, the toner container 1 at the middle of the toner insertion part 2 to discharge toner therefrom. In addition, at substantially the same time, a display device 45*a* arranged at a part of the toner supplying device 40 of the image forming apparatus 100, displays a message indicating that the toner container 1 at the top has run out of toner or produces a sound so as to remind an operator to replace the used toner container 1 at the top.

Thus, even if one of the plurality of toner containers 1 has run out of toner, toner is supplied from another toner container 1, and thereby the toner is not intermittently supplied to the developing device 9. Further, by replacing the used toner container 1 in accordance with the message or the reminding sound, stoppage of the image forming operation is prevented.

However, when replacing the used toner container 1, the operator may erroneously attach an empty toner container 1. Therefore, a controller 45*c* for the second detect device 45 is configured so as to control the second detect device 45 to repeat the detect operation when a new toner container 1 is set to the toner container insertion part 2. Specifically, when the new toner container 1 is set in the toner container insertion part 2, the newly set toner container 1 is rotated so as to exhaust the toner therefrom. If the first detect device 44 detects non-existence of toner again (i. e, the newly set toner container 1 is empty), then the display device 45*a* again displays the message or produces the sound reminding the operator to replace the empty toner container 1. If the first detect device 44 detects existence of toner, the message in the display device 45*a* or the sound produced by the display device 45*a* is not activated.

Further, if power to a power supply device 47 that supplies power to the second detect device 45 is turned off while the display device 45*a* is displaying the message or producing the reminding sound, the controller 45*c* performs substantially the same operation as described above to detect existence of an empty toner container 1 when the power to the power supplying device 47 is turned on. Therefore, even when power to the power supply device 47 is turned off while the display device 45*a* is displaying the message or producing the reminding sound and a first operator is replacing the toner container 1, because the message or the sound is turned off after the power to the power supply device 47 is turned on, if the set toner container 1 is not empty, it is prevented that the newly set toner container 1 is erroneously replaced by another operator. Further, even if power to the power supply device 47 is turned off while the display device 45*a* is displaying the message or producing the reminding sound and such a message or sound is put off, the message is displayed or the sound is produced again by the display device 45*a*, when the power to the power supply device 47 is turned on, if the set toner container 1 is empty. Therefore, the operator is reminded about replacing the empty toner container 1.

Figure 18:
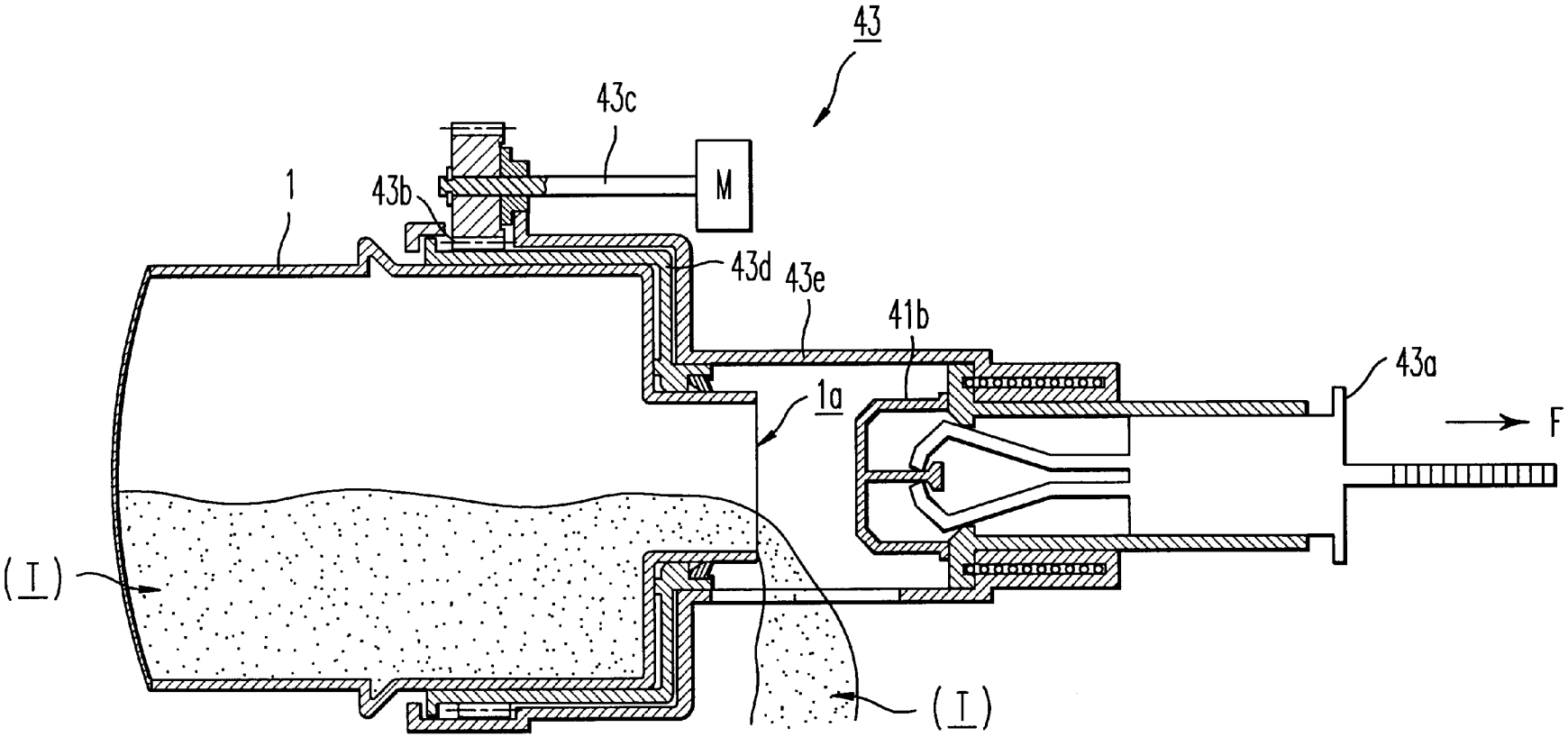
FIG. 18 is a schematic drawing illustrating an exemplary construction of a toner discharging device used in the toner supplying device of FIG. 17.

FIG. 18 is a schematic drawing illustrating an exemplary construction of the toner discharging device 43. A cap 41*b* is taken off the opening 1*a* of a toner container 1 by a chuck 43*a*, which is moved in a direction F in the drawing by a moving device (not shown). An inner holder 43*d* is rotated, while being held by a holder 43*e*, by rotation of a gear 43*b* provided on an outer circumferential surface of the toner container 1, and a gear of a rotation drive device 43*c*. The gear 43*b* and the gear of the rotation drive device 43*c* are engaged with each other, and thereby the toner container 1 is rotated in synchronous with the inner holder 43*d*. The toner contained in the toner container 1 is discharged through the opening 1*a* as the toner container 1 is rotated. When the toner in the toner container 1 is exhausted, the chuck 43*a* is moved back in the opposite direction so as to close the opening 1*a* with the cap 41*b*.

Figure 19:
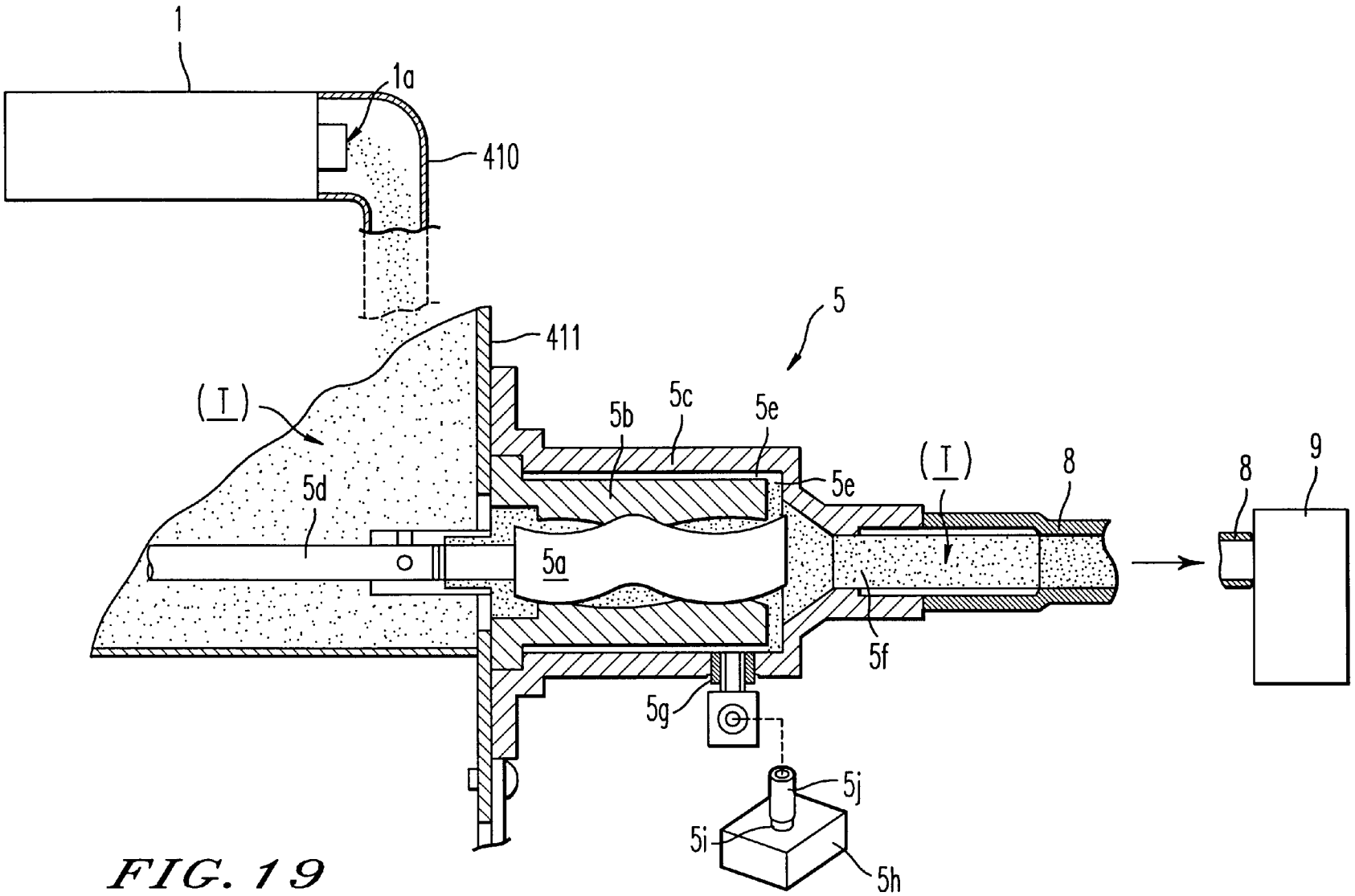
FIG. 19 is a schematic drawing illustrating an exemplary construction of a toner delivery device used in the toner supplying device of FIG. 17.

FIG. 19 is a schematic drawing illustrating an exemplary construction of the toner delivery device 5. The toner delivery device 5 includes a powder pump generally called a Moineau pump described earlier. The toner delivery device 5 mixes the toner, which is exhausted from the toner container 1 to the toner conveying path 410 and deposited in the merged toner conveyed path 41*l*, with air so as to deliver the mixture of toner and air to the developing device 9 through the toner/air mixture conveying path 8.

Figure 20:
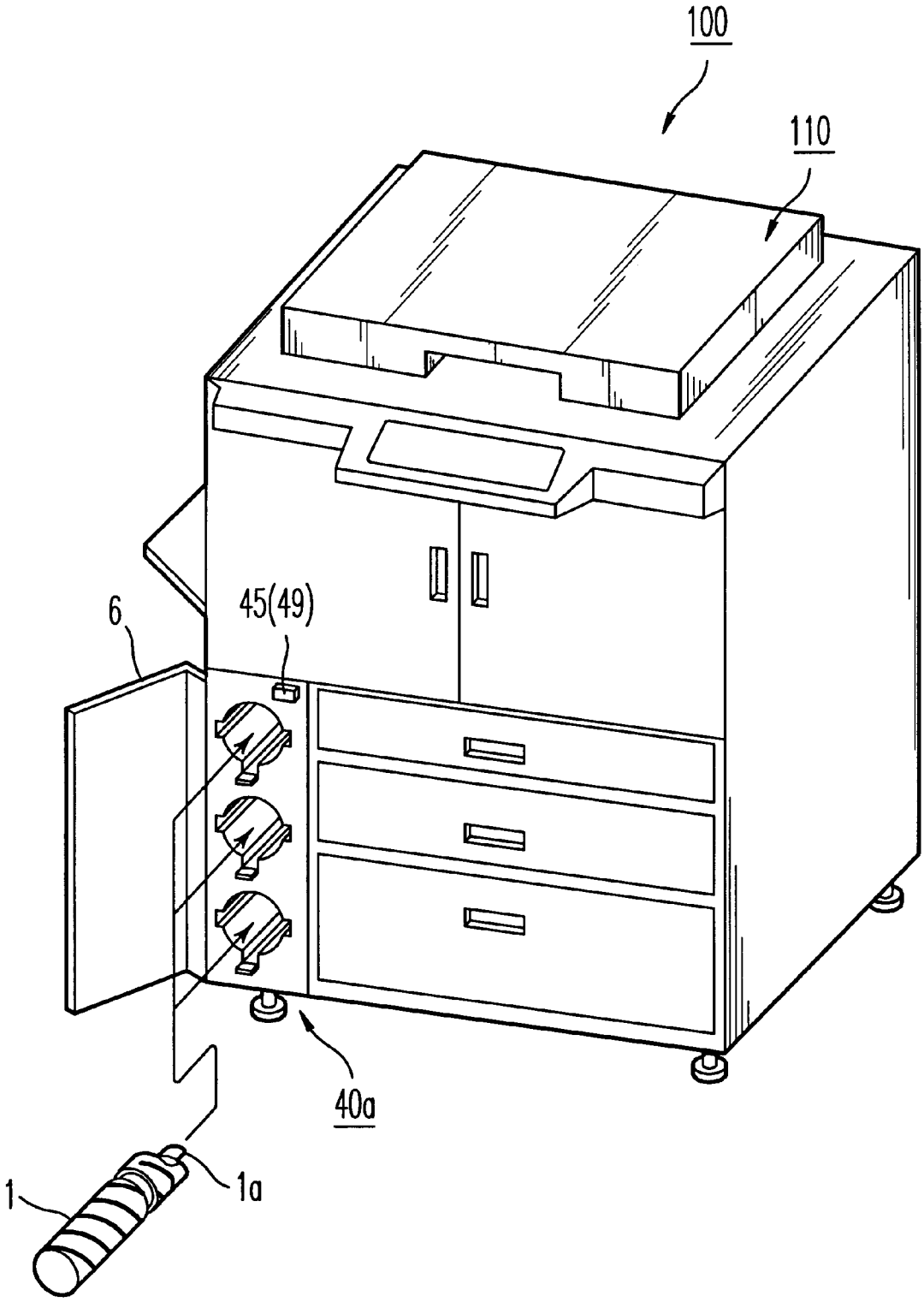
FIG. 20 is a schematic drawing illustrating an outer appearance of an image forming apparatus incorporating another embodiment of a toner supplying device according to the present invention.

FIG. 20 is a schematic drawing illustrating an outer appearance of an image forming apparatus incorporating another embodiment of a toner supplying device according to the present invention. In this embodiment, a cover open/close sensor 49 is provided at a part of the front surface of the toner supplying device 40 to detect if the cover 6 is opened or closed, and the same cover open/close sensor 49 is configured to perform the function of the second detect device 45. Thus, in this embodiment, the cost of the second detect device 45 is made lower than in the previous embodiment in which three sensors are used as the second detect device 45.

Figure 21:
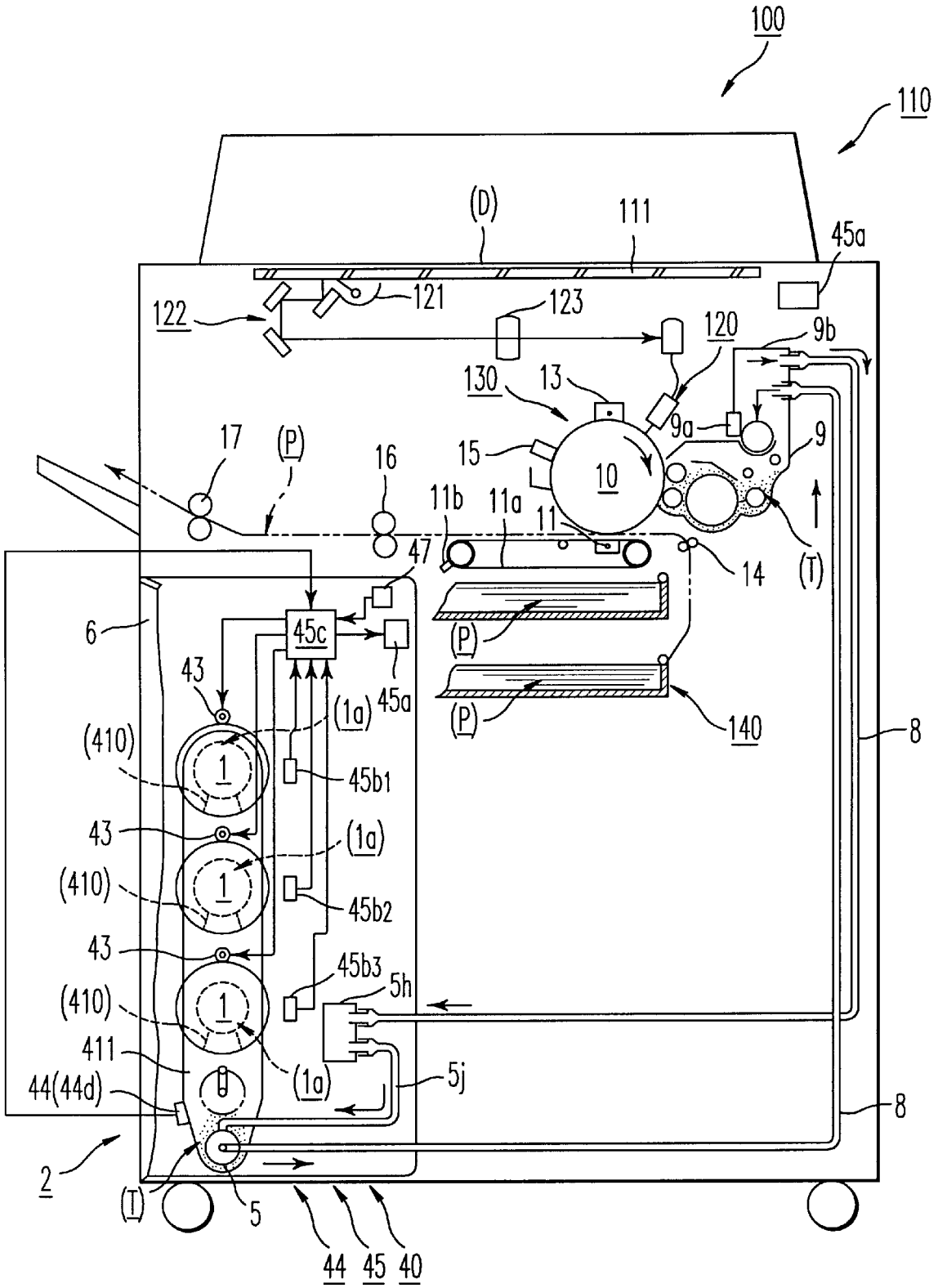
FIG. 21 is a schematic drawing illustrating an image forming apparatus incorporating a toner supplying device according to another embodiment of the present invention.

FIG. 21 is a schematic drawing illustrating an image forming apparatus incorporating a toner supplying device according to another embodiment of the present invention. In this embodiment, a first detect sensor 44*d* of a first detect device 44 is arranged at the merged toner conveying path 41*l* to detect the toner being conveyed to the merged toner conveying path 41*l*. Thus, if the first detect sensor 44*d* detects no toner, it is determined that the operating toner container 1 is empty. Further, the first detect sensor 44*d* may be configured so as to also function to detect if the toner deposited in the merged toner conveying path 411 exceeds a predetermined height, such that after the sensor 44*d* detects no toner and the toner discharging device 43 for another toner container 1 is activated to discharge toner, if the sensor 44*d* detects no toner again, it is determined that the operating toner container 1 is empty. By configuring the first detect device 44 as above, the cost of the first detect device 44 is reduced.

Figure 22:
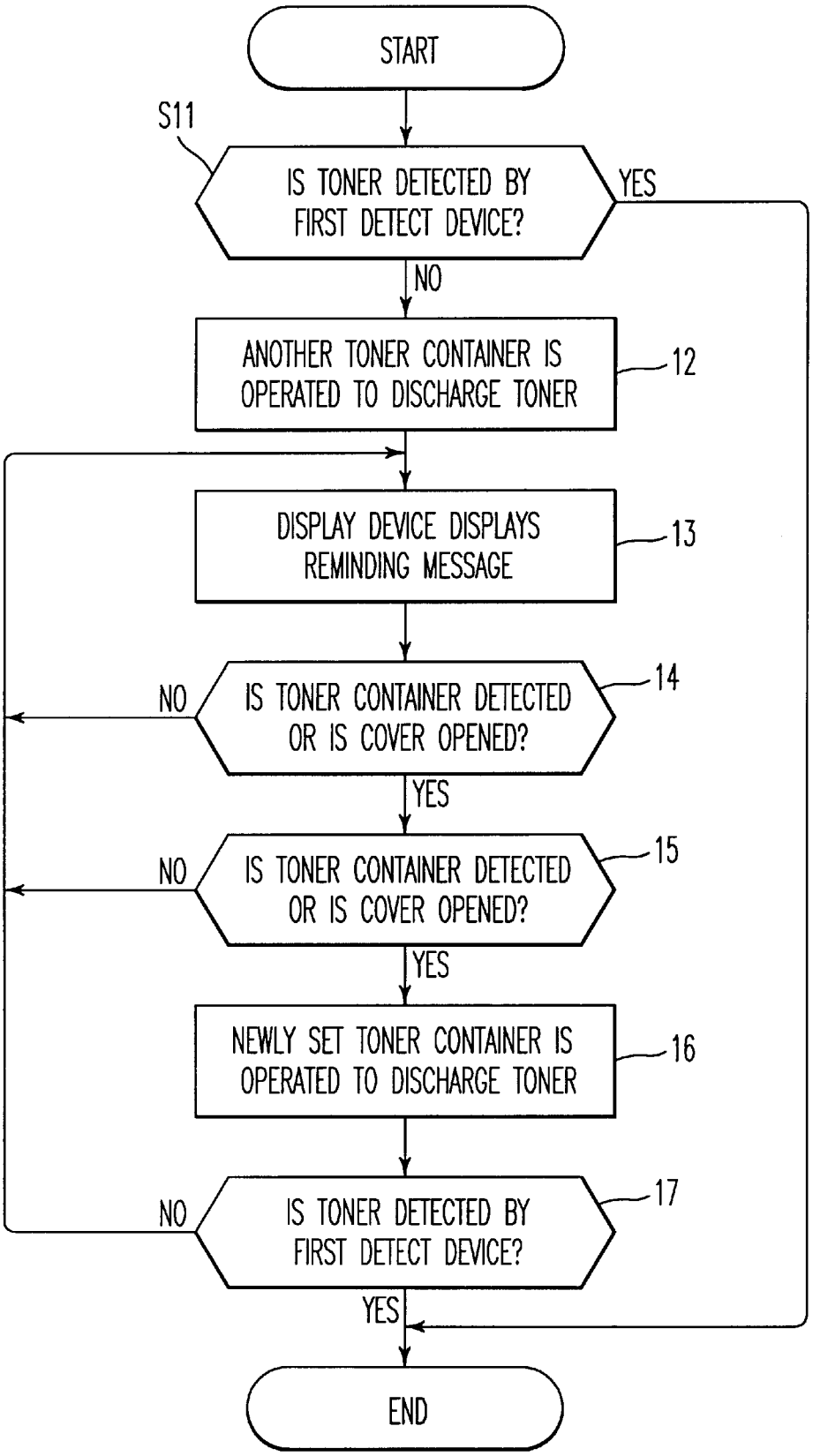
FIG. 22 is a flowchart illustrating an exemplary operation of detecting an existence of an empty toner container in the toner container insertion part of the toner supplying device according to an embodiment of the present invention.

FIG. 22 is a flowchart illustrating an exemplary operation of detecting existence of an empty toner container 1 in the toner container insertion part 2. The operation is performed by the controller 45*c*.

If the first detect device 44 for the operating toner container 1 does not detect toner in step S11, another toner container 1 is operated by the toner discharging device 43 to discharge toner in step S12. Then, the display device 45*a* displays in step S13 the message reminding an operator to replace the toner container 1 for which no toner is detected by the first detect device 44. The second detect sensor 45*b* for the used toner container 1 then detects existence of the container 1 or the cover open/close sensor 49 detects if the cover 6 is opened in step S14. If the second detect sensor 45*b* detects existence of the toner container 1 or the cover open/close sensor 49 detects that the cover 6 is not opened in step S14, then the display device 45*a* continues to display the reminding message in step S13. If the second detect sensor 45*b* detects non-existence of the toner container 1 or the cover open/close sensor 49 detects that the cover 6 is opened in step S14, then in step S15, the second detect sensor 45*b* detects existence of the toner container 1 again or the cover open/close sensor 49 detects again if the cover 6 is opened. If the second detect sensor 45*b* detects non-existence of the toner container 1 again or the cover open/close sensor 49 detects that the cover 6 is opened, then it is determined that the used toner container 1 is not yet replaced and the display device 45*a* continues to display the reminding message in step S13. If the second detect sensor 45*b* detects the existence of the toner container 1 or the cover open/close sensor 49 detects that the cover 6 is closed in step S15, then in step S16, it is determined that the used toner container 1 is replaced. Then, the toner discharging device 43 for the newly set toner container 1 is operated to discharge toner and is stopped after a predetermined period of time long enough for the first detect device 44 to detect the toner being discharged from the newly set toner container 1. If the first detect device 44 then detects no toner in step S17, it is determined that the newly set toner container 1 is empty and the display device 45*a* displays the message reminding the operator to again replace the newly set toner container 1.

Figure 23:
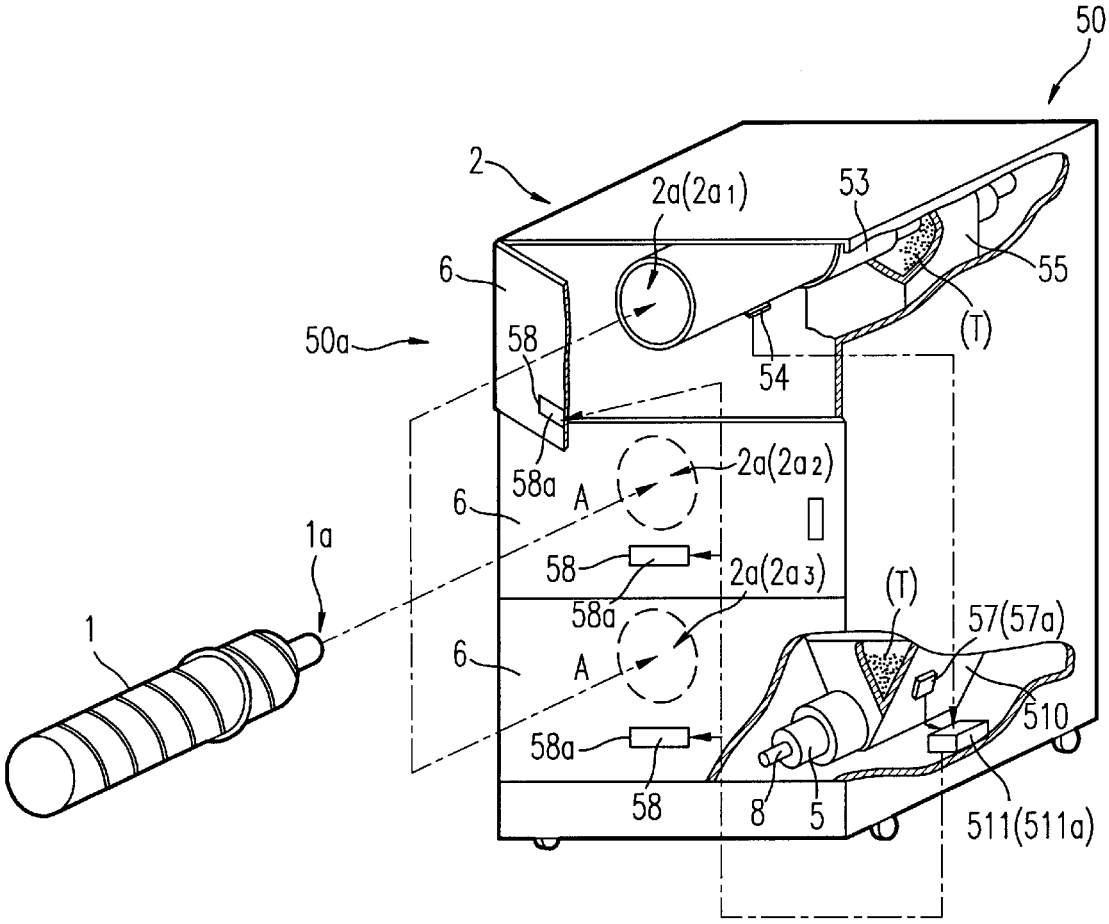
FIG. 23 is a schematic drawing illustrating a toner supplying device according to another embodiment of the present invention.

FIG. 23 is a schematic drawing illustrating a toner supplying device according to another embodiment of the present invention. A toner bank 50 as a toner supplying device is configured such that a plurality of toner containers 1, each containing toner can be inserted into a toner container insertion part 2 from a front side 50*a* of the toner bank 50. A toner container 1 is inserted in a direction indicated by an arrow A in the drawing into respective toner container insertion parts 2 through respective insertion inlets 2*a*1, 2*a*2 and 2*a*3 and is detachably held by respective toner container holders 53.

When the toner container 1 held by the toner container holder 53 is rotated by a rotation drive device (not shown), toner (T) contained in the container 1 is discharged from the toner container 1 through an opening 1*a*. The opening 1*a* is provided at an axial end of the container 1 in the direction in which the container 1 is inserted into the toner container insertion parts 2. The discharged toner is exhausted to a toner exhausting path 55 provided at a rear end side of the toner container insertion parts 2. The toner exhausted to the toner exhausting path 55 from each toner container 1 is conveyed to a toner deposit part 510 at the bottom of the toner exhausting path 55. The toner deposited in the toner deposit part 510 is then mixed with air by a toner delivery device 5 and is conveyed via a toner/air mixture conveying path 8 to a developing device of an image forming apparatus (not shown) in which the toner supplying device 50 is attached.

A toner container detect device 54 is arranged for each of the toner container insertion parts 2 so as to detect existence of the toner container 1 inserted into each of the toner container insertion parts 2 and held by the corresponding toner container holder 53.

A toner detect device 57 is arranged in the toner deposit part 510 to detect existence of toner in the toner deposit part 510. The toner detect device 57 includes, for example, a sensor 57*a* that detects if the deposited toner in the toner deposit part 510 exceeds a predetermined height. A control device 511 determines, based upon the detect result with the toner detect device 57, if the deposited toner in the toner deposit part 510 is running low.

Covers 6 are provided so as to cover and uncover parts of a front surface 50*a* of the toner bank 50, in which the insertion inlets 2*a*1, 2*a*2 and 2*a*3 are provided. Further, an LED display device as a display device 58 is arranged at a part of the front surface of each cover 6 so as to display detect results. The detect results include detecting existence of an empty toner container 1 in the toner container insertion parts 2 based on the respective toner container detect devices 54 and existence of toner in each of the toner containers 1 inserted in the toner container insertion parts 2 based on the toner detect device 57.

Figure 24A:
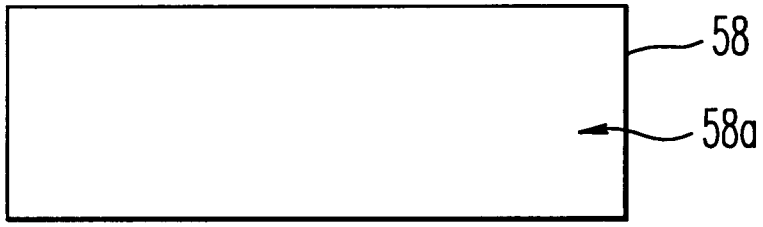
FIGS. 24(*a*), 24(*b*) and 24(*c*) are diagrams respectively illustrating an example of an indication displayed in a display plane of a display device of the toner supplying device of FIG. 23, respectively indicating results of detecting an existence of an empty toner container and an existence of toner in each of the toner containers.
Figure 24B:
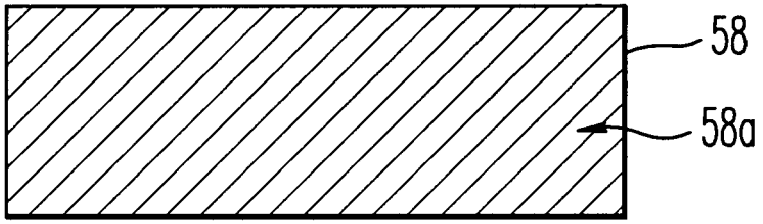
Figure 24C:
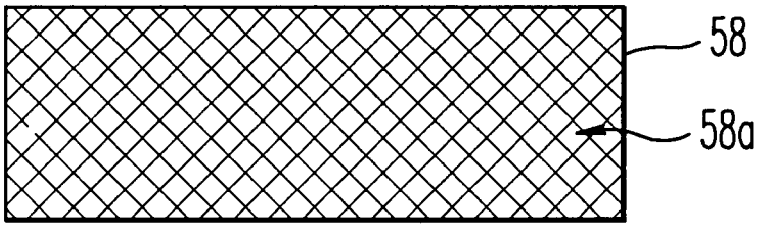

FIGS. 24(*a*), 24(*b*) and 24(*c*) are diagrams respectively illustrating an example of an indication displayed in a display plane 58*a* of the display device 58. The displays indicate results of detecting existence of an empty toner container 1 in the toner container insertion parts 2 with the respective toner container detect devices 54 and existence of toner in each of the toner containers 1 inserted in the toner container insertion parts 2 with the toner detect device 57. FIG. 24(*a*) illustrates an example of indicating that the toner container 1 exists in the corresponding container insertion part 2 and toner exists in the toner container 1. In this example, the display plane 58*a* is not lighted. FIG. 24(*b*) illustrates an example of indicating that the toner container 1 exists in the corresponding toner container insertion part 2 and toner in the toner container 1 inserted in the corresponding toner insertion part 2 is running low or run out. The display of the indication may be slowly intermittent when toner is running low and rapidly intermittent when toner is run out. FIG. 24(*c*) illustrates an example of indicating that a toner container 1 does not exist in the corresponding toner container insertion part 2. In this example, the display plane 58*a* is lighted when displaying this indication.

Figure 25:
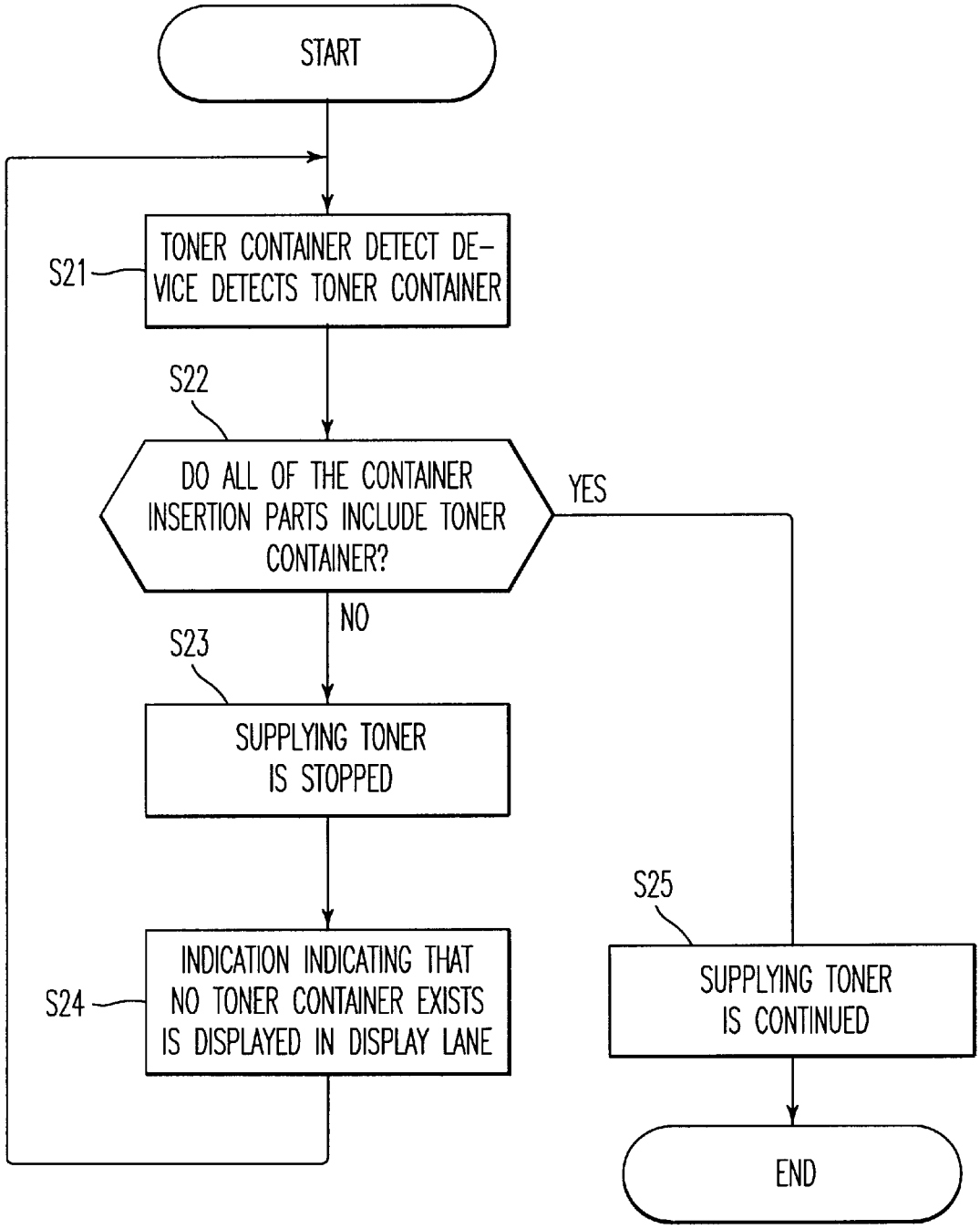
FIG. 25 is a flowchart of an operation of displaying an indication in the display plane of the display device.

FIG. 25 is a flowchart of an operation of displaying results in the display plane 58*a* of the display device 58. The display results indicates results of detecting existence of an empty toner container 1 in the toner container insertion parts 2 with the respective toner container detect devices 54. The displayed results also indicate existence of toner in each of the toner containers 1 inserted in the toner container insertion parts 2 with the toner detect device 57. In step S21, each toner container detect device 54 detects if the toner container 1 is inserted in the corresponding toner container insertion part 2. Step S22 then determines if all of the container insertion parts 2 include the toner container 1. If any of the toner container insertion parts 2 does not include the toner container 1, the control device 511*a* stops supplying toner to the developing device of the image forming apparatus 100 in step S23, and then in step S24, displays in the corresponding display plane 58*a* the indication indicating that toner container 1 does not exists. If a new toner container 1 is inserted into the corresponding toner container insertion part 2 and is detected in step S21, and then if the step S22 determines that all of the container insertion parts 2 include the toner container 1, the control device 511*a* continues to supply toner to the developing device in step S25.

Figure 26:
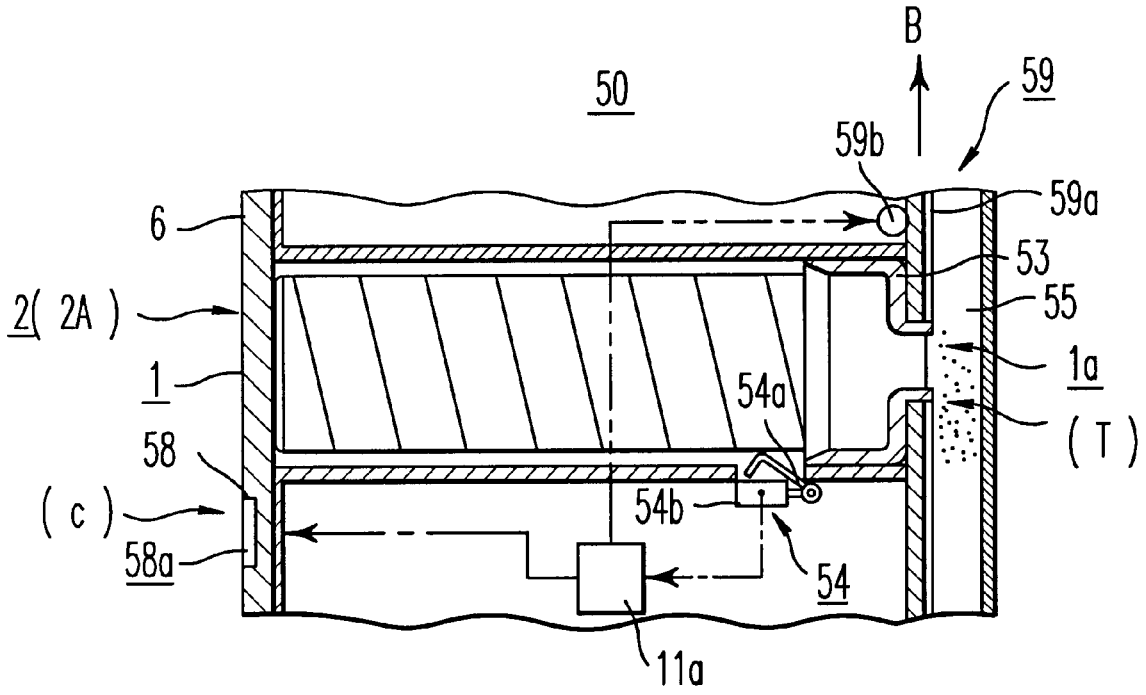
FIG. 26 is a schematic drawing illustrating a sectional view of a main part of the toner supplying device of FIG. 23.

FIG. 26 is a schematic drawing illustrating a sectional view of a main part of the toner supplying device 50. As illustrated in the drawing, when the toner container 1 is inserted in the toner container insertion part 2 and is held by the toner container holder 53, a filler 54*a* of the toner container detect device 54 contacts a sensor 54*b*. Therefore, the existence of the toner container 1 is detected. The sensor 54*b* includes a photo-interrupter, a limiting switch and so forth.

When the toner container detect device 54 detects a toner container 1, the indication indicating that the toner container 1 exists is displayed in the display plane 58*a*. Further, a shutter plate 59*a* of a shutter 59 is driven by a drive motor 59*b* to move in a direction indicated by an arrow J. This opens the communication between the toner container insertion part 2 and the toner conveying path 55, such that toner can be exhausted to the toner conveying path 55 from the opening 1*a* of the toner container 1.

Figure 27:
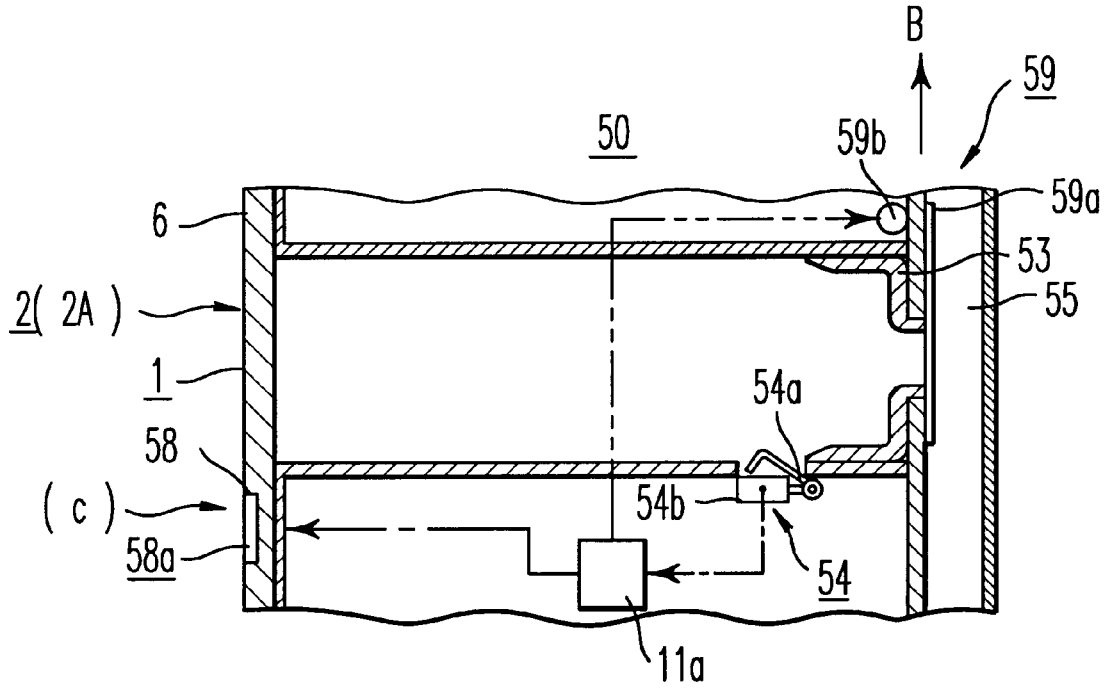
FIG. 27 is a schematic drawing illustrating a sectional view of the main part of the toner supplying device when a toner container is not inserted in the toner insertion part.

FIG. 27 is a schematic drawing illustrating a sectional view of the main part of the toner supplying device 50 when a toner container 1 is not inserted in the toner insertion part 2. When the toner container 1 is not inserted in the toner container insertion part 2, the filler 54*a* of the toner container detect device 54 is rotated in a counterclockwise direction, such that the filler 54*a* does not interfere with the sensor 54*b*, and thereby it is detected that a toner container 1 does not exist. When the toner container detect device 54 detects a toner container 1 does not exist, the indication indicating that toner container 1 does not exist is displayed in the display plane 58*a*, and the shutter plate 59*a* of the shutter 59 is driven by the drive motor 59*b* to move in a direction indicated by an arrow Z. This closes the communication between the toner container insertion part 2 and the toner conveying path 55, such that scattering of toner through the opening 2*a* is prevented.

Figure 28:
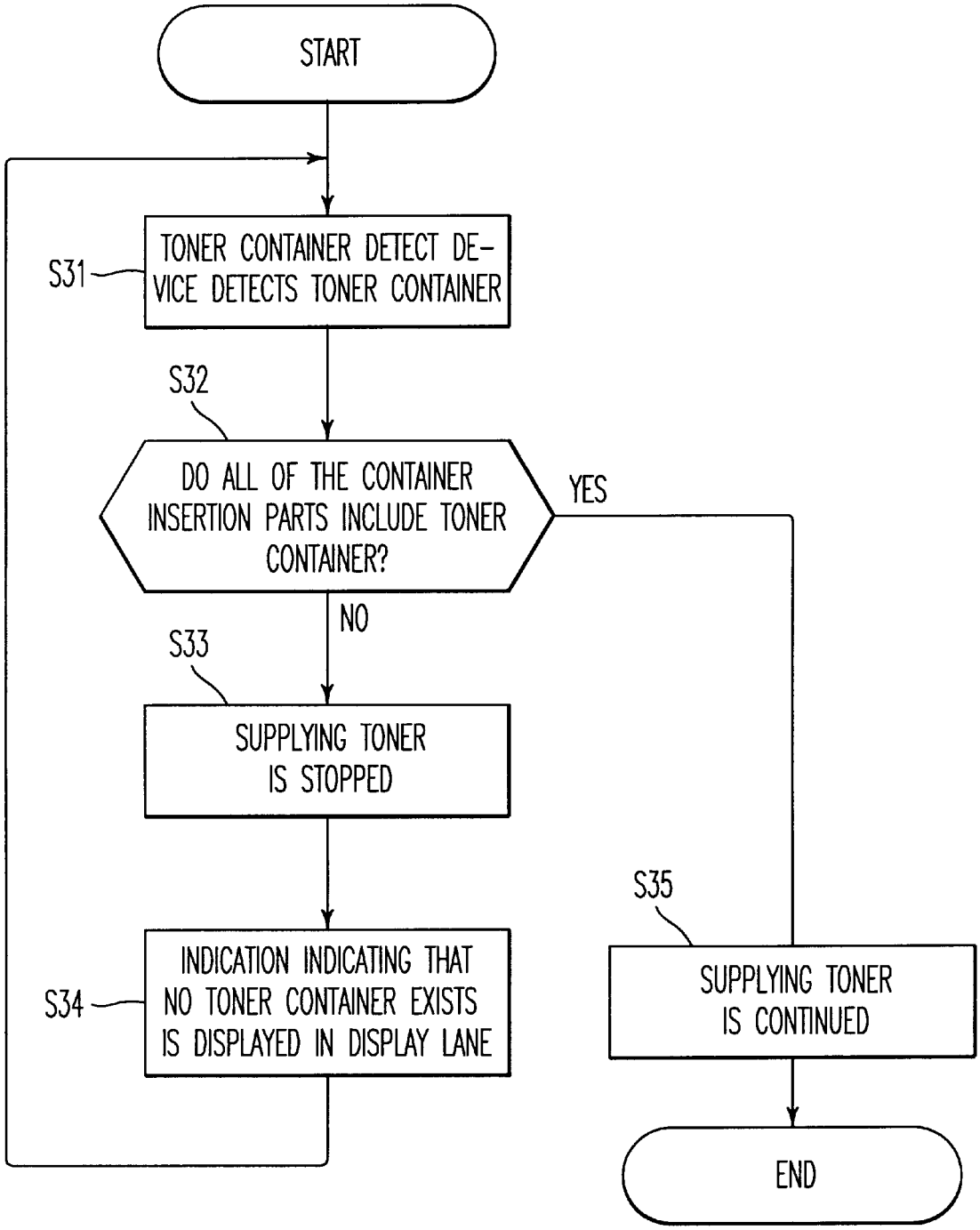
FIG. 28 is a flowchart of an operation of displaying the indication that no toner container exists in the corresponding toner container insertion part, when a shutter to close the communication between an insertion inlet of the toner container insertion part and a toner conveying path is provided in the toner supplying device.

FIG. 28 is a flowchart of an operation of displaying the indication that a toner container 1 does not exist in the corresponding toner container insertion part 2, when the shutter 59 to close the communication between the toner container insertion part 2 and the toner conveying path 55 is provided. In step S31, each toner container detect device 54 detects the toner container 1 inserted in the corresponding toner container insertion part 2. Step S32 then determines if any of the container insertion parts 2 include the toner container 1. If any of the toner container insertion parts 2 includes the toner container 1, toner supply to the developing device 9 is continued in step S35. When none of the toner container insertion parts 2 include the toner container 1, the control device 511*a* stops supplying toner to the developing device 9 in step S33. Then step S34 displays in the display plane 58*a* of each display device 58 the indication indicating that no toner container 1 exists. If a new toner container 1 is inserted into any of the toner container insertion parts 2 and the corresponding toner container detect device 54 detects the newly inserted toner container 1 in step S31, and then if step S32 determines that the toner container insertion parts 2 include the toner container 1, the control device 511*a* starts to supply toner to the developing device 9 in step S35. Thus, another toner container 1 can be inserted in another toner container insertion part 2. That is, a toner container 1 can be replaced while toner is being supplied to the developing device 9 in this embodiment.

Figure 29:
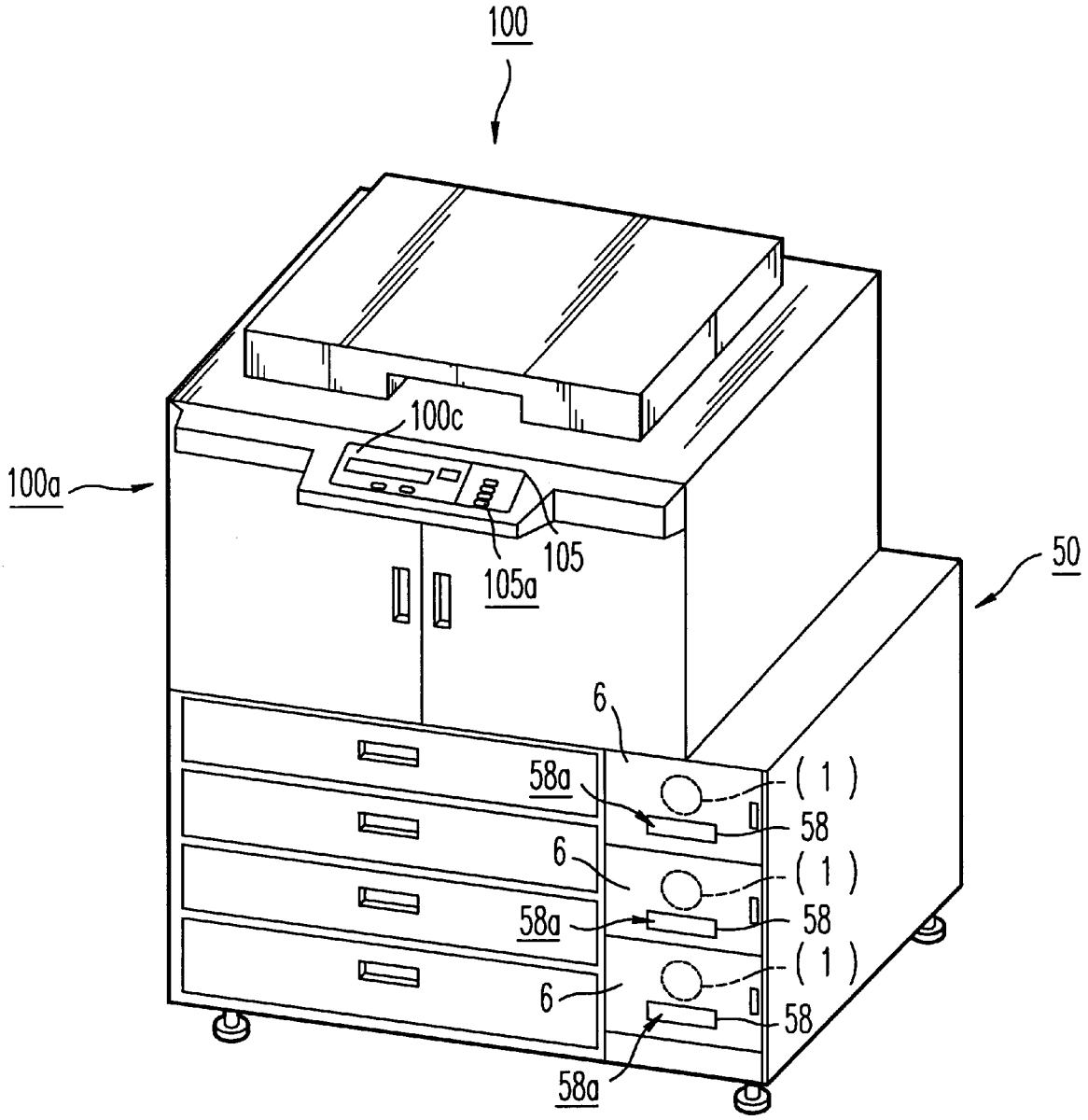
FIG. 29 is a schematic drawing illustrating an example of an outer appearance of an image forming apparatus including the toner supplying device of FIG. 23.
Figure 30:
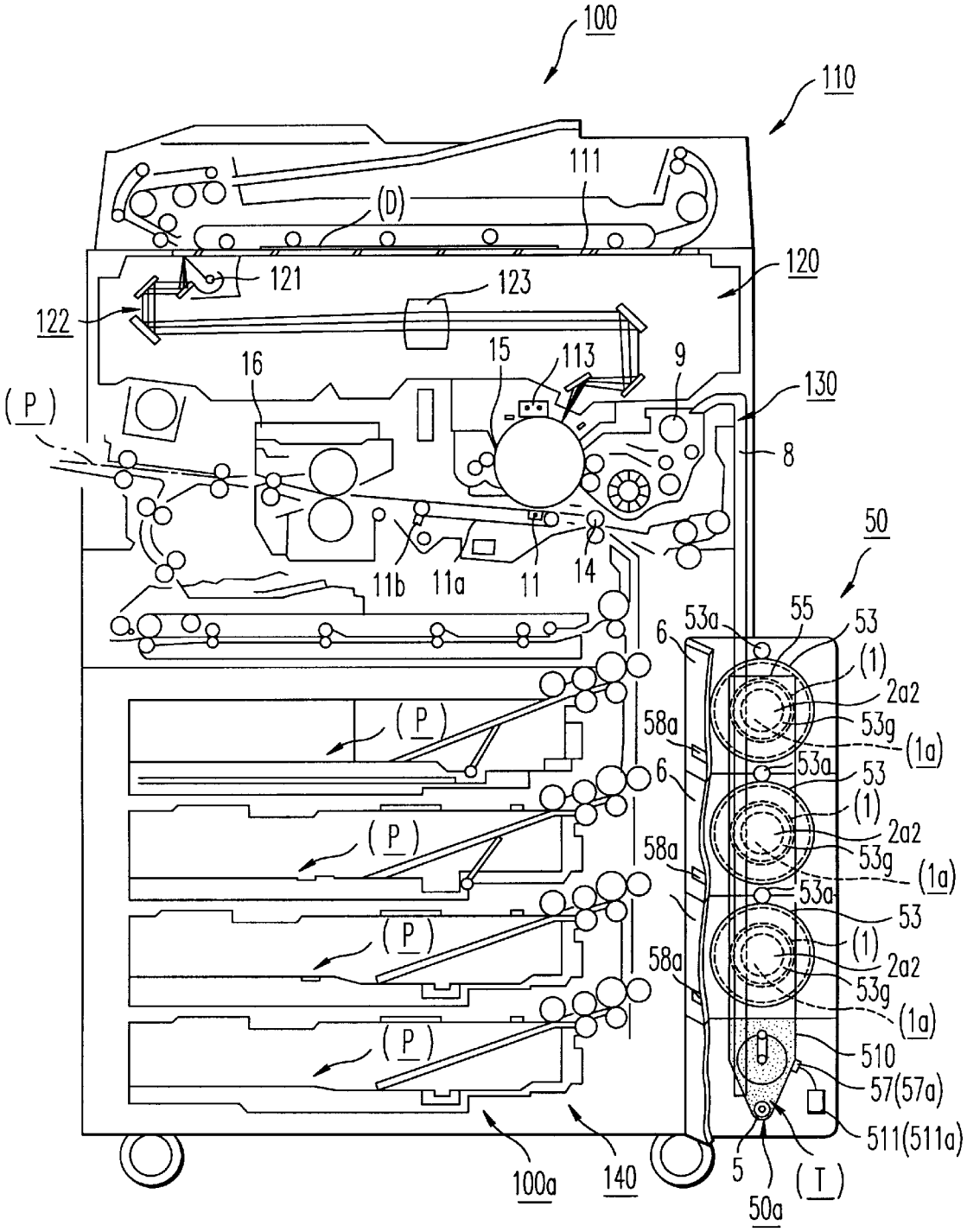
FIG. 30 is a sectional drawing illustrating the construction of the image forming apparatus of FIG. 29.
Figure 31A:
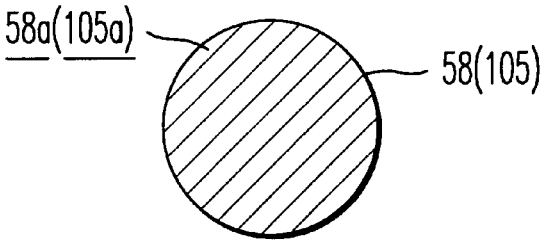
FIGS. 31(*a*), 31(*b*), 31(*c*) and 31(*d*) are diagrams respectively illustrating another example of an indication of the display plane of the display device and a toner supply display plane of a toner supply display device, respectively indicating results of detecting an existence of an empty toner container and an existence of toner in each of the toner containers.
Figure 31B:
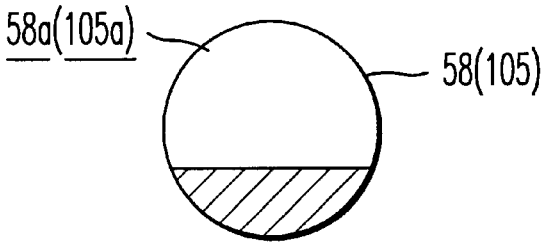
Figure 31C:
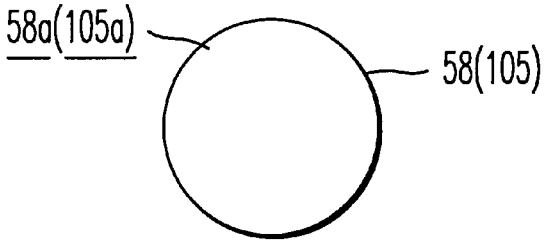
Figure 31D:
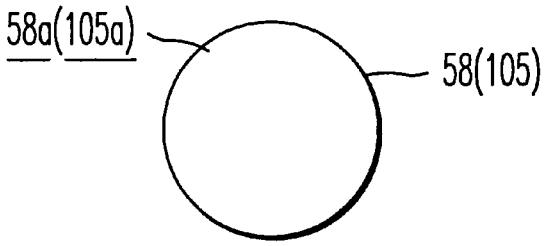

FIG. 29 is a schematic drawing illustrating an example of an outer appearance of an image forming apparatus, including the toner bank 50 as a toner supplying device, according to the present invention. FIG. 30 is a sectional drawing illustrating the construction of this image forming apparatus.

As illustrated in FIG. 29, an image forming apparatus 100 includes the toner bank 50 as the toner supplying device at a lower right part of the image forming apparatus 100. The toner bank 50 includes, as described above, the display plane 58*a* for each toner container 1 held by the toner container holder 53. The display plane 58*a* displays the indications to indicate the results of detecting with the toner container detect device 54 existence of an empty toner container 1 in the corresponding container insertion part 2, and the result of detecting with the toner detect device 57 existence of toner in the toner container 1. In addition, the image forming apparatus 100 is provided with a toner supply display device 105 having a toner supply display plane 105*a* arranged in an operational panel 100*c* of the image forming apparatus 100.

In FIG. 30, when power of a main motor (not shown) is turned on and a toner container 1 held by the toner container holder 53 starts to be rotated by a rotation drive device 53*a*, toner (T) contained in the toner container 1 is exhausted through an opening 1*a* into a toner exhausting path 55. The opening 1*a* is provided at an axial end of the container 1. The toner exhausted to the toner exhausting path 55 from each toner container 1 is conveyed to a toner deposit part 510 at the bottom of the toner exhausting path 55. The toner deposited in the toner deposit part 510 is mixed with air by a toner delivery device 5 and is then conveyed to a developing device 9 of the image forming apparatus 100.

When a sensor 57*a* of the toner detect device 57 provided at a bottom part of the toner deposit part 510 detects that the toner at the toner deposit part 510 is below a predetermined height, the operating toner container 1 is rotated to discharge toner through the opening 1*a* under a control of a control device 511*a* according to a detect signal from the sensor 57*a*. When the sensor 57*a* detects that the toner at the toner deposit part 510 is above the predetermined height, the toner container 1 is stopped from being rotated to discharge toner, and both the display plane 58*a* and the toner supply display plane device 105*a* of the toner supply display device 105 (FIG. 29) display an indication indicating that a toner container 1 exists and toner exists in the toner container 1.

When the sensor 57*a* detects that the toner in the deposit part 510 is below the predetermined height a predetermined number of times or for a predetermined period of time, the control device 511*a* determines that the toner contained in the operating toner container 1 is running low. Then, the control device 511*a* controls the rotation drive device 53*a* for another toner container 1, for which the display plane 58*a* and the toner supply display plane 105*a* are displaying the indication to indicate that a toner container 1 exists and toner exist in the container 1, to be driven, such that the another toner container 1 is started to be rotated by the rotation drive device 53*a* to discharge toner therefrom to the toner conveying path 55 so as to be deposited in the toner deposit part 510.

When a predetermined period of time elapses after the toner detect device 57 detects that the toner in the operating toner container 1 is running low, a cap 53*g* of the operating toner container 1 closes the opening 1*a* of the toner container 1. After the opening 1*a* of the toner container 1 is closed by the cap 53*g*, both the display plane 58*a* and the toner supply display plane 105*a* of the toner supply display device 105 intermittently display the indication indicating that a toner container 1 exists and the toner in the container 1 is running low or empty. Alternatively, the display of the indication may be slowly intermittent when the toner is running low and rapidly intermittent when the toner has run out. Thus, the remaining amount of toner in the toner bank 50 is easily recognized via the above-described indications by an operator. Therefore, the operator is reminded of replacing the used toner container 1, and consequently the intermittent supply of toner to the developing device 9 is prevented. In addition, because the opening 1*a* of the used toner container 1 is closed with the cap 53*g*, scattering of toner is prevented when the used toner container 1 is removed from the toner supplying device 50.

FIGS. 31(*a*), 31(*b*), 31(*c*) and 31(*d*) are diagrams respectively illustrating another example of an indication of the display plane 58*a* of the display device 58 and the toner supply display plane 105*a* of the toner supply display device 105. This displays are for indicating the results of detecting existence of an empty toner container 1 in each of the toner container insertion parts 2 with the corresponding toner container detect device 54 and existence of toner in each of the toner containers 1 inserted in each toner container insertion part 2 with the toner detect device 57. FIG. 31(*a*) illustrates an indication for a state where a toner container 1 exists and toner exists in the container 1, FIG. 31(*b*) for a state where a toner container 1 exists and the toner is running low, FIG. 31(*c*) for a state where a toner container 1 exists and the toner has run out, and FIG. 31(*d*) for a state where no toner container 1 exists. With these indications, recognition of the remaining amount of the toner in the toner bank 50 is further facilitated.

Figure 32:
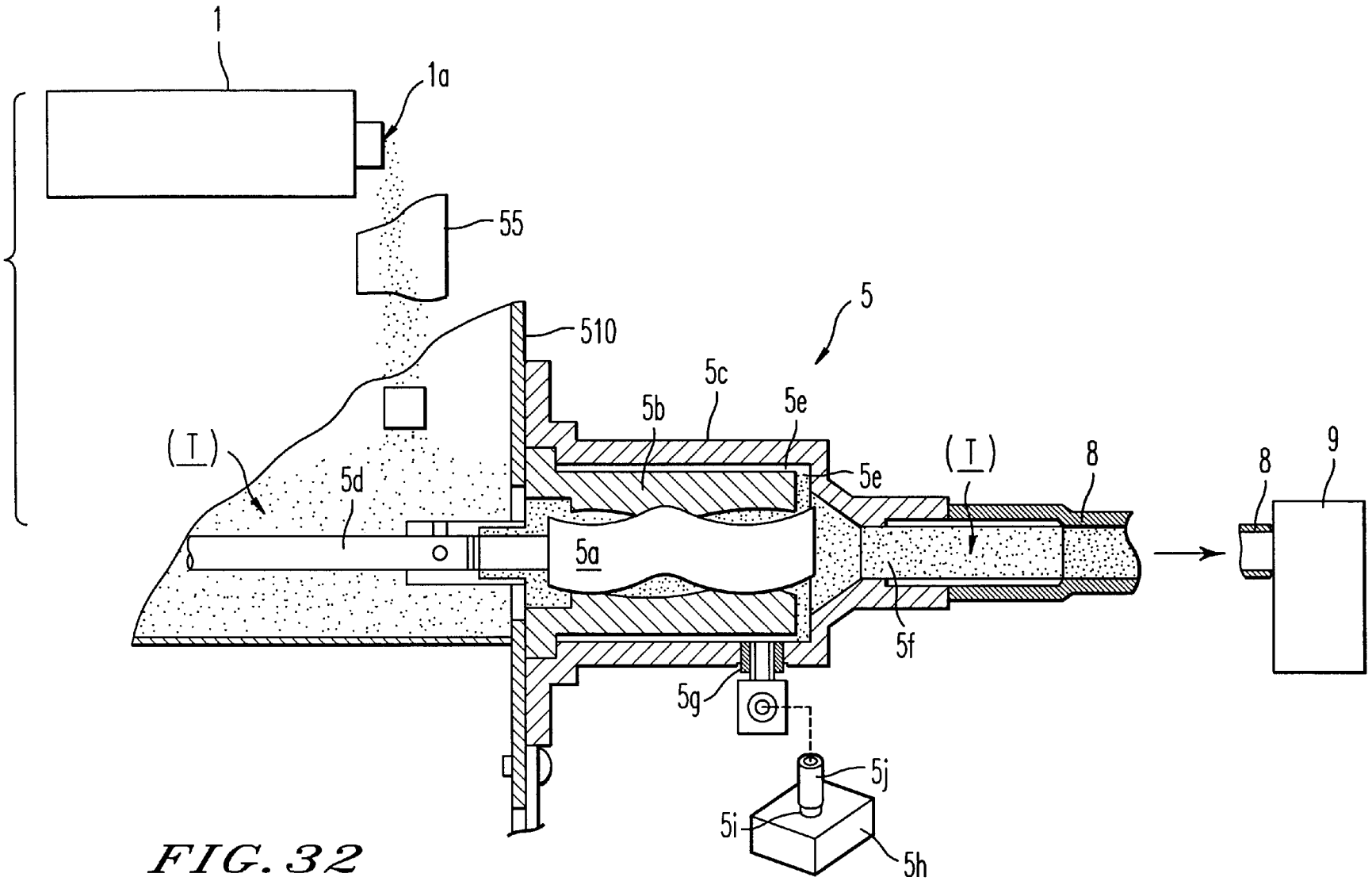
FIG. 32 is a schematic drawing illustrating an exemplary construction of the toner delivery device used in the toner supplying device of FIG. 23.

FIG. 32 is a schematic drawing illustrating an exemplary construction of the toner delivery device 5 used in the toner supplying device 50. The toner delivery device 5 includes a powder pump generally called a Moineau pump described earlier. The toner delivery device 5 mixes the toner, which is exhausted from the toner container 1 to the toner conveying path 55 and deposited in the toner deposit part 510, with air so as to deliver the mixture of toner and air to the developing device 9 through the toner/air mixture conveying path 8.

Figure 33:
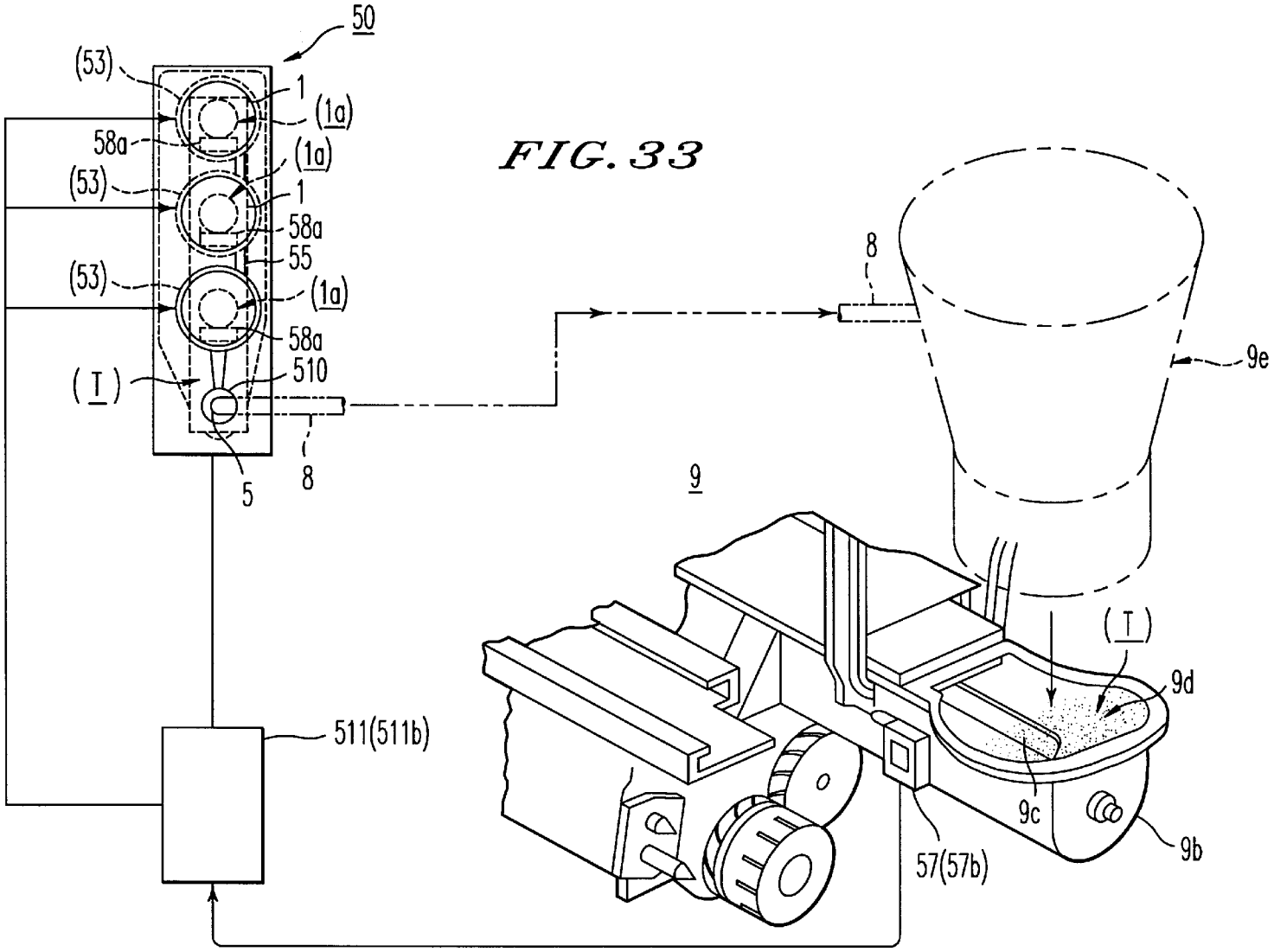
FIG. 33 is a schematic drawing illustrating the main portion of the developing device of the image forming apparatus of FIG. 30 for explaining control of toner supply from the toner supplying device to the developing device.

FIG. 33 is a schematic drawing illustrating the main portion of the developing device 9 of the image forming apparatus 100 of FIG. 30 and is for explaining control of toner supply from the toner bank 50 to the developing device 9 with the control device 511 and a sensor 57*b* provided to the toner supplying section 9*b* of the developing device 9. In FIG. 33, if the sensor 57*b* does not detect toner, that is, when the height of the accumulated toner in the toner supplying section 9*b* of the developing device 9 is lower than a predetermined level, the above powder pump unit 5 is driven to supply toner from the toner bank 50 to the toner supplying section 9*b* of the developing device 9. When the height of the accumulated toner in the toner supplying section 9*b* reaches the predetermined level, the toner is detected by the sensor 57*b* and the supply of toner to the toner supplying section 9*b* from the toner bank 50 is stopped. With these controls, the toner supplying section 9*b* always contains a certain amount of toner, so that a stable developing process is assured. Additionally, if the sensor 57*b* does not detect toner a predetermined number of times ( i.e., at periodic or predetermined intervals) or for a predetermined period of time, it is determined that the toner contained in the toner container 1 is almost exhausted. Then, toner contained in another toner container 1, for which the display plane 58*a* displays the indication that a toner container 1 exists and toner exists in the container 1, starts to be operated by a rotation drive device (not shown in FIG. 33) to exhaust the toner to the toner conveying path 55, so as to be deposited in the toner deposit part 510.

Figure 34A:
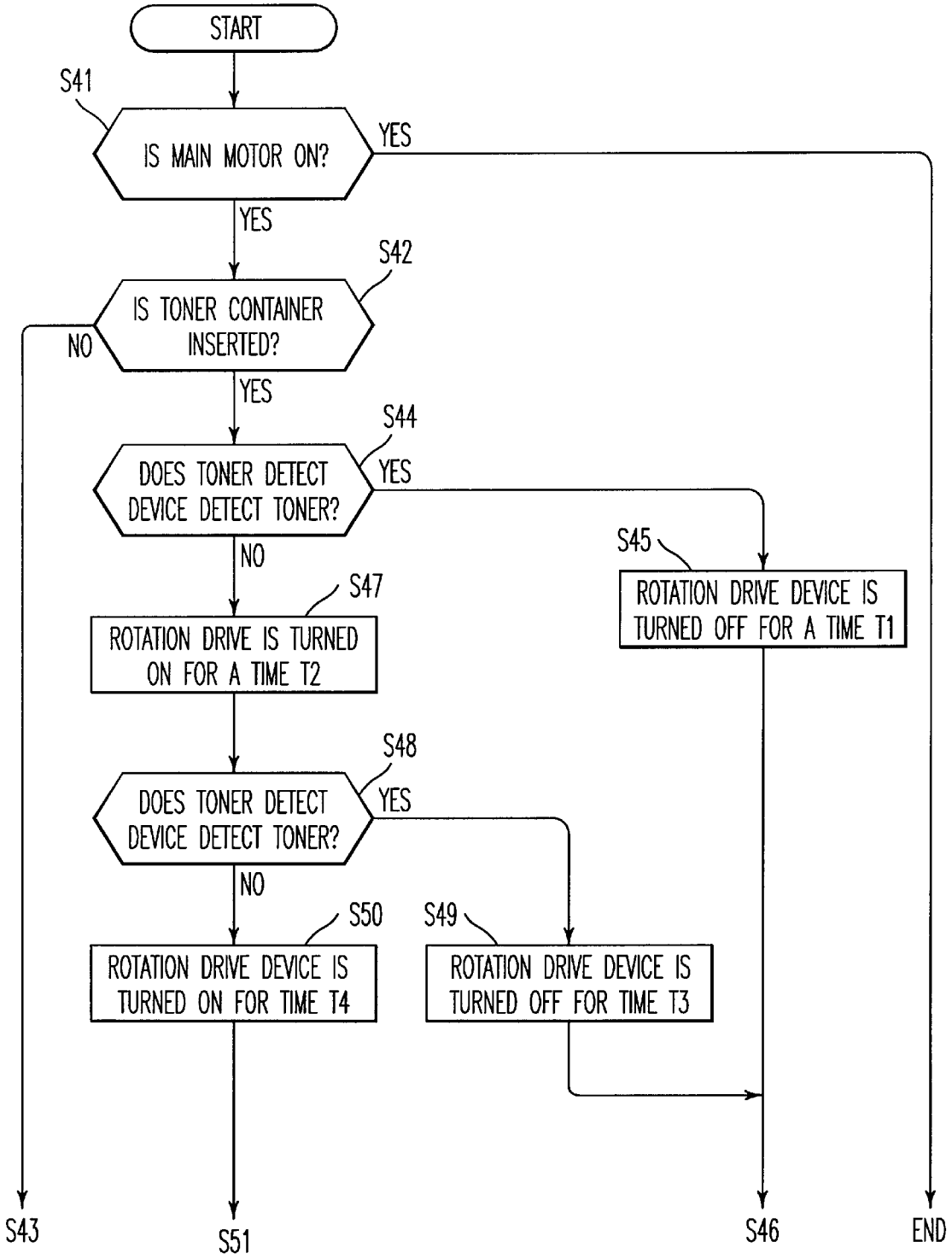
FIG. 34 is a flowchart illustrating an exemplary operation of detecting an existence of an empty toner container and an existence of toner in each of the toner containers and displaying detect results in the display plane.
Figure 34B:
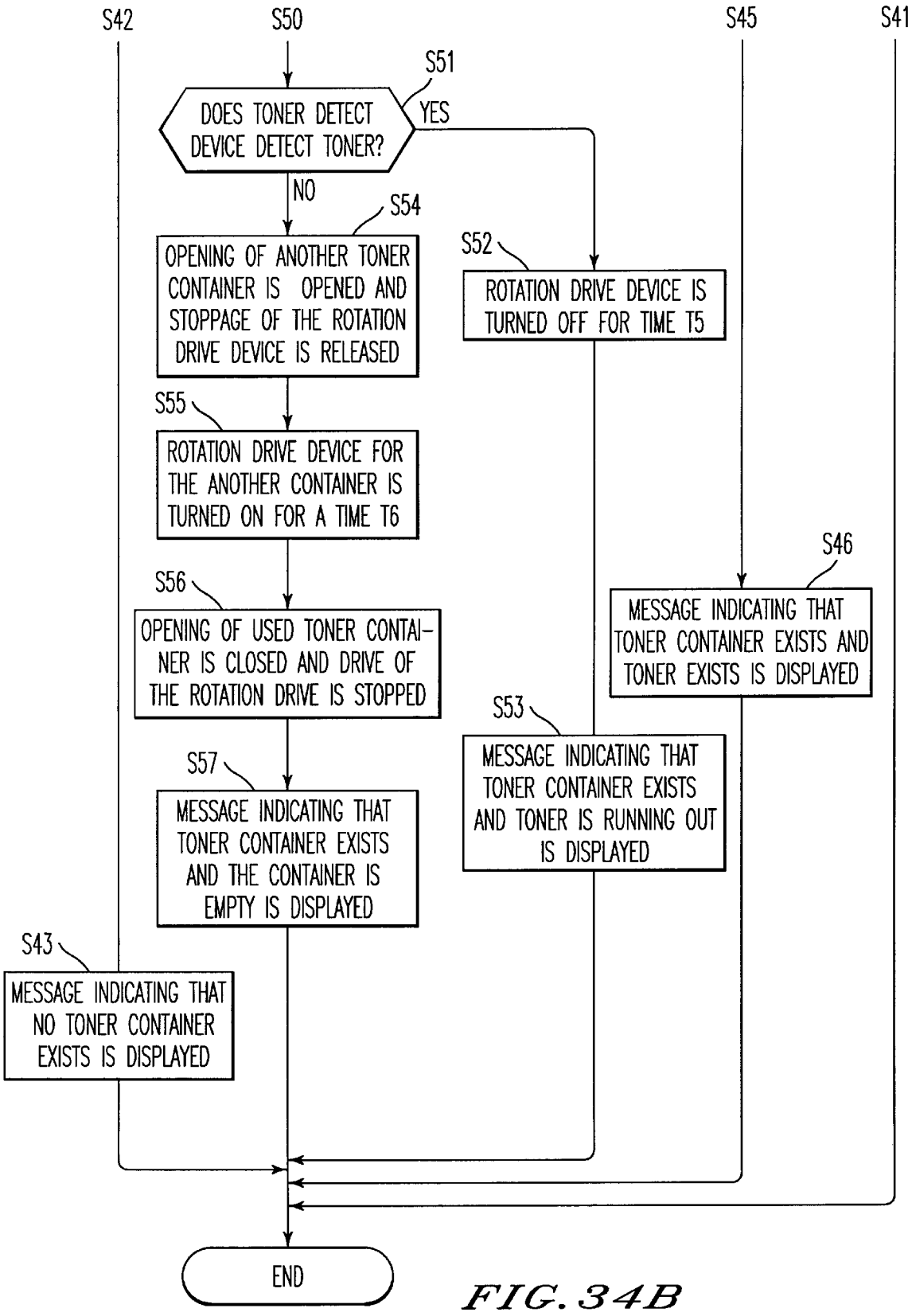

FIG. 34 is a flowchart illustrating an exemplary operation of detecting existence of an empty toner container 1 in each of the toner container insertion parts 2 with the toner container detect device 54 and existence of toner in the toner container 1 inserted in each toner container insertion part 2 with the toner detect device 57, and displaying the detect result in the display plane 58*a*.

In step S41, the controller 511*a* or 511*b* of the controller 511 determines if the main motor of the image forming apparatus 100 is on by detecting existence of toner in the toner container 1 with the sensor 57*a* or 57*b* of the toner detect device 57. If the main motor is on, step S42 determines if a toner container 1 is inserted in each of the toner container insertion parts 2 with the toner container detect device 54. If the toner container 1 is not inserted in each of the toner container insertion parts 2, step S43 displays in the corresponding display plane 58*a* of the display device 58 the message indicating that a toner container 1 does not exist. If the toner container 1 is inserted in any of the toner container insertion parts 2, step S44 detects existence of the toner with the toner detect device 57. If the toner detect device 57 detects the toner deposited in the toner deposit part 510 (i.e. the deposited toner exceeds a predetermined height), step S45 turns off the rotation drive device 53*a* for the operating toner container 1 for a period of time T1 to stop discharging the toner from the operating toner container 1. Step S46 displays in the corresponding display plane 58*a* the message indicating that the toner container 1 exists and toner exists in the toner container 1.

If the toner detect device 57 detects no toner (i.e., the deposited toner does not exceed the predetermined height) in step S44, step S47 turns on the rotation drive device 53*a* for the operating toner container 1 for a period of time T2, and step S48 detects existence of toner with the toner detect device 57. If the toner detect device 57 detects the toner deposited in the toner deposit part 510 (i.e., the deposited toner exceeds a predetermined height), step S49 turns off the rotation drive device 53*a* for a period of time T3 to stop discharging the toner from the operating toner container 1. Step S46 displays in the display plane 58*a* the message indicating that the toner container 1 exists and toner exists in the operating toner container 1.

If the toner detect device 57 detects no toner (i.e., the deposited toner does not exceed the predetermined height) in step S48, step S50 turns on the rotation drive device 53*a* for the operating toner container 1 for a period of time T4, and step S51 detects existence of toner with the toner detect device 57. If the toner detect device 57 detects the toner deposited in the toner deposit part 510 (i.e., the deposited toner exceeds the predetermined height), step S52 turns off the rotation drive device 53*a* for the operating toner container 1 for a period of time T5 to stop discharging the toner from the toner container 1. Step S53 displays in the display plane 58*a* the message indicating that the toner container 1 exists and the toner in the operating toner container 1 is running out.

If the toner detect device 57 detects no toner (i.e., the deposited toner does not exceed the predetermined height) in step S51, step S54 determines that the operating toner container 1 is empty. Then, the opening 1*a* of another toner container 1 inserted in another toner container insertion part 2 is opened by taking off the cap 53*g* of the another toner container 1 and the stoppage of the drive of the rotation drive 53*a* for the another toner container 1 is released. Step S55 then turns on the rotation drive device 53*a* for the another toner container 1 for a period of time T6. Step S56 closes the opening 1*a* of the used toner container 1 with the cap 53*g* and stops the drive of the rotation drive device 53*a* for the used toner container 1. Step S57 then displays in the display plane 58*a* for the used toner container 1 the message indicating that the toner container 1 exists and the container 1 is empty.

Figure 35:
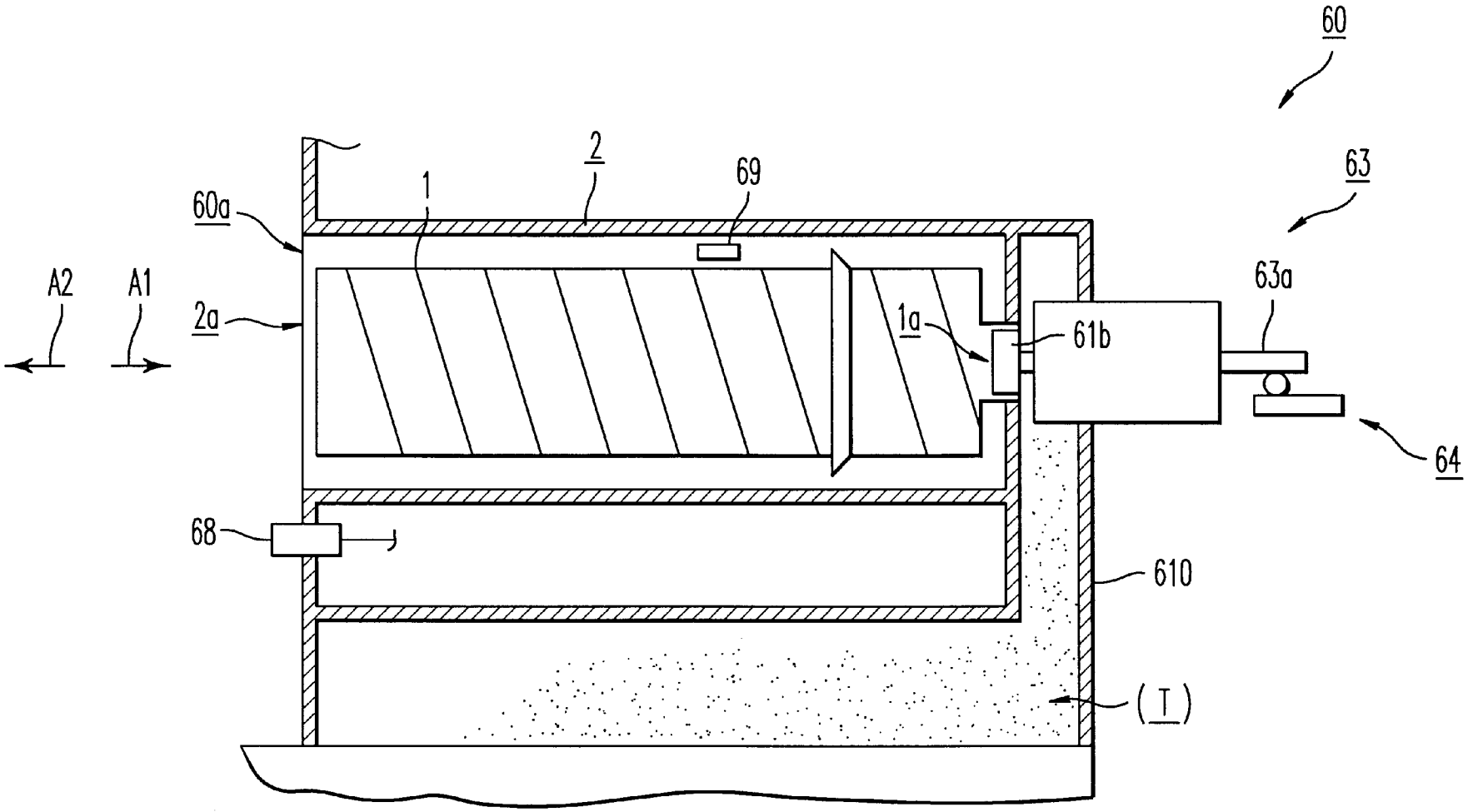
FIG. 35 is a schematic sectional drawing illustrating an example of a toner supplying device according to another embodiment of the present invention.
Figure 36:
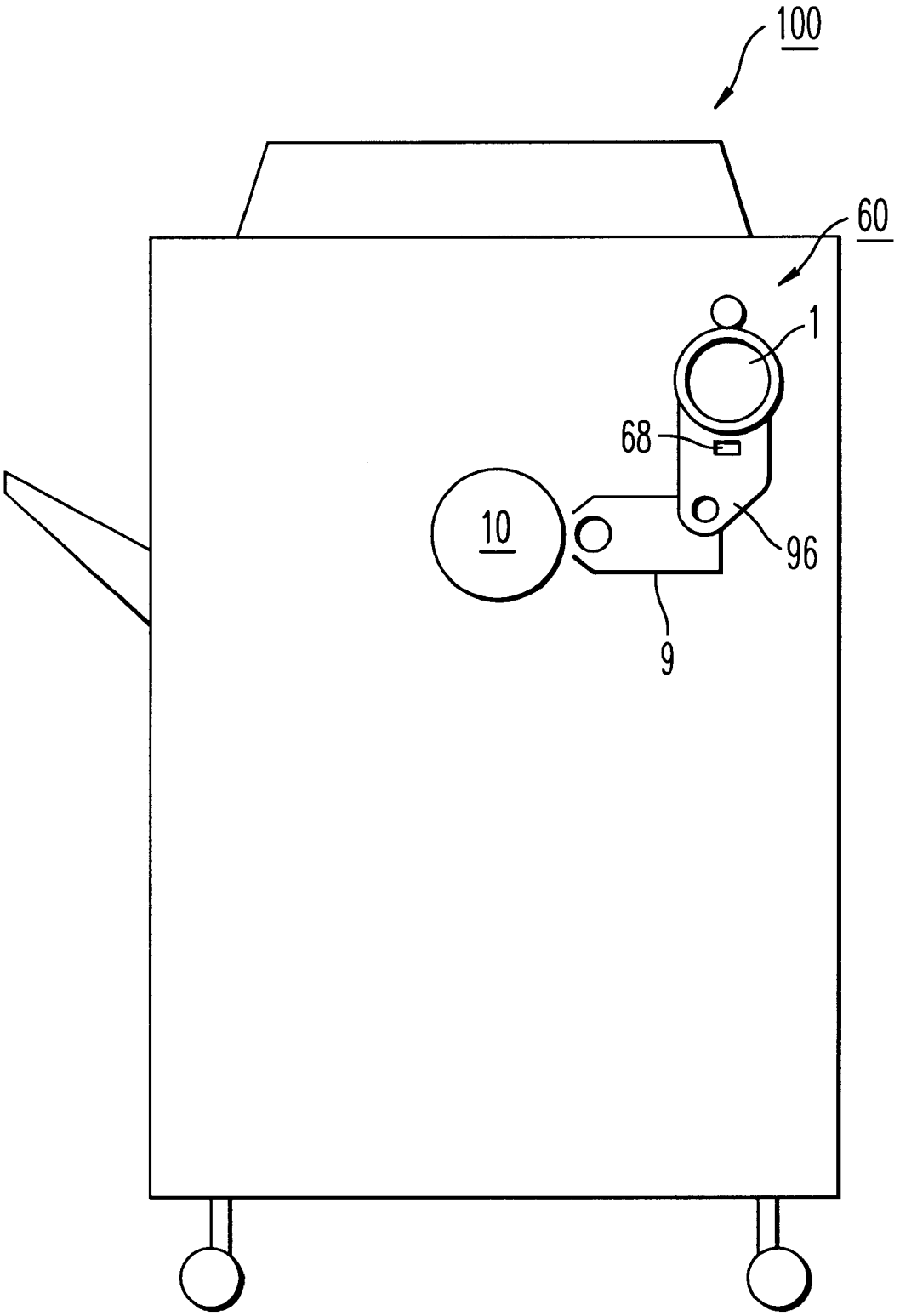
FIG. 36 is a schematic drawing illustrating an image forming apparatus incorporating the toner supplying device of FIG. 35.

FIG. 35 is a schematic sectional drawing illustrating an example of a toner supplying device according to another embodiment of the present invention, and FIG. 36 is a schematic drawing illustrating an image forming apparatus incorporating the same toner supplying device.

A toner supplying device 60 is configured such that a toner container 1 can be inserted through an insertion inlet 2*a* located at a front surface 60*a* of the toner supplying device 60, so as to be attached to a toner container insertion part 2 by manipulating an operation lever 68. An arrow A1 indicates a direction to insert the toner container 1 into the toner container insertion part 2 to be attached to the toner supplying device 60, and an arrow A2 indicates a direction to detach the toner container 1 from the toner supplying device 60.

An open/close device 63 that opens and closes an opening 1*a* of the toner container 1 is provided at a position to face a cap 61*b* of the container 1, with which the opening 1*a* of the container 1 is closed. The open/close device 63 puts the cap 61*b* on and off the opening 1*a* of the container 1 so as to open and close the opening 1*a* by moving a moving member 63*a* of the open/close device 63 in the directions indicated by the arrows A1 and A2 in FIG. 35.

Toner (T) contained in the toner container 1 is discharged from the container 1 to a toner exhaust path 610 when the toner container 1 is rotated by a rotation drive of a discharging device 69 after the cap 61*b* is detached from the opening 1*a* by the open/close device 63. The exhausted toner is then conveyed to a toner supplying section 9*b* of a developing device 9 of the image forming apparatus 100 (illustrated in FIG. 36) via the toner conveying path 610.

A drive device 64 of the open/close device 63 is configured so as to apply to the moving member 63*a* of the open/close device 63 a driving force to move the cap 61*b* of the toner container 1 in the directions to open and close the opening 1*a* of the container 1. That is, in the directions indicated by the arrows A1 and A2 in FIG. 35. The drive device 64 is further configured so as to prevent the moving member 63*a* from being moved when the drive device 64 does not apply the driving force to the moving member 63*a* in the directions indicated by the arrows A1 and A2.

Figure 37:
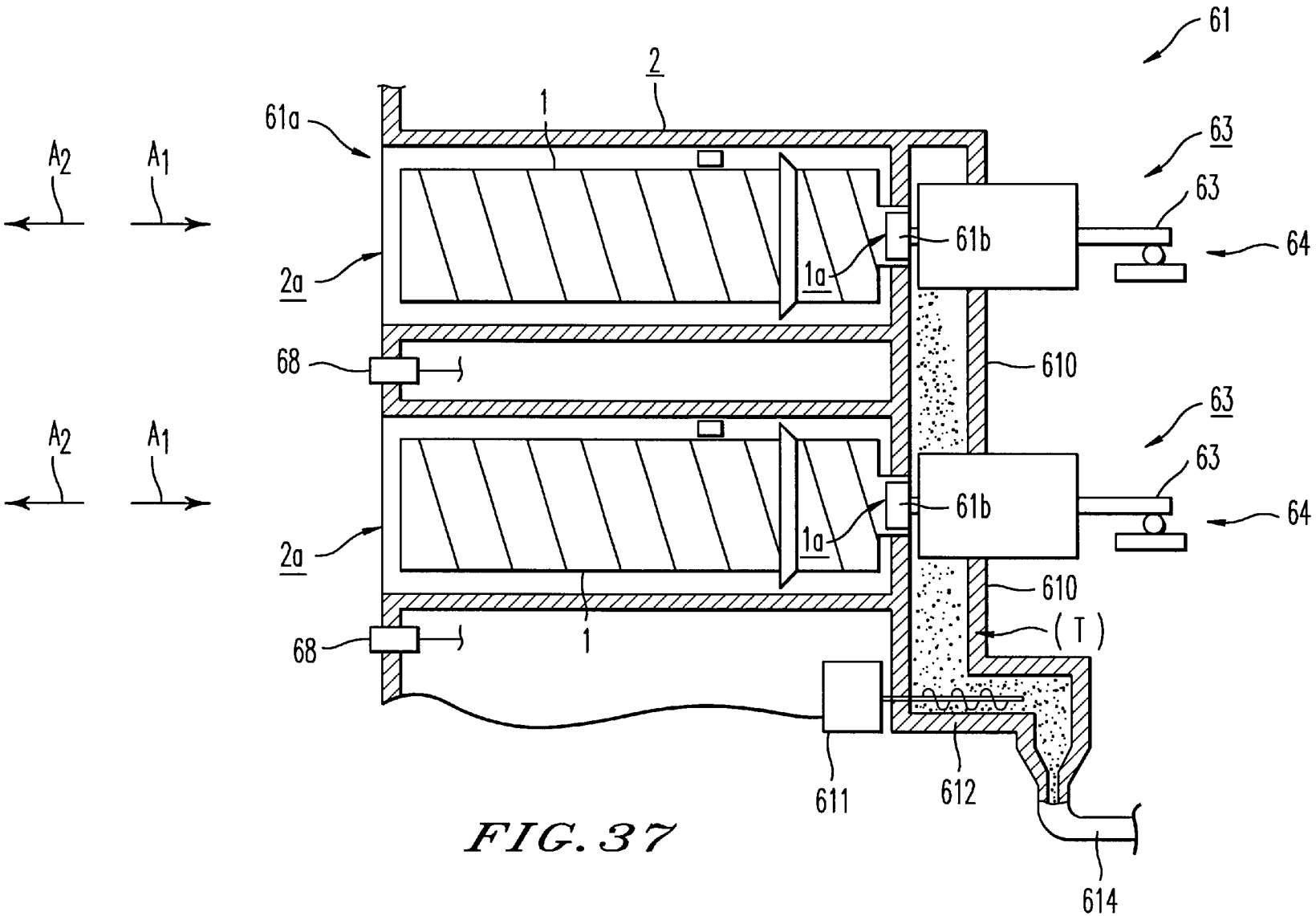
FIG. 37 is a schematic sectional drawing illustrating an example of a toner supplying device according to still another embodiment of the present invention.
Figure 38:
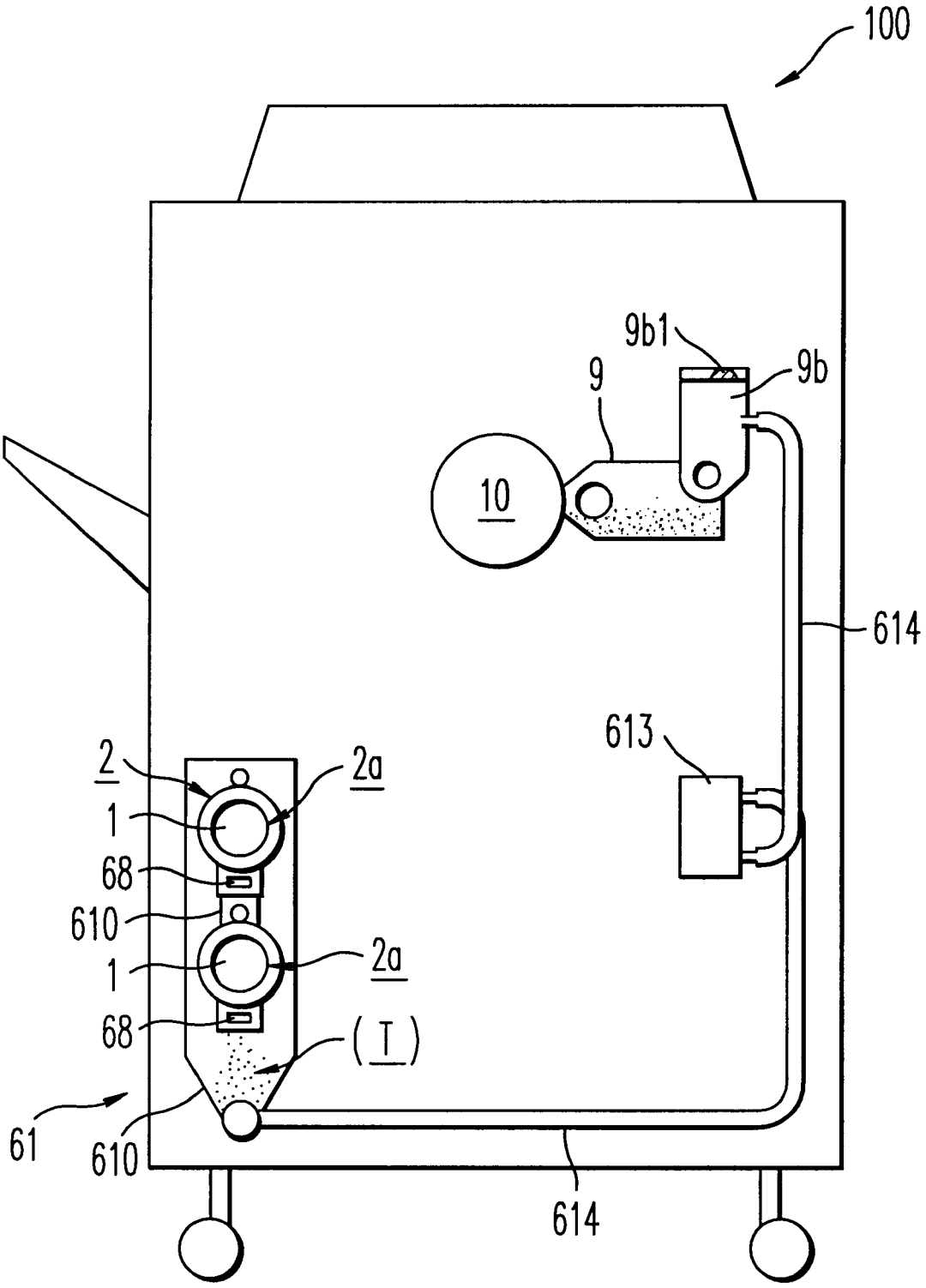
FIG. 38 is a schematic drawing illustrating an image forming apparatus incorporating the toner supplying device of FIG. 37.

FIG. 37 is a schematic sectional drawing illustrating an example of a toner supplying device according to still another embodiment of the present invention, and FIG. 38 is a schematic drawing illustrating an image forming apparatus incorporating the same toner supplying device.

A toner supplying device 61 is configured such that two pieces of toner containers 1 can be inserted through a pair of insertion inlets 2*a* located at a front surface 61*a* of the toner supplying device 61, so as to be attached to a toner insertion part 2 by manipulating an operation lever 68 provided for each insertion inlet 2*a*. An arrow A1 indicates a direction to insert the toner container 1 to be attached to the toner supplying device 61, and an arrow A2 indicates a direction to detach the toner container 1 from the toner supplying device 61.

Toner (T) discharged from each of the toner containers 1 is merged with each other in the toner exhaust path 610 and then exhausted from the toner exhaust path 610 to a toner conveying path 614 by a rotation movement of a toner conveying screw 612 of a drive device 611. The toner is then conveyed, as illustrated in FIG. 38, by a toner delivery device 613 including a powder diaphragm pump, to a toner supplying section 9*b* of a developing device 9 of the image forming apparatus 100 via the toner conveying path 614. The toner supplying section 9*b* includes a filter 9*b*1 for passing air, such that air, which is mixed with toner, is exhausted.

Figure 39:
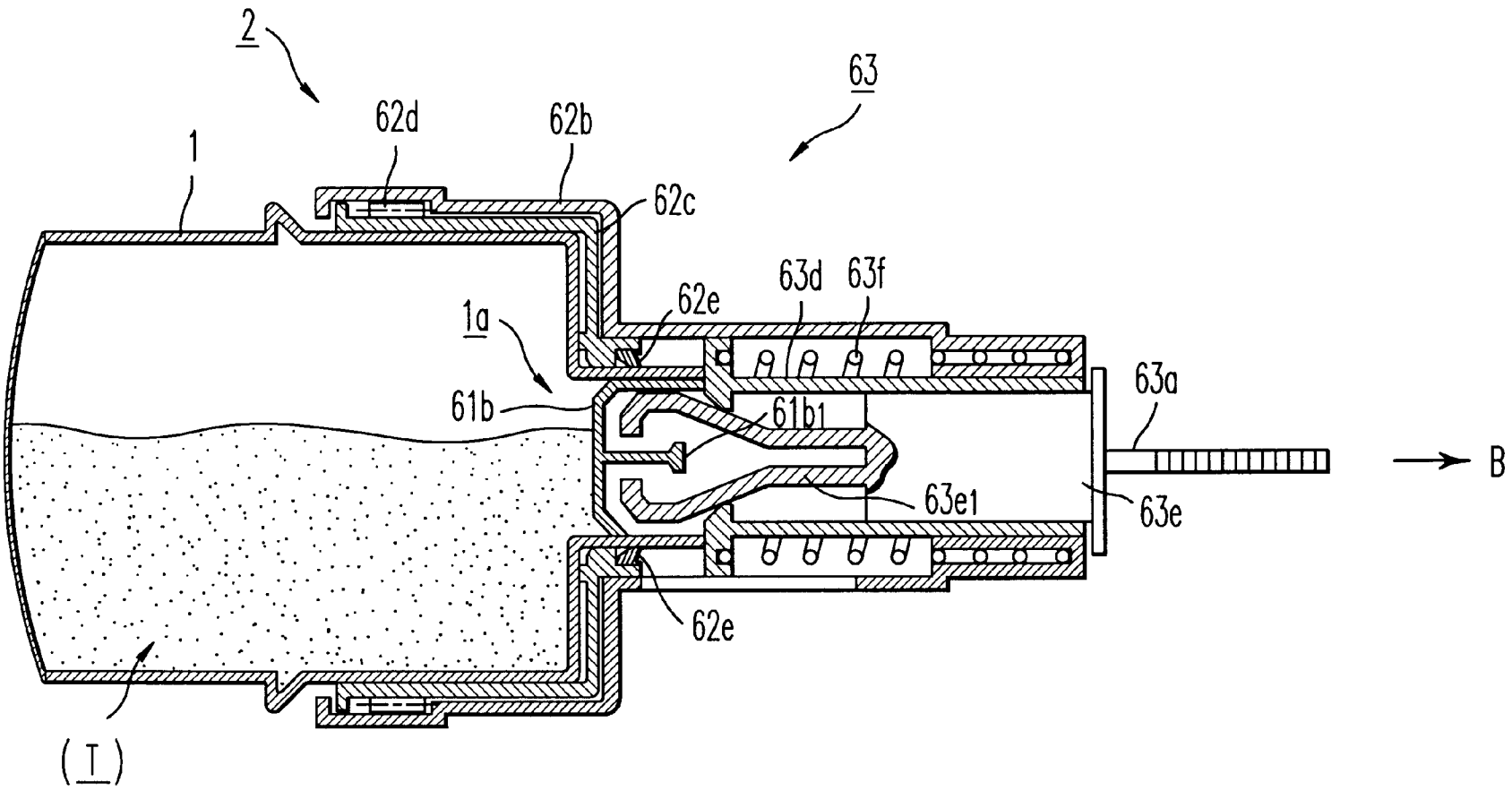
FIGS. 39 and 40 are sectional drawings illustrating a structure of a toner insertion part and an open/close device used in the toner supplying devices of FIGS. 35 and 37.
Figure 40:
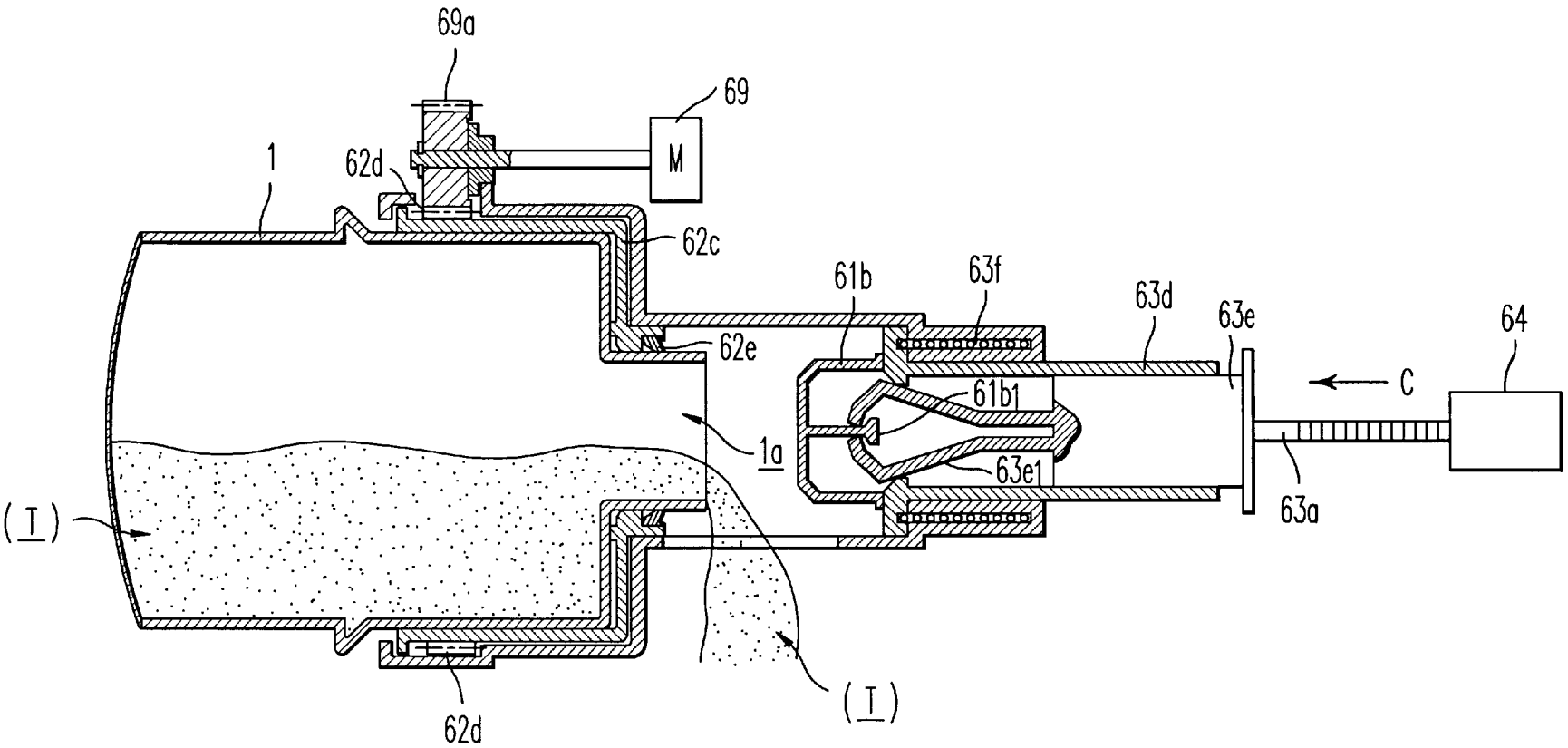

FIGS. 39 and 40 are sectional drawings illustrating a structure of the toner container insertion part 2 and the open/close device 63. As illustrated in FIG. 39, in the toner container insertion part 2, there is provided a rotatably-supported inner holder 62*c* in a holder 62*b*. The inner holder 62*c* is rotated by a gear drive (not shown) via a driving gear 62*d*. The toner container 1 has recess and projecting portions (not shown) so that it can rotate synchronously with this inner holder 62*c*. In the inner holder 62*c*, as shown in FIG. 39, a seal 62*e* is arranged so as to prevent toner from being scattered from a gap between the toner container 1 and a supporting section of the inner holder 62*c*. In the holder 62*b*, a slider 63*d* and a chuck 63*e* are supported so as to respectively slide freely. The slider 63*d* is pressed by a spring 63*f* in a direction that urges the cap 61*b* toward the toner container 1. When the chuck 63*e* is shifted in a direction indicated by an arrow B, as shown in FIG. 39, from this state, a grab portion 61*b*1 of the cap 61*b* is held by a click 63*e*1 of the chuck 63*e*, and then the cap 61*b* is drawn out of the toner container 1, whereby the opening 1*a* is opened.

FIG. 40 illustrates a state of the open/close device 63 when the cap 61*b* is taken off the opening 1*a* of the toner container 1. In FIG. 40, when the driving gear 62*d* is rotated by a gear 69*a* of the rotation drive device 69 in this state, the inner holder 62*c* rotates and the toner container 1 rotates synchronously with this rotation, whereby toner (T) in the toner container 1 is discharged from the opening 1*a*. If the toner (T) remaining in the toner container 1 becomes less than a predetermined amount, as determined by the toner detect device (not shown) after a predetermined period of time long enough for using the remaining toner of the toner container 1, the opening 1*a* of the toner container 1 is closed by the cap 61*b* by shifting the chuck 63*e* with the drive device 64 in a direction indicated by the arrow C in FIG. 40.

Figure 41:
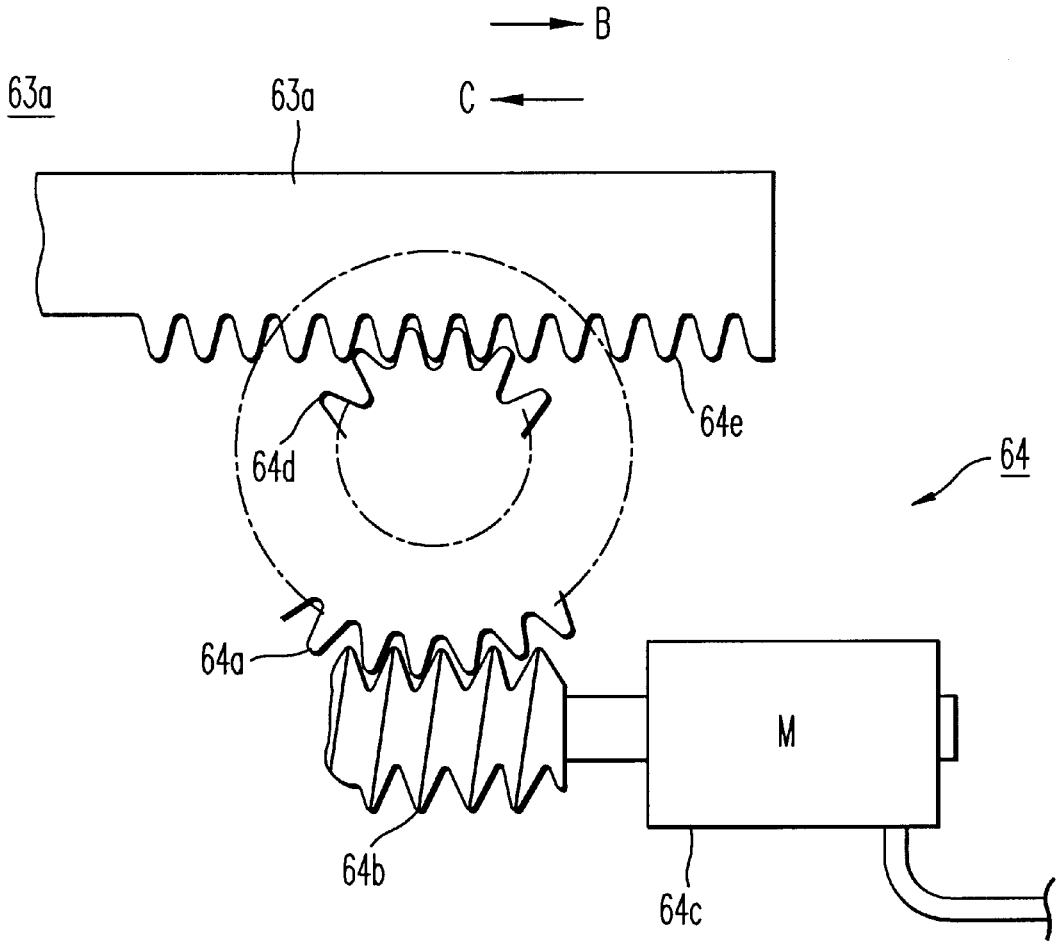
FIG. 41 is a schematic drawing illustrating a structure of a drive device to drive the open/close device used in the toner supplying devices of FIGS. 35 and 37.

FIG. 41 is a schematic drawing illustrating the structure of the drive device 64. As illustrated in FIG. 41, the drive device 64 includes a worm wheel 64*a*, a worm 64*b*, a rotation drive unit 64*c*, a pinion 64*d*, and a rack 64*e* provided to the moving member 63*a*. The drive device 64 is configured so as to move the moving member 63*a* in the directions indicated by arrows K and L by a rotation movement of the pinion 64*d* in clockwise and counterclockwise directions, respectively, with the rotation drive device 64*c*. Because the drive device 64 is configured as above so as to prevent the moving member 63*a* from being moved when the drive device 64 does not apply the driving force to the moving member 63*a* in the directions indicated by the arrows K and L, even when the cap 61*b* is kept being removed from the opening 1*a* or the cap 61*b* is kept being placed in the opening 1*a* to close the opening 1*a* for a long time, the rotation drive device 64*c* does not need to keep being activated, and thereby power consumption is saved.

Figure 42A:
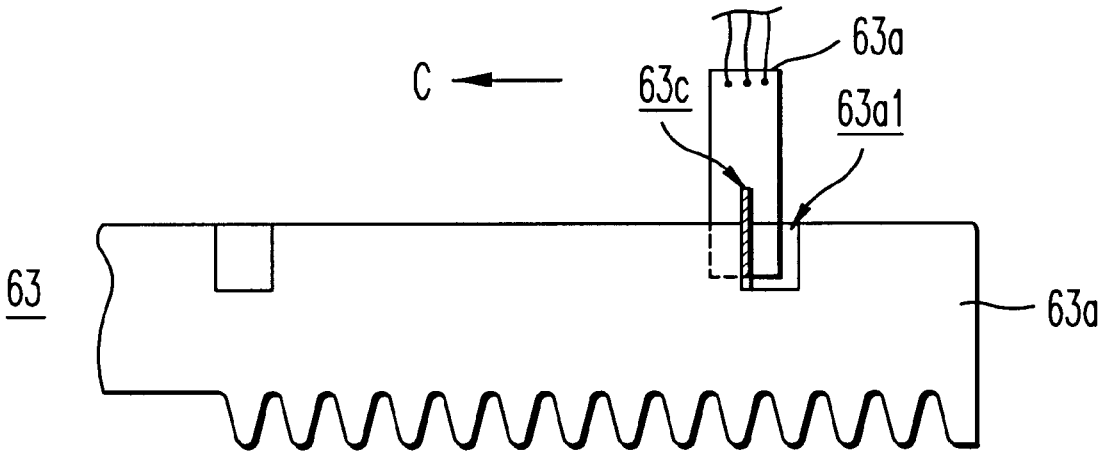
FIGS. 42(*a*) and 42(*b*) are schematic drawings illustrating another example of the open/close device.
Figure 42B:
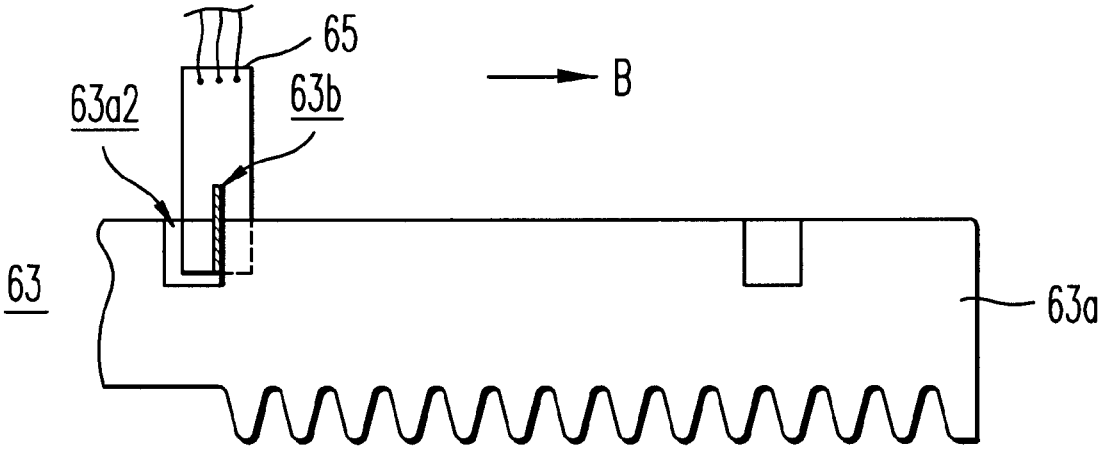

FIGS. 42(*a*) and 42(*b*) are schematic drawings illustrating another example of the open/close device 63. The open/close device 63 includes a detect device 65 that detects a position 63*c* of a light transmitting part 63*a*1 of the moving member 63*a*, at which the opening 1*a* of the toner container 1 is closed with the cap 61*b*, when the moving member 63*a* is moved in the direction indicated by an arrow L as illustrated in FIG. 42(*a*), or a position 63*b* of another light transmitting part 63*a*2 of the moving member 63*a*, at which the cap 61*b* is removed from the opening 1*a* to open the opening 1*a*, when the moving member 63*a* is moved in a direction indicated by an arrow K as illustrated in FIG. 42(*b*). In this example, the moving member 63*a* is made of material which does not transmit light. When each position is detected by the detect device 65, the drive device 64 stops the rotation movement with the rotation drive device 64*c* to stop the movement of the moving member 63*a*. Therefore, the worm wheel 64*a* and worm 64*b* are prevented from abrading each other at the engaged part. Even when the output power of a motor of the rotation drive device 64*c* is made small and an angle of the worm 64*b* relative to a moving direction of the worm 64*b* is small, such as for example, about three degrees, the worm wheel 64*a* and the worm 64*b* are prevented from abrading each other.

Figure 43:
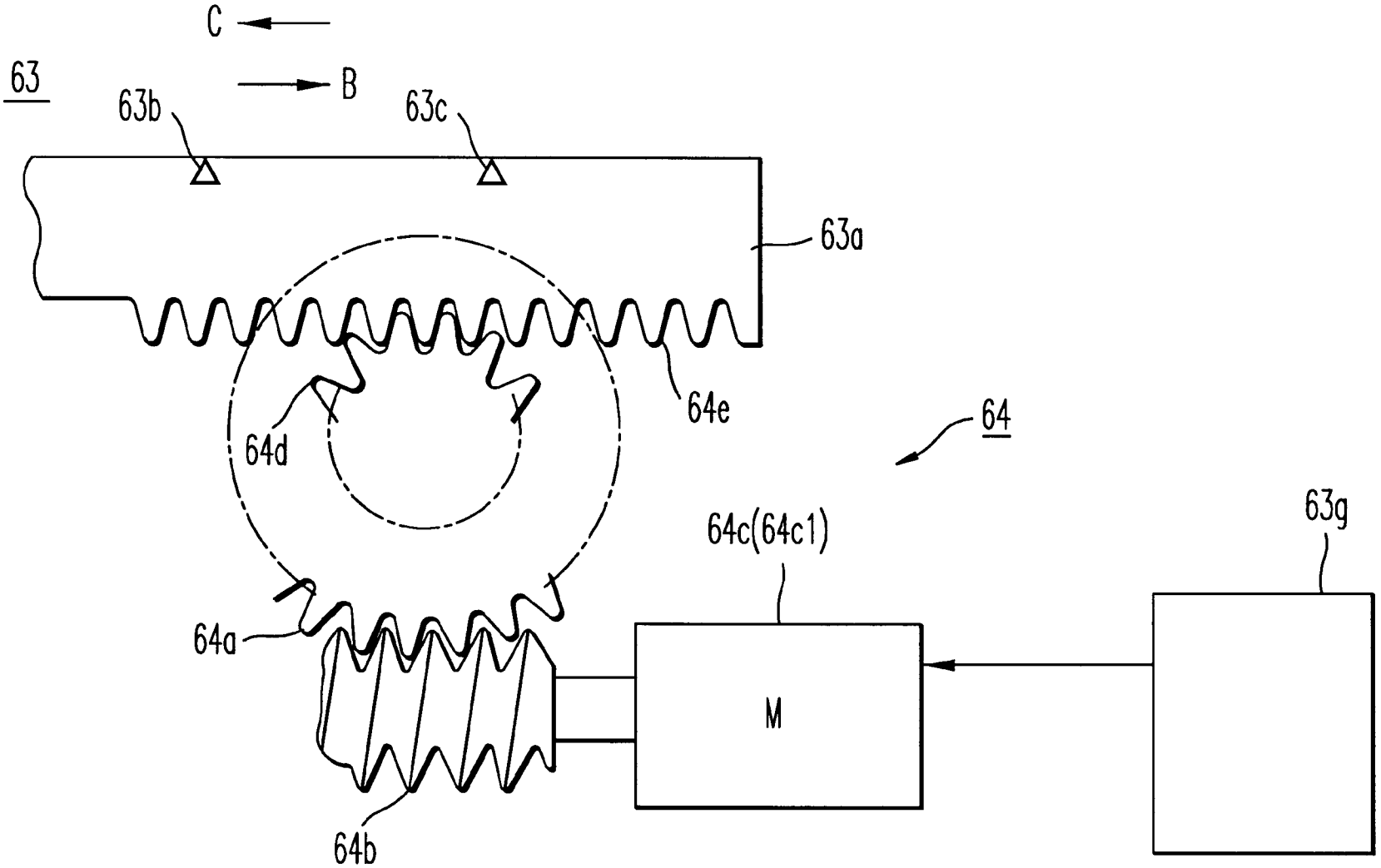
FIG. 43 is a schematic drawing illustrating still another example of the open/close device.

FIG. 43 is a schematic drawing illustrating still another example of the open/close device 63. The open/close device 63 includes a control device 63*g* that stores information of a number of steps to drive a stepping motor 64*c*1 of the rotation drive device 64*c* to move the moving member 63*a* to the position 63*b* at which the opening 1*a* of the toner container 1 is closed with the cap 61*b*, when the moving member 63*a* is moved in the direction indicated by an arrow L, or to the position 63*c* at which the opening 1*a* is closed with the cap 61*b*, when the moving member 63*a* is moved in the direction indicated by an arrow K. Therefore, the worm wheel 64*a* and the worm 64*b* are prevented from abrading each other at the engaged parts. Even when the output power of the motor 64*c*1 is small and an angle of the worm 64*b* relative to a moving direction of the worm 64*b* is small, such as for example, about three degrees, the worm wheel 64*a* and the worm 64*b* are prevented from abrading each other at the engaged parts, and thereby the opening 1*a* is securely closed and opened with the cap 61*b*.

Figure 44:
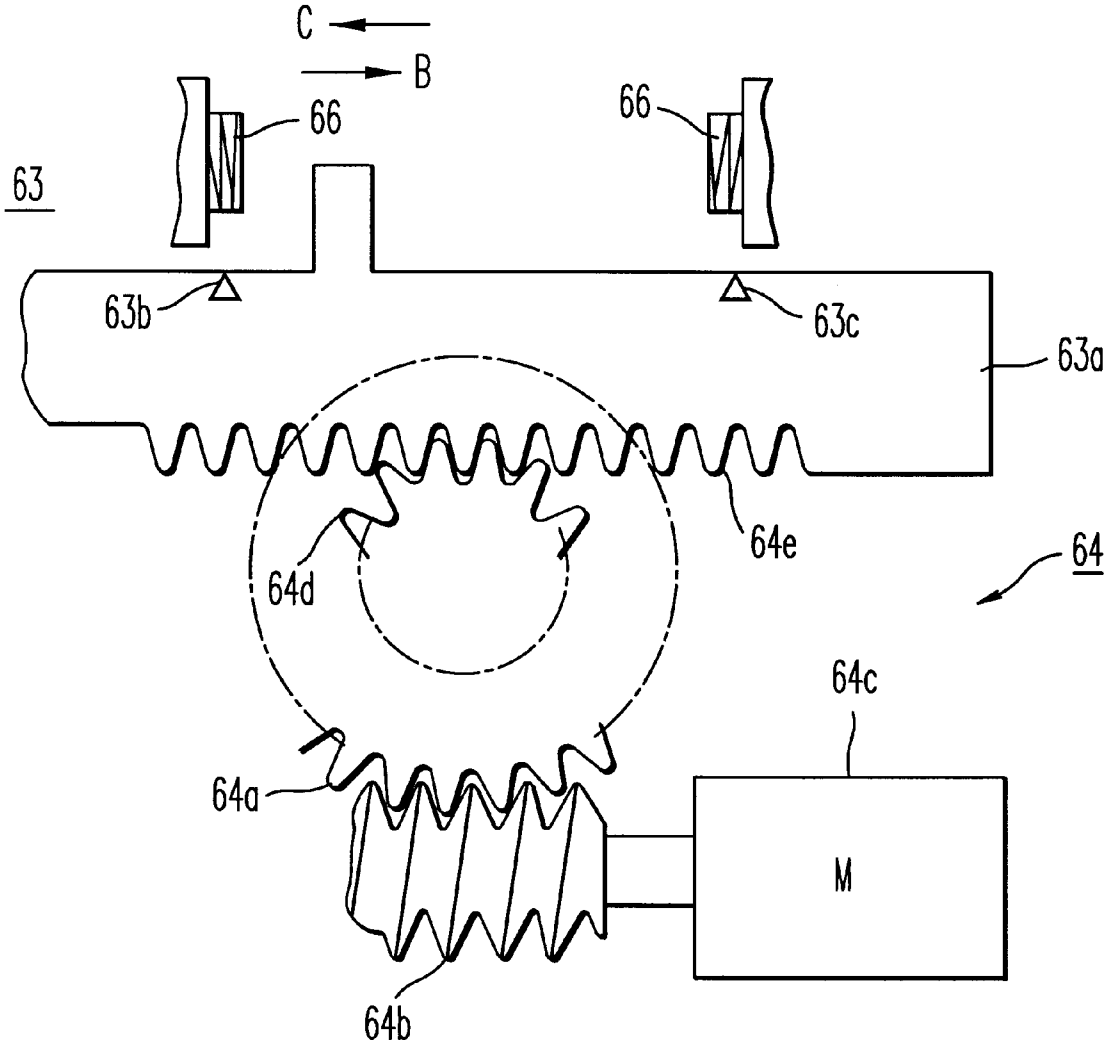
FIG. 44 is a schematic drawing illustrating still another example of the open/close device.

FIG. 44 is a schematic drawing illustrating still another example of the open/close device 63. The open/close device 63 includes a shock absorbing member 66, such as for example, a spring, at the positions 63*b* and 63*c*, respectively. Therefore, even when the motor for the rotation drive device 64*c* is turned off when the moving member 63*a* is moved to the position 63*b* or 63*c*, the worm wheel 64*a* and the worm 64*b* are prevented from abrading each other at the engaged parts, and thereby the opening 1*a* is securely closed and opened with the cap 61*b*.

Figure 45:
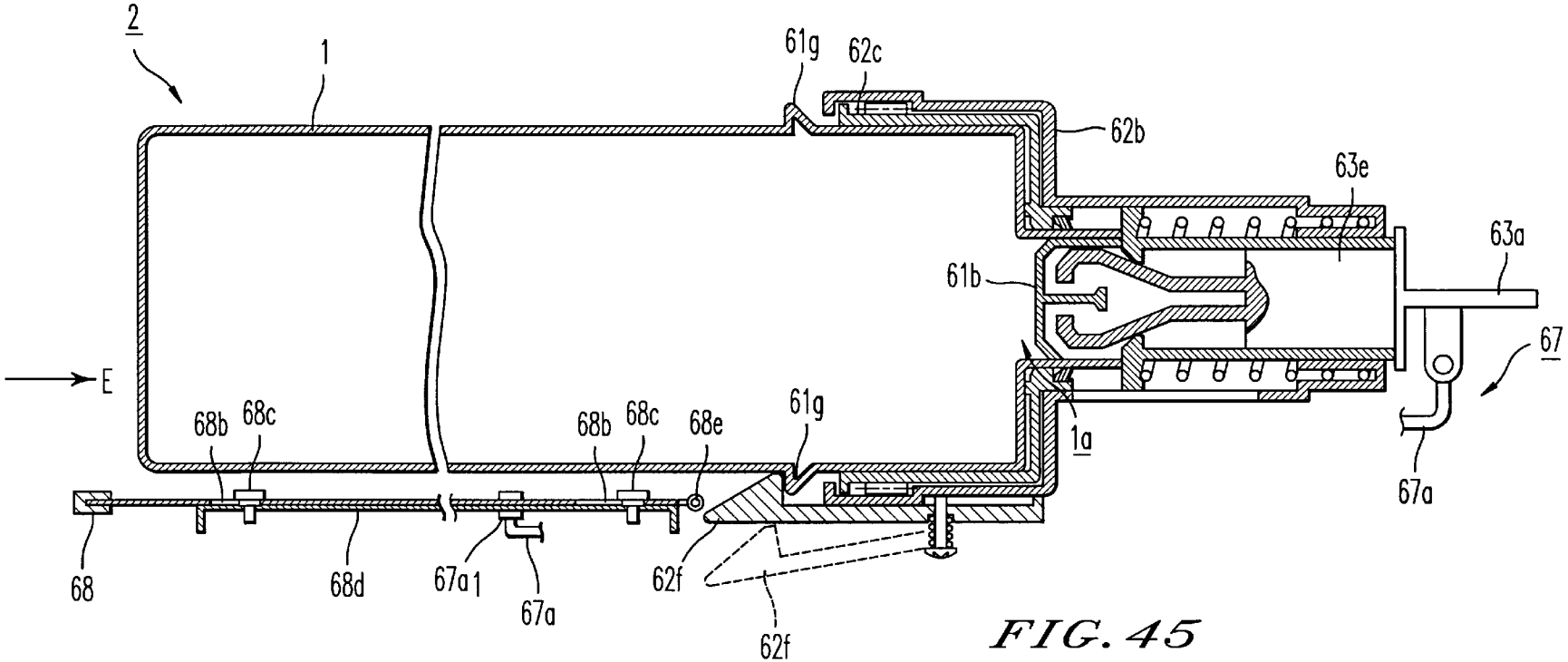
FIG. 45 is a schematic drawing illustrating an example of a construction of an operation lever used in the toner supplying device of FIGS. 35 and 37.
Figure 46:
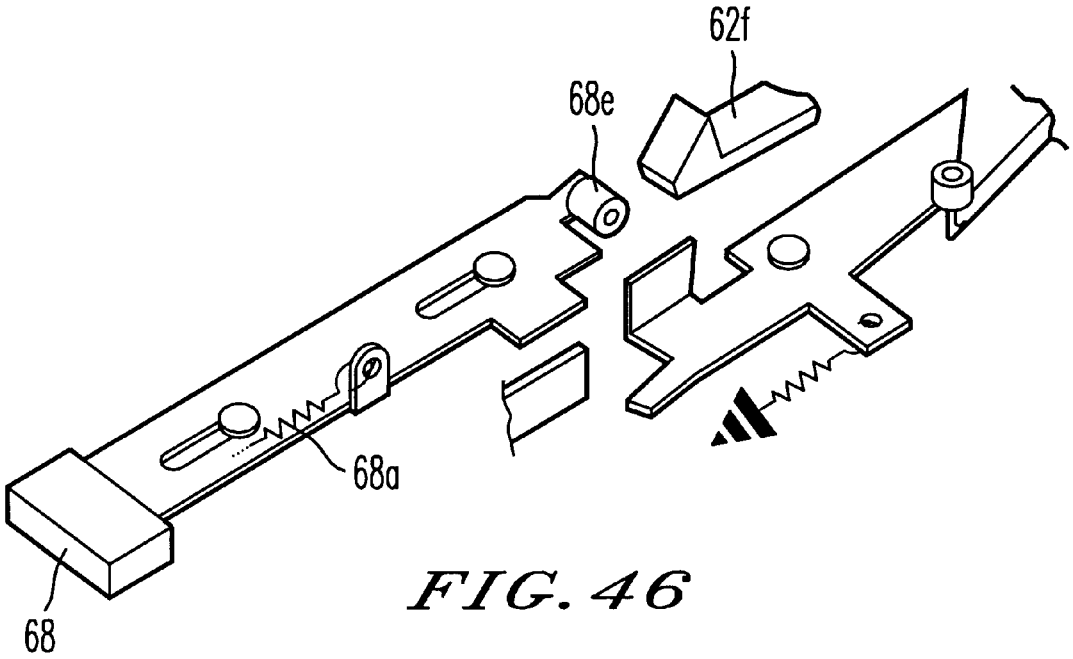
FIG. 46 is a detailed schematic drawing illustrating the structure of the operation lever.
Figure 47:
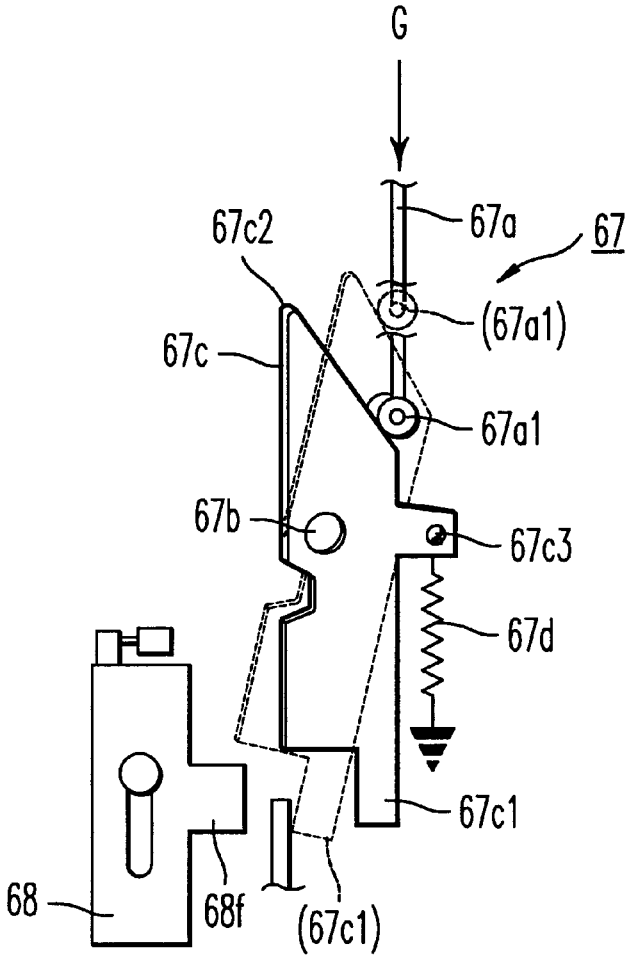
FIG. 47 is a schematic drawing illustrating an example of a locking member for the operation lever.

FIG. 45 is a schematic drawing illustrating an example of a construction of the operation lever 68. In FIG. 45, the operation lever 68 releases engagement of a stopper 62*f* and an engaging protrusion 61*g* of the toner container 1. An elongated hole 68*b* is opened at the lever 68 and the lever 68 is arranged so as to slide relative to a fixing wall member 68*d* by fixing a screw 68*c* to the fixing wall member 68*d* through the hole 68*b*. When the opening 1*a* of the toner container 1 is closed with the cap 61*b*, and if the operation lever 68 is pushed in a direction indicated by an arrow E, a roller 68*e*, which is freely rotatable and held at a position apart from the stopper 62*f* by a predetermined distance, slides along a slanted surface of the stopper 62*f*, and thereby the stopper 62*f* is moved downward as illustrated by a dotted line in FIG. 45. Thus, the engagement of the stopper 62*f* and the engaging protrusion 61*g* is released, such that the toner container 1 held by the holder 62*b* can be removed from the holder 62*b*.

When the cap 61*b* is removed from the opening 1*a* of the toner container 1 and the opening 1*a* is opened, even when the operating lever 68 is pushed to the direction indicated by the arrow E, the engagement of the stopper 62*f* and the engaging protrusion 61*g* is prevented from being released by a toner container removal prevention device 67, that includes a connecting rod 67*a* mechanically connecting to the moving member 63*a* and a roller 67*a*1 provided at a tip end of the connecting rod 67*a*. That is, the toner container 1 is prevented from being removed from the holder 62*b* when the opening 1*a* of the toner container 1 is not closed with the cap 61*b*.

When the toner bank 70 is inserted into the apparatus 100, the toner bank 70 is positioned in a position to be attached to the main body 0 of the apparatus 100 by a positioning member (not shown) and is fixed to the main body 0 of the apparatus 100 by fixing screws 712 as a fixing member. The screws 712 are removed when detaching the toner bank 70 from the main body 0 of the apparatus 100. Because the toner bank 70 can be detached from the main body 0 of the apparatus 100, as described above, the toner bank 70 can be assembled separately from the main body 0 of the apparatus 100, such that assembling of the main body 0 can be facilitated. Further, because the toner bank 70 is fixed when attached to the main body 0, the toner bank 70 is prevented from being unnecessarily detached from the main body 0. Therefore, unnecessary stoppage of the image forming operation due to unnecessary detachment of the toner bank 70 from the apparatus 100 is prevented.

Figure 48:
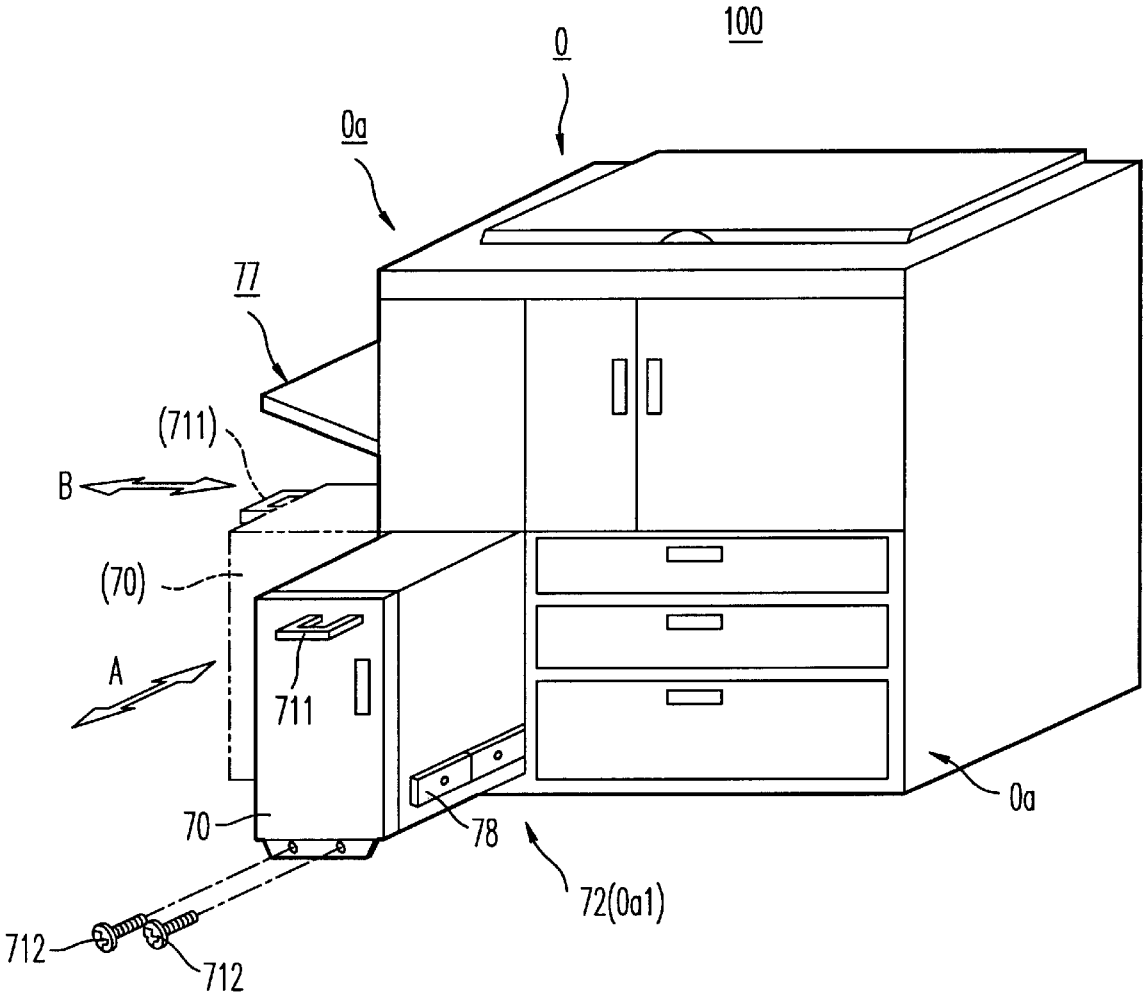
FIG. 48 is a schematic drawing illustrating an example of an image forming apparatus including a toner supplying device according to another embodiment of the present invention.

The opening 0*a*1 may alternatively be provided facing a side of the apparatus 100, for example, facing the side of the apparatus 100 where a copysheet exit tray 77 of the image forming apparatus 100 is located, such that the toner bank 70 (indicated by a dotted line) can be inserted into or removed from the main body 0 in a direction indicated by an arrow M in FIG. 48. By thus arranging the opening 0*a*1, the open space below the copysheet exit tray 77 is effectively utilized.

A guide member 78 is provided, as illustrated in FIG. 48, at the side of the toner bank 70 so as to guide the toner bank 70 in a direction to be inserted into or removed from the main body 0. Thus, the toner bank 70 can be easily attached to and detached from the main body 0. In addition, a handhold 711 is provided, for example, at a front surface of the toner bank 70 so as to facilitate the operation of inserting and removing the toner bank 70 to and from the main body 0.

Figure 49:
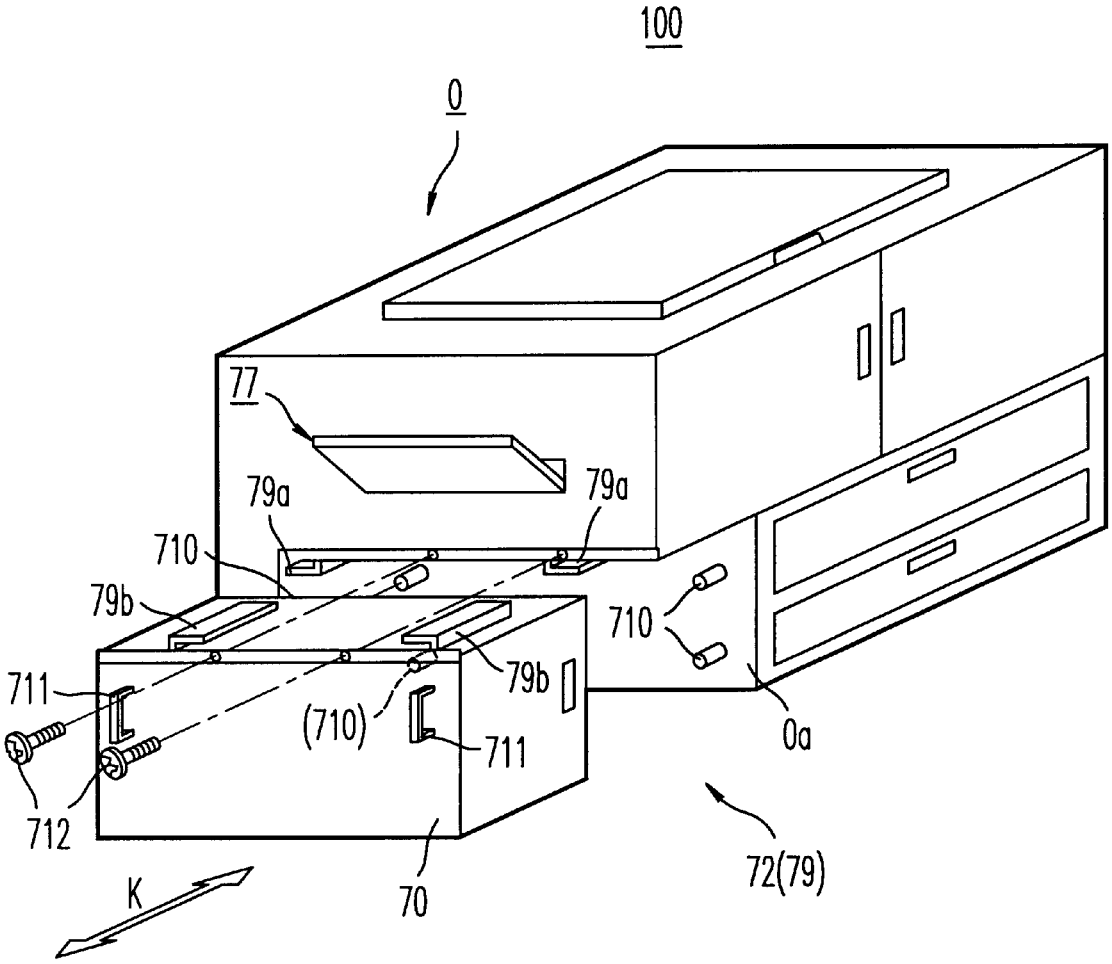
FIG. 49 is a schematic drawing illustrating an example of an image forming apparatus including a toner supplying device according to another embodiment of the present invention.

FIG. 49 is a schematic drawing illustrating an example of an image forming apparatus including a toner supplying device, according to another embodiment of the present invention. In FIG. 49, a guide member 79 of a toner supplying device holder 72 includes a pair of guide rails 79*a* provided at an outer circumferential surface 0*a* located below a copysheet exit tray 77 and a pair of guide rails 79*b* provided at an upper surface of a toner bank 70. When attaching and detaching the toner bank 70 to and from a main body 0 of the image forming apparatus 100, the guide rails 79*a* and 79*b* engage with each other such that the toner bank 70 is guided in a direction indicated by an arrow K so as to be inserted into or removed from the main body 0. When attaching the toner bank 70 to the main body 0, the toner bank 70 is positioned in a position to be attached to the main body 0 by four positioning members 710 provided at the outer circumferential surface 0*a* below the copysheet exit tray 77. The toner bank 70 is then fixed by fixing screws 712 to the main body 0. When detaching the toner bank 70 from the main body 0, the screws 712 are removed. The toner bank 70 is provided with a handhold 711 at both end sides of a front surface of the toner bank 70 so as to facilitate an operation of inserting and removing the toner bank 70 into and from the main body 0.

Obviously, numerous additional modifications and variations of the present inventions are possible in light of the above teachings. In particular, features described for certain embodiments may be employed in a logical manner to other embodiments described herein. It is therefore to be understood that within the scope of the appended claims, the present invention may be practiced otherwise than as specifically described herein.

This document is based on Japanese patent applications No. 10-027745 filed in the Japanese Patent Office on Jan. 26, 1998, No. 10-067913 filed on Mar. 3, 1998, No. 10-073605 filed on Mar. 6, 1998, No. 10-092736 filed on Mar. 20, 1998, and No. 10-120001 filed on Apr. 14, 1998, each of which the entire contents are incorporated by reference.

What is claimed as new and is desired to be secured by Letters Patent of the United States is:

1. A toner supplying device for supplying toner contained in a toner container to a developing device of an image forming apparatus, the toner supplying device comprising:

a toner container insertion part configured to receive an inserted toner container from a front side of the toner supplying device;

a toner container holder that detachably holds the toner container inserted into the toner container insertion part;

a toner exhaust path to which toner, discharged from the toner container held by the toner container holder, is exhausted;

a toner delivery device that delivers the toner exhausted to the toner exhaust path to the developing device of the image forming apparatus by mixing the toner with air; and a covering device that covers and uncovers the toner container insertion part, wherein the covering device includes a regulating device that prevents movement of the covering device of the toner container insertion part when toner is being discharged from the toner container held by the toner container holder in the toner container insertion part.

2. The toner supplying device of claim 1, wherein the toner container insertion part includes a plurality of toner container insertion parts configured to receive a corresponding plurality of inserted toner containers from the front side of the toner supplying device.

3. The toner supplying device of claim 2, wherein the covering device includes a plurality of covering devices that cover and uncover the plurality of toner container insertion parts.

4. The toner supplying device of claim 3, wherein each of the plurality of covering devices include a regulating device that prevents movement of a covering device of a corresponding toner container insertion part when toner is being discharged from the toner container held by the toner container holder in the corresponding toner container insertion part.

5. The toner supplying device of claim 4, wherein each regulating device releases a regulating movement of the covering device of the corresponding toner insertion part when toner is not being discharged from the toner container held by the toner container holder in the corresponding toner container insertion part.

6. An image forming apparatus, comprising:

a developing device; and a toner supplying device for supplying toner contained in a toner container to the developing device, the toner supplying device having:

a toner container insertion part configured to receive an inserted toner container from a front side of the toner supplying device;

a toner container holder that detachably holds the toner container inserted into the toner container insertion part;

a toner exhaust path to which toner, discharged from the toner container held by the toner container holder, is exhausted;

a toner delivery device that delivers the toner exhausted to the toner exhaust path to the developing device by mixing the toner with air; and a covering device that covers and uncovers the toner container insertion part, wherein the covering device includes a regulating device that prevents movement of the covering device of the toner container insertion part when toner is being discharged from the toner container held by the toner container holder in the toner container insertion part.

7. The image forming apparatus of claim 6, wherein the toner container insertion part includes a plurality of toner container insertion parts configured to receive a corresponding plurality of inserted toner containers from the front side of the toner supplying device.

8. The image forming apparatus of claim 7, wherein the covering device includes a plurality of covering devices that cover and uncover the plurality of toner container insertion parts.

9. The image forming apparatus of claim 8, wherein each of the plurality of covering devices include a regulating device that prevents movement of a covering device of a corresponding toner insertion part when toner is being discharged from the toner container held by the toner container holder in the corresponding toner container insertion part.

10. The image forming apparatus of claim 9, wherein each regulating device releases a regulating movement of the covering device of the corresponding toner insertion part when toner is not being discharged from the toner container held by the toner container holder in the corresponding toner container insertion part.

11. The image forming apparatus of claim 6, further comprising a front cover that opens and closes, and wherein an image forming operation is stopped when the front cover is opened, and the toner supplying device is arranged so as to be free from movement of the front cover to open and close.

12. An image forming apparatus, comprising:

a developing device;

a toner supplying device for supplying toner contained in a toner container to the developing device, the toner supplying device having:

a toner container insertion part configured to receive an inserted toner container from a front side of the toner supplying device;

a toner container holder that detachably holds the toner container inserted into the toner container insertion part;

a toner exhaust path to which toner, discharged from the toner container held by the toner container holder, is exhausted; and a toner delivery device that delivers the toner exhausted to the toner exhaust path to the developing device by mixing the toner with air; and a front cover that opens and closes, and wherein an image forming operation is stopped when the front cover is opened, and the toner supplying device is arranged so as to be free from movement of the front cover to open and close.

13. The image forming apparatus of claim 12, wherein the toner container insertion part includes a plurality of toner container insertion parts configured to receive a corresponding plurality of inserted toner containers from the front side of the toner supplying device.

14. The image forming apparatus of claim 13, wherein the toner supplying device further includes a plurality of covering devices that cover and uncover the plurality of toner container insertion parts.

15. The image forming apparatus of claim 14, wherein each of the plurality of covering devices include a regulating device that regulates movement of a covering device of a corresponding toner insertion part when toner is being discharged from the toner container held by the toner container holder in the corresponding toner container insertion part.

16. The image forming apparatus of claim 15, wherein each regulating device releases a regulating movement of the covering device of the corresponding toner insertion part when toner is not being discharged from the toner container held by the toner container holder in the corresponding toner container insertion part.

17. The image forming apparatus of claim 12, wherein the toner supplying device further includes a covering device that covers and uncovers the toner container insertion part.

18. The image forming apparatus of claim 17, wherein the covering device includes a regulating device that regulates movement of the covering device of the toner container insertion part when toner is being discharged from the toner container held by the toner container holder in the toner container insertion part.

* * * * *

UNITED STATES PATENT AND TRADEMARK OFFICE

CERTIFICATE OF CORRECTION

PATENT NO. : 6,091,912

DATED : July 18, 2000

INVENTOR(S): Yuuji KITAJIMA et al.

It is certified that an error appears in the above-ide[illegible] atent and that said Letters Patent is hereby corrected as shown below:

On the title page, item [54] and at the top of Column 1, is incorrectly listed. The Title should be:

-[54] TONER SUPPLYING DEVICE AND IMAGE FORMING APPARATUS USING SAME TONER SUPPLYING DEVICE--

Signed and Sealed this

Seventeenth Day of April, 2001

*Attest:*

Nicholas P. Godici

NICHOLAS P. GODICI

*Attesting Officer*

*Acting Director of the United States Patent and Trademark Office*